US011073781B2

(12) United States Patent
Ikada et al.

(10) Patent No.: US 11,073,781 B2
(45) Date of Patent: Jul. 27, 2021

(54) IMAGE FORMING APPARATUS THAT SUPPRESSES OCCURRENCE OF IMAGE SMEARING BY MAINTAINING A METAL SOAP ON A SURFACE OF A PHOTOCONDUCTOR

(71) Applicant: CANON KABUSHIKI KAISHA, Tokyo (JP)

(72) Inventors: Kosuke Ikada, Machida (JP); Go Shindo, Mishima (JP); Keitaro Nakata, Suntou-gun (JP); Hisashi Yamauchi, Numazu (JP); Shinichi Agata, Suntou-gun (JP); Yoshihiro Mitsui, Mishima (JP); Masahito Kato, Suntou-gun (JP); Yuichiro Hirata, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/905,764

(22) Filed: Jun. 18, 2020

(65) Prior Publication Data

US 2020/0409297 A1 Dec. 31, 2020

(30) Foreign Application Priority Data

Jun. 27, 2019 (JP) ..... JP2019-120445
Jun. 27, 2019 (JP) ..... JP2019-120449
Jun. 27, 2019 (JP) ..... JP2019-120450

(51) Int. Cl.
*G03G 15/00* (2006.01)
*G03G 21/00* (2006.01)
(Continued)

(52) U.S. Cl.
CPC ..... *G03G 15/5037* (2013.01); *G03G 9/08773* (2013.01); *G03G 9/09791* (2013.01);
(Continued)

(58) Field of Classification Search
CPC ..... G03G 15/50; G03G 15/5037; G03G 21/0094; G03G 2215/00071; G03G 9/08773; G03G 9/09791
See application file for complete search history.

(56) References Cited

U.S. PATENT DOCUMENTS 6,014,530 A * 1/2000 Tsunemi ..... G03G 21/0005 399/26
2007/0217829 A1* 9/2007 Tanida ..... G03G 15/0131 399/299

(Continued)

FOREIGN PATENT DOCUMENTS

JP 2005-121833 A 5/2005
JP 4027407 B2 12/2007
JP 2016-38591 A 3/2016

*Primary Examiner* — Sophia S Chen
(74) *Attorney, Agent, or Firm* — Canon U.S.A., Inc., IP Division

(57) ABSTRACT

An image forming apparatus that executes an image forming operation for forming a toner image on a recording material and an application operation of applying a metal soap to a surface of an image bearing member by supplying a toner stored in a toner storing unit to the surface of the image bearing member from the developing member. A surficial moving speed of the image bearing member during the application operation is lower than the surficial moving speed of the image bearing member during the image forming operation, and a speed difference between the surficial moving speed of the developing member and the surficial moving speed of the image bearing member during the application operation is larger than that during the image forming operation.

74 Claims, 25 Drawing Sheets

(51) Int. Cl.
*G03G 9/097* (2006.01)
*G03G 9/087* (2006.01)

(52) U.S. Cl.
CPC ..... *G03G 21/0094* (2013.01); *G03G 2215/00071* (2013.01)

(56) References Cited

U.S. PATENT DOCUMENTS

| | | | | |
|---|---|---|---|---|
| 2010/0119260 | A1* | 5/2010 | Egawa | G03G 5/14791 399/159 |
| 2015/0192877 | A1* | 7/2015 | Fujioka | 399/43 |
| 2015/0261129 | A1* | 9/2015 | Hayashi | G03G 15/065 399/55 |
| 2016/0370745 | A1* | 12/2016 | Suzumi | G03G 15/55 |
| 2019/0101844 | A1* | 4/2019 | Mochizuki | G03G 21/0094 |

* cited by examiner

IMAGE FORMING APPARATUS THAT SUPPRESSES OCCURRENCE OF IMAGE SMEARING BY MAINTAINING A METAL SOAP ON A SURFACE OF A PHOTOCONDUCTOR

BACKGROUND OF THE INVENTION

Field of the Invention

The present disclosure relates to an image forming apparatus. Here, an image forming apparatus is an apparatus that forms an image on a recording material (recording medium) by using an electrophotographic image forming system. Examples of the image forming apparatus include copying machines, printers (laser beam printers, LED printers, etc.), facsimile machines, word processors, and multifunctional machines (multifunctional printers).

Description of the Related Art

Typically, organic photoconductors, which offer advantages of low cost and high productivity, have been widely used as electrophotographic photoconductors (hereinafter, may be simply referred to as "photoconductors") of electrophotographic image forming apparatuses. In an organic photoconductor, a photosensitive layer (organic photosensitive layer) that uses an organic material as a photoconductive material (charge generation material or charge transport material) is disposed on a supporting member.

In the respective steps of charging, exposing, developing, transferring, and cleaning, an electrical external force and a mechanical external force are directly applied to a photoconductor; thus, the photoconductor is required to have endurance that withstands these external forces. Specifically, endurance against occurrence of scratches and wear in the surface caused by these external forces, in other words, the scratch resistance and the wear resistance, is required.

However, suppressing the wear of the photoconductor causes refreshing of the photoconductor surface to be more difficult; in particular, in a high-humidity environment, blurring of an electrostatic latent image known as "image smearing" is likely to occur. Image smearing occurs mainly when corona products, such as ozone and NOx, generated by discharge at the charged photoconductor surface adhere to the surface of the photoconductor and decrease the surface resistance of the photoconductor. When the friction coefficient of the surface of the photoconductor is decreased to increase the hardness and to suppress wear of the photoconductor, the surface becomes more difficult to scrape, and thus the corona products adhering to the surface are not easily removed. As a result, the corona products adhering to the surface of the photoconductor absorb moisture in a high humidity environment, decrease the resistance, degrade the charge retaining ability of the surface of the photoconductor, and cause image smearing.

Japanese Patent Laid-Open No. 2005-121833 proposes, as a method for preventing occurrence of image smearing, a method that involves adding a metal soap to a developer and supplying the metal soap to the photoconductor surface from a developer bearing member. According to this method, zinc stearate, i.e., a metal soap, is supplied to the surface of the photoconductor by using a developer bearing member so as to cover the surface of the photoconductor with zinc stearate, suppress attachment of corona products, and prevent occurrence of image smearing.

However, the metal soap supplied to the photoconductor by the method described in Japanese Patent Laid-Open No. 2005-121833 is scraped away by a member, such as a cleaning unit, that contacts the photoconductor as the photoconductor rotates, and thus image smearing has sometimes occurred.

SUMMARY OF THE INVENTION

The present disclosure suppresses occurrence of image smearing by maintaining a sufficient amount of a metal soap on a surface of a photoconductor.

According to a first aspect of the disclosure, an image forming apparatus that forms a toner image on a recording material includes: a rotatable image bearing member; a charging member that charges a surface of the image bearing member; a toner storing unit that stores a toner containing a metal soap; a developing member that forms a toner image by supplying the toner to the surface of the image bearing member, which is charged by the charging member, in a developing portion where the developing member opposes the image bearing member; and a control unit that controls a rotation speed of the image bearing member so that a surficial moving speed of the developing member is higher than a surficial moving speed of the image bearing member. An image forming operation for forming the toner image on a recording material and an application operation of applying the metal soap to the surface of the image bearing member by supplying the toner stored in the toner storing unit to the surface of the image bearing member from the developing member are executed. The control unit performs control so that a surficial moving speed of the image bearing member during the application operation is lower than the surficial moving speed of the image bearing member during the image forming operation, and so that a speed difference between the surficial moving speed of the developing member and the surficial moving speed of the image bearing member during the application operation is larger than that during the image forming operation.

According to a second aspect of the disclosure, an image forming apparatus that forms a toner image on a recording material includes: a rotatable image bearing member; a charging member that charges a surface of the image bearing member; a toner storing unit that stores a toner containing a metal soap; a developing member that forms a toner image by supplying the toner to the surface of the image bearing member, which is charged by the charging member, in a developing portion where the developing member opposes the image bearing member; a voltage applying unit that applies a charging voltage to the charging member; a current detection unit that detects a current flowing from the charging member to the image bearing member while the charging voltage is being applied to the voltage applying unit; and a control unit that controls the voltage applying unit. An image forming operation for forming the toner image on a recording material and an application operation of applying the metal soap to the surface of the image bearing member by supplying the toner stored in the toner storing unit to the surface of the image bearing member from the developing member are executed. The application operation is not executed when a current value of the current detected by the current detection unit is a first current value, and the application operation is executed when the current value is a second current value having an absolute value larger than that of the first current value.

According to a third aspect of the disclosure, an image forming apparatus that forms a toner image on a recording material includes: a rotatable image bearing member; a charging member that charges a surface of the image bearing member; a toner storing unit that stores a toner containing a metal soap; a developing member that forms a toner image by supplying the toner to the surface of the image bearing member, which is charged by the charging member, in a developing portion where the developing member opposes the image bearing member; a voltage applying unit that applies a charging voltage to the charging member; a control unit that performs control to enable execution of an image forming operation for forming the toner image on a recording material and an application operation of applying the metal soap to the surface of the image bearing member by supplying the toner stored in the toner storing unit to the surface of the image bearing member from the developing member; a determination unit that determines whether or not to execute the application operation on the basis of a current value of a current flowing from the charging member to the image bearing member when the charging voltage is being applied to the charging member, information regarding an environment in which the image forming apparatus is used, and information regarding an execution time for the image forming operation; and an estimating unit that estimates the current value. The determination unit determines whether or not to execute the application operation on the basis of the current value estimated by the estimating unit during the image forming operation.

Further features of the present disclosure will become apparent from the following description of exemplary embodiments with reference to the attached drawings.

DESCRIPTION OF THE EMBODIMENTS

Figure 1:
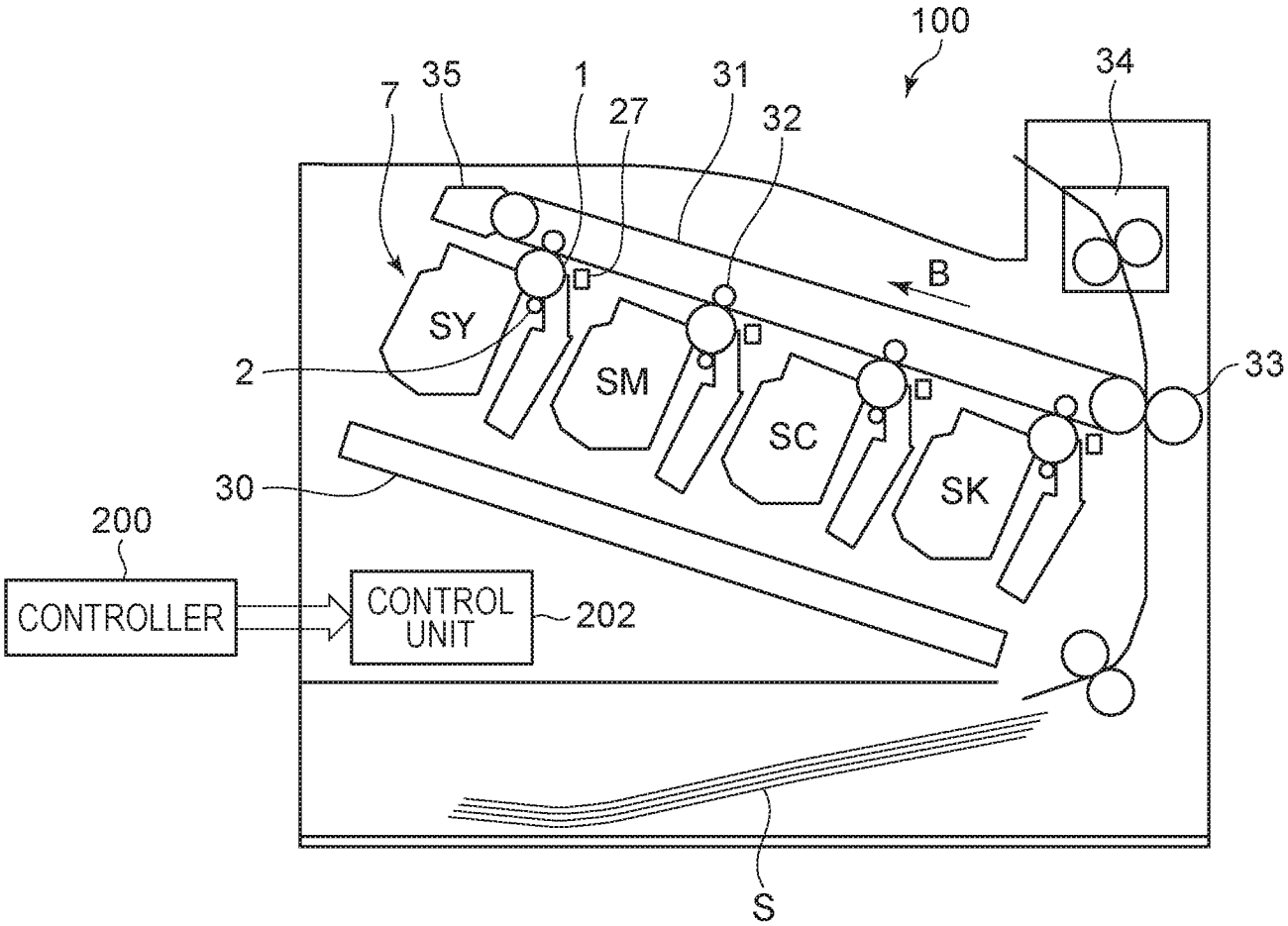
FIG. 1 is a schematic cross sectional view of an image forming apparatus of Example 1.

Exemplary embodiments of the present disclosure will now be described with reference to the drawings. The embodiments described below are merely exemplary and contents of the embodiments do not limit the present disclosure. Moreover, in the drawings described below, constituent elements not necessary for describing the embodiments are omitted from the drawings.

1. Image Forming Apparatus

The overall structure of an electrophotographic image forming apparatus according to Example 1 will now be described. FIG. 1 is a schematic cross-sectional view of an image forming apparatus 100 of Example 1. The image forming apparatus 100 is a full-color laser printer that employs an in-line system and an intermediate transfer system. On the basis of image information, the image forming apparatus 100 can form a full color image on a recording material S (for example, a recording sheet, a plastic sheet, or a cloth). The image information is input to the image forming apparatus 100 from an image reader (not illustrated) connected to the image forming apparatus 100 or a host device (not illustrated) such as a personal computer that is connected to and can communicate with the image forming apparatus 100.

The image forming apparatus 100 includes multiple image forming units, namely, first, second, third, and fourth image forming units SY, SM, SC, and SK for respectively forming yellow (Y), magenta (M), cyan (C), and black (K) images.

In Example 1, the image forming apparatus 100 includes multiple image bearing members, namely, four drum-shaped electrophotographic photoconductors (hereinafter referred to as photoconductors 1) that are arranged side-by-side in a direction intersecting the vertical direction, and one photoconductor 1 and one image forming unit are integrated to constitute a process cartridge 7.

The photoconductor 1 that serves as an image bearing member that bears an electrostatic latent image is driven and rotated by a driving unit (not illustrated). A charging roller 2 that serves as a charging member is a single-layer roller constituted by a conductive core metal and a conductive rubber layer, and has an outer diameter ϕ of 7.5 mm and a volume resistivity of $10^3$ to $10^{6\Omega}$·cm. The surface of the photoconductor 1 is evenly charged to −500 V when a charging voltage of −1000 V is applied to the charging roller 2 by a charging high voltage 71 that serves as a charging voltage applying unit that serves as a high-voltage power source described below. A DC (direct current) voltage of Vd+Vth is applied to the charging roller 2, and the photoconductor 1 is evenly charged at the charging potential Vd by discharge. Vd here is called a dark potential and is −500 V. Vth is a discharge start voltage. The surface potential of the photoconductor 1 does not increase by discharge when the applied charging voltage is small; however, from the discharge start voltage Vth, the surface potential starts to increase. In other words, the discharge start voltage Vth in Example 1 is −500 V.

After the surface of the photoconductor 1 is charged by the charging roller 2, a laser beam is applied from an exposure unit 30 to the surface of the photoconductor 1. The exposure unit 30 is an exposure unit that forms an electrostatic latent image on the surface of the photoconductor 1 on the basis of the image information by irradiating the surface with the laser. The surface of the photoconductor 1 irradiated with the laser beam undergoes changes in surface potential to −100 V, which is the light potential VL, and an electrostatic latent image is formed as a result.

Figure 2:
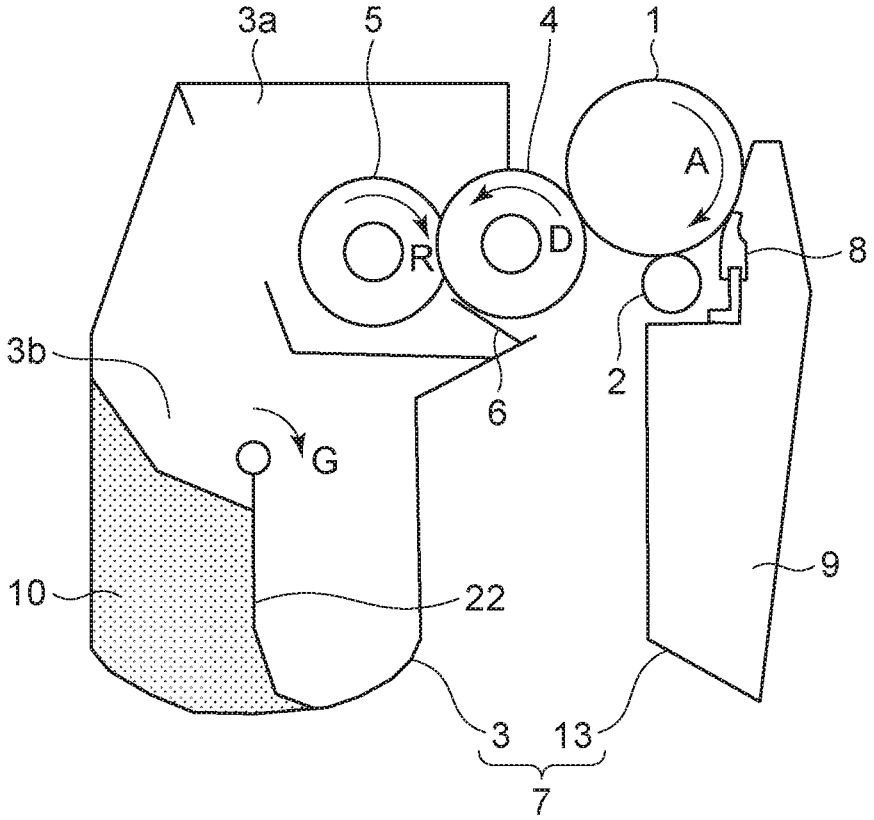
FIG. 2 is a cross sectional view of a process cartridge of Example 1.

FIG. 2 is a sectional view of the process cartridge 7 of Example 1 as viewed in the longitudinal direction (rotational axis direction) of the photoconductor 1. The process cartridge 7 is constituted by a developing unit 3 and a photoconductor unit 13. The developing unit 3 is equipped with a developing roller 4, which serves as a developing member, and a toner supplying roller (hereinafter referred to as the "supplying roller") 5, which serves as a toner supplying member. The developing roller 4 starts rotating in the arrow D direction in FIG. 2, and the supplying roller 5 starts rotating in the arrow R direction in FIG. 2. When a voltage of −300 V is applied as a developing voltage to the developing roller 4 from a development high voltage 72 that serves as a developing voltage applying unit, a developer (toner) is supplied to the electrostatic latent image formed on the surface of the photoconductor 1, in other words the aforementioned VL portion, to develop the electrostatic latent image.

The developer image (toner image) developed on the surface of the photoconductor 1 is transferred onto an intermediate transfer belt 31 illustrated in FIG. 1. The intermediate transfer belt 31 is an endless belt that opposes the photoconductors 1 of the image forming units and serves as an intermediate transfer body for transferring the toner images on the photoconductors 1 onto the recording material S. The intermediate transfer belt 31 abuts against the photoconductors 1 of the image forming units and circulates (rotates) in the arrow B direction (counterclockwise direction) in FIG. 1.

Primary transfer rollers 32 that serve as transfer members serving as a primary transfer unit are arranged on the inner peripheral surface side of the intermediate transfer belt 31 so as to oppose the photoconductors 1. A voltage opposite in polarity to the normal charging polarity of the toner is applied to each of the primary transfer rollers 32 from a primary transfer voltage power source (primary transfer high voltage) 73 serving as a primary transfer voltage applying unit. As a result, the toner images on the photoconductors 1 are transferred (primary transfer) onto the intermediate transfer belt 31. The polarity of the toner in this embodiment is set so that the normal polarity is a negative polarity. Thus, primary transfer can be carried out by applying a positive voltage as the primary transfer voltage.

A secondary transfer roller 33 that serves as a secondary transfer unit is arranged on the outer peripheral surface side of the intermediate transfer belt 31. A voltage opposite in polarity to the polarity of the toner is applied to the secondary transfer roller 33 from a secondary transfer voltage power source (secondary transfer high voltage) 74 serving as a secondary transfer voltage applying unit. As a result, the toner images on the intermediate transfer belt 31 are transferred (secondary transfer) onto the recording material S. For example, when forming a full color image, the aforementioned process is sequentially performed in the image forming units SY, SM, SC, and SK, and the toner images of the respective colors on the intermediate transfer belt 31 are sequentially stacked on top of each other to carry out primary transfer. Next, in synchronization with the movement of the intermediate transfer belt 31, the recording material S is conveyed to a secondary transfer portion. The toner images in four colors on the intermediate transfer belt 31 are transferred in a single batch (secondary transfer) onto the recording material S by the action of the secondary transfer roller 33 abutting against the intermediate transfer belt 31 with the recording material S therebetween.

The recording material S with the toner images transferred thereon are conveyed to a fixing device 34. In the fixing device 34, heat and pressure are applied to the recording material S to fix the toner images to the recording material S, and the recording material S is discharged out of the image forming apparatus 100.

Meanwhile, the surface potential of the photoconductor 1 after transfer of the toner to the intermediate transfer belt 31 is uneven due to the applied primary transfer voltage. Thus, whole surface exposure (irradiating the whole surface with light) is carried out on the photoconductor 1 by using a pre-exposure unit 27 so as to even out the surface potential of the photoconductor 1, which has been made uneven due to the previous image formation. In other words, the surface of the photoconductor 1 is irradiated with light to erase the residual charges on the surface of the photoconductor 1. The pre-exposure unit 27 is disposed on the downstream side of a transfer portion where the intermediate transfer belt 31 and the photoconductor 1 abut against each other with respect to the rotation direction of the photoconductor 1, and yet on the upstream side of a charging portion where the charging roller 2 and the photoconductor 1 abut against each other with respect to the rotation direction of the photoconductor 1. The pre-exposure unit 27 exposes, with light, a part of the surface of the photoconductor 1 that opposes the pre-exposure unit 27. Examples of the light source of the pre-exposure unit 27 include a light-emitting diode (LED) and a halogen lamp. Although the light source used is not particularly limited, an LED is advantageous since it has low driving voltage and is compact in size. Thus, in Example 1, an LED is used as the pre-exposure light source.

The toner that was not transferred by the primary transfer roller 32 and remained on the surface of the photoconductor 1 is scraped off from the surface of the photoconductor 1 by a cleaning blade 8 in contact with the photoconductor 1, and stored in a waste toner storage chamber 9 disposed below the cleaning blade 8. The toner that was not transferred onto the recording material S by the secondary transfer roller 33 and remained on the intermediate transfer belt 31 is conveyed to an intermediate transfer body cleaning device 35 serving as a cleaning device and removed.

2. Control Mode of Image Forming Apparatus

Figure 3:
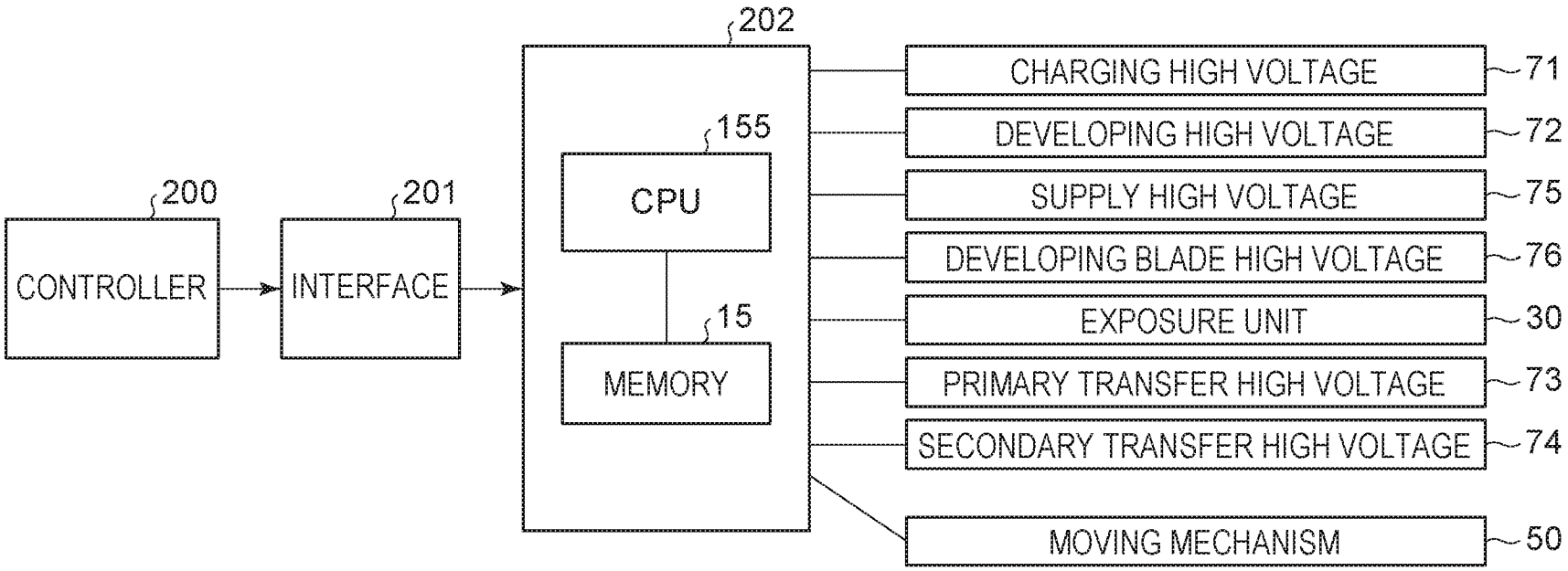
FIG. 3 is a schematic block diagram illustrating a control mode of the image forming apparatus in Example 1.

FIG. 3 is a block diagram illustrating a schematic control mode of relevant parts of the image forming apparatus 100 of Example 1. A control unit 202 is a unit that controls the operation of the image forming apparatus 100 and exchanges various electrical information signals. In addition, the control unit 202 processes electrical information signals input from various processing apparatuses and sensors and processes command signals to various processing apparatuses. A controller 200 exchanges various pieces of electrical information with a host apparatus 300, and integrally controls the image forming operation of the image forming apparatus 100 in accordance with a predetermined control program and reference tables through an interface 201 and the control unit 202. The control unit 202 is constituted by a CPU 155, which is a central device for performing various calculation processes, and a memory 15, which is a storage device such as a RAM or ROM. The RAM stores detection results from sensors, count results from counters, calculation results, etc., and the ROM stores control programs and data tables obtained by preliminary experiments and the like. Subjects to be controlled in the image forming apparatus 100, sensors, counters, etc., are connected to the control unit 202. The control unit 202 controls exchange of various electrical information signals and timings for driving respective units so as to control a predetermined image forming sequence or the like. For example, in order to form a toner image on the surface of the photoconductor 1, the control unit 202 controls the following high-voltage power sources and devices. The control unit 202 controls the charging high voltage 71 serving as a charging power source, the development high voltage 72 serving as a developing power source, a supply high voltage 75 serving as a power source for the supplying roller 5 that supplies a toner supplying voltage, a developing blade high voltage 76 serving as a power source for the developing blade 6 serving as a toner regulating member, the exposure unit 30, etc. Furthermore, the control unit 202 controls the primary transfer high voltage 73 serving as the primary transfer voltage power source, the secondary transfer high voltage 74 serving as a secondary transfer power source, etc., so as to form a toner image on the recording material S. In addition, the control unit 202 controls a moving mechanism 50 that causes the developing roller 4 and the photoconductor 1 to move close to or far from each other. In Example 1, the control unit 202 controls the aforementioned high voltages etc., to perform a metal soap application operation described in detail below.

3. Schematic Structure of Process Cartridge

The overall structure of the process cartridge 7 loaded into the image forming apparatus 100 of Example 1 will now be described with reference to FIG. 2. The process cartridge 7 is detachably attachable to the image forming apparatus 100 through an attaching unit, such as an attachment guide, a positioning member, etc., not illustrated in the drawing in the image forming apparatus 100. In Example 1, the process cartridges 7 of respective colors are identical in shape, and the process cartridges 7 of respective colors contain toners 10 of respective colors, that is, yellow (Y), magenta (M), cyan (C), and black (K). In Example 1, the process cartridge 7 is described; alternatively, the single developing unit 3 may be constituted as a developing cartridge detachably attachable to the image forming apparatus 100.

In Example 1, the structure and operation of the process cartridges 7 of respective colors are substantially the same except for the type (color) of the toner 10 contained therein.

The process cartridge 7 is equipped with a developing unit 3 that includes a developing roller 4 etc., and a photoconductor unit 13 that includes a photoconductor 1.

In this embodiment, the developing unit 3 and the photoconductor unit 13 are integrated to form a process cartridge 7; however, this is not limiting. The developing unit 3 and the photoconductor unit 13 may be configurated as a developing cartridge and a photoconductor cartridge, respectively, that are detachably attachable to the image forming apparatus 100.

The developing unit 3 is roughly divided into a developing chamber 3*a* and a toner storing unit 3*b*. The toner storing unit 3*b* is equipped with a toner conveying member 22 that conveys the toner 10 to the developing chamber 3*a*, and the toner conveying member 22 conveys the toner 10 to the developing chamber 3*a* as it rotates in the arrow G direction in the drawing.

The developing chamber 3*a* is equipped with the developing roller 4 that contacts the photoconductor 1, rotates in the arrow D direction in the drawing, and serves as a toner bearing member. In Example 1, the developing roller 4 and the photoconductor 1 rotate so that the surfaces thereof move in the same direction in a developing portion where the developing roller 4 and the photoconductor 1 oppose each other.

The supplying roller 5 that supplies the toner 10, which has been conveyed from the toner storing unit 3*b*, to the developing roller 4 and a toner regulating member 6 that regulates the coat amount of the toner 10 on the developing roller 4 supplied by the supplying roller 5, and imparts charges are disposed inside the developing chamber 3*a*.

Independent voltages are applied to the developing roller 4, the supplying roller 5, and the toner regulating member 6 from high-voltage power sources. The toner 10 supplied to the developing roller 4 by the supplying roller 5 is frictionally charged by friction between the developing roller 4 and the toner regulating member 6 and becomes charged. At the same time, the layer thickness of the toner 10 is regulated. The regulated toner 10 on the developing roller 4 is conveyed to a part where the developing roller 4 and the photoconductor 1 oppose each other as the developing roller 4 rotates, and develops and visualizes the electrostatic latent image on the photoconductor 1 into a toner image.

In the present disclosure, the predetermined DC voltage (developing voltage: Vdc) applied to the developing roller 4 is set to −300 V. Moreover, by applying a voltage (supplying voltage: Vr=−250 V) to the supplying roller 5, the potential difference (ΔVr) between the supplying roller 5 and the developing roller 4 can be adjusted and the amount of the toner 10 supplied to the developing roller 4 can be adjusted. In Example 1, ΔVr=Vdc-Vr is set to −50 V.

In Example 1, when an electrostatic latent image on the photoconductor 1 is developed and visualized into a toner image, the developing roller 4 is rotated and driven so as to contact the peripheral surface of the photoconductor 1. This is to make it easier to supply a metal soap externally added to the toner described below onto the photoconductor 1. The structure is not limited to the one in which the developing roller 4 and the photoconductor 1 contact each other as long as a metal soap can be supplied.

In the following description regarding the potential and the applied voltage, a potential is referred to as "high" when the absolute value is large on the negative polarity side (for example, −1000 V is high relative to −500 V), and a potential is referred to as "low" when the absolute value is small on the negative polarity side (for example, −300 V is low relative to −500 V). This is because the toner 10 having the negative chargeability is considered as a reference in Example 1.

In Example 1, the voltage is expressed as a potential difference relative to the earth potential (0 V). Thus, the developing voltage=−300 V is interpreted as having a potential difference of −300 V by the developing voltage applied to the core metal of the developing roller 4 with respect to the earth potential. The same applies to other voltages, such as a charging voltage.

The photoconductor 1 is rotatably attached to the photoconductor unit 13 via a bearing (not illustrated). The photoconductor 1 is driven to rotate in the arrow A direction in FIG. 2 by receiving a driving force of a driving motor not illustrated in the drawings. In the photoconductor unit 13, the charging roller 2 and the cleaning blade 8 that serves as a plate-shaped elastic body are arranged to contact the peripheral surface of the photoconductor 1. The cleaning blade 8 has one end fixed to a plate-shaped meatal plate and another free end abutting against the photoconductor 1, and a cleaning nip, which is an abutting part where the cleaning blade 8 abuts against the photoconductor 1, is formed. The surface of the photoconductor 1 is rubbed with the cleaning blade 8 so that the toner 10 remaining from the transferring step and microparticles are scraped off and housed in the waste toner storage chamber 9. As a result, contamination of the charging roller 2 and adverse effects on the image caused by dragging the toner 10 onto the photoconductor 1 are prevented.

4. Structure of Photoconductor

The photoconductor 1 is constituted by a cylindrical metal support member having electroconductivity, a conductive layer that serves as an undercoat layer of the support member, photosensitive layers (charge generation layer and charge transport layer) formed on the undercoat layer, and a protective layer formed on the photosensitive layer. The photoconductor 1 is obtained by forming a photosensitive material, such as an organic photosemiconductor (OPC), amorphous selenium, or amorphous silicon, on a cylindrical drum base composed of aluminum, nickel, or the like having an outer diameter (of 24 mm and serving as a support member. Furthermore, the photoconductor 1 of Example 1 has a wear-resistant protective layer as the uppermost surface layer in order to improve the wear resistance. The protective layer improves endurance.

The protective layer can contain a resin and conductive particles and/or a charge transport material. Examples of the conductive particles include particles of metal oxides such as titanium oxide, zinc oxide, tin oxide, and indium oxide. Examples of the charge transport material include polycyclic aromatic compounds, heterocyclic compounds, hydrazone compounds, styryl compounds, enamine compounds, benzidine compounds, triarylamine compounds, and resins having groups derived from these substances. Among these, triarylamine compounds and benzidine compounds are preferable.

Examples of the resin include polyester resins, acrylic resins, phenoxy resins, polycarbonate resins, polystyrene resins, phenol resins, melamine resins, and epoxy resins. Among these, polycarbonate resins, polyester resins, and acrylic resins are preferable.

The protective layer may be formed as a cured film obtained by polymerizing a composition that contains a monomer having a polymerizable functional group. Examples of the reaction for this process include a thermal polymerization reaction, a photopolymerization reaction, and a radiation polymerization reaction. Examples of the polymerizable functional group in the monomer having a polymerizable functional group include an acryl group and a methacryl group. A material having a charge transport property may be used as a monomer having a polymerizable functional group.

The protective layer may contain additives such as an antioxidant, a UV absorber, a plasticizer, a leveling agent, a lubrication imparter, and a wear resistance improver. Specific examples thereof include hindered phenol compounds, hindered amine compounds, sulfur compounds, phosphorus compounds, benzophenone compounds, siloxane-modified resins, silicone oil, fluororesin particles, polystyrene resin particles, polyethylene resin particles, silica particles, alumina particles, and boron nitride particles. The protective layer preferably has an average thickness of 0.5 μm or more and 10 μm or less and more preferably has an average thickness of 1 μm or more and 7 μm or less.

The protective layer can be formed by preparing a protective layer-forming coating solution containing the aforementioned materials and a solvent, forming a coating film of this coating solution, and drying and/or curing the coating film. Examples of the solvent used in the coating solution include alcohol solvents, ketone solvents, ether solvents, sulfoxide solvents, ester solvents, and aromatic hydrocarbon solvents. In Example 1, the average thickness of the protective layer is set to 3 μm.

5. Structure of Toner

Figure 4:
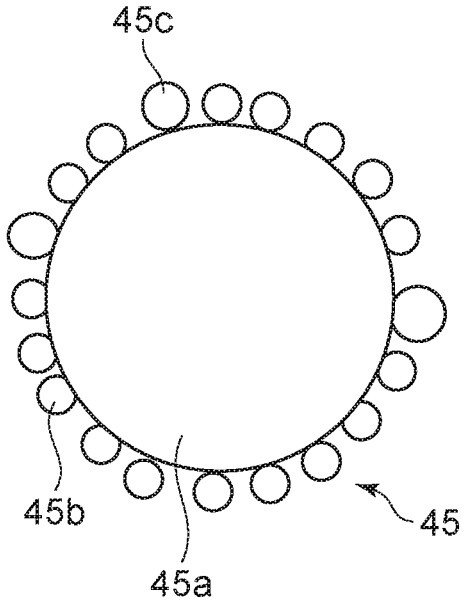
FIG. 4 is a schematic diagram of a toner in Example 1.

FIG. 4 is a schematic diagram of a particle of the toner 10 used in Example 1. In Example 1, an inorganic toner-added toner 45 obtained by externally adding inorganic silicon 45*b* to a base particle 45*a* in order to ensure flowability and improve chargeability is used. The toner used in Example 1 is a nonmagnetic, mono-component particle polymerized toner having a negative charging polarity and has an average particle diameter of 7 μm.

Furthermore, a metal soap 45*c* is externally added in addition to the inorganic silicon 45*b* in order to suppress image smearing. Attachment of corona products and the like can be reduced by forming a protective film by supplying the metal soap 45*c* to the photoconductor 1. Corona products exhibit lower resistances once impregnated with moisture. Thus, the surface of the photoconductor 1 to which the corona products attach exhibit a lower resistance. By supplying the metal soap 45*c* to the surface of the photoconductor 1, occurrence of image smearing caused by low surface resistance of the photoconductor 1 can be suppressed.

The metal soap 45*c* is a generic name for long-chain fatty acids and metal salts other than those of sodium and potassium. Specific examples thereof include metal salts between fatty acids, such as stearic acid, myristic acid, lauric acid, ricinoleic acid, and octylic acid, and metal species such as lithium, magnesium, calcium, barium, and zinc. In Example 1, zinc stearate is externally added as the metal soap 45*c*. The type of the metal soap 45*c* is not limited to this, and lead stearate, cadmium stearate, barium stearate, calcium stearate, aluminum stearate, zinc stearate, magnesium stearate, zinc laurate, zinc myristate, and the like are also usable. At least one metal soap selected from these can be used, for example.

The external addition amount of the metal soap 45*c* can be 0.6 wt % or less. The larger the external addition amount, the stronger the image smearing suppressing effect; however, excessive external addition degrades the flowability of the toner and decreases the image density of the latter half of the image. This is a phenomenon called solid adaptability failure in which, when a solid black image is being output, the adaptability degrades toward the rear end. Meanwhile, the external addition amount of the metal soap 45*c* can be 0.05 wt % or more. If the amount is smaller, the effect of the metal soap 45*c* is rarely exhibited.

The average particle diameter of the metal soap 45*c* can be 0.15 μm or more and 2.0 μm or less. When the average particle diameter of the metal soap 45*c* is less than 0.15 m, it becomes difficult to apply the metal soap 45*c* to the surface of the photoconductor 1. This phenomenon is particularly prominent when there are grooves in the surface of the photoconductor 1 described below. Meanwhile, when the particle diameter is larger than 2.0 μm, the particles cannot pass through the toner regulating member 6 and the like in the developing unit 3, and are left inside the developing chamber 3*a*, and thus it becomes difficult to supply the particles to the surface of the photoconductor 1. Hereinafter, the toner referred in Example 1 is a typical toner constituted by a toner base particle 45*a* and external additives.

The method for measuring the average particle diameter of the metal soap 45*c* will now be described. To 0.5 g of the metal soap 45*c*, 10 mL of ethanol was added, and the resulting mixture was ultrasonically dispersed for 5 minutes with an ultrasonic disperser produced by Nippon Seiki Co., Ltd. Next, ethanol was circulated as the measurement solvent. To a Microtrac laser diffraction/scattering particle size distribution analyzer (SPA type) produced by Nikkiso Co., Ltd., the obtained dispersion liquid of the metal soap 45*c* was added until the value DV (diffracted light quantity) that related to the scattered light quantity accumulated value of the particles reached 0.6 to 0.8. The particle size distribution in this state was measured, and the median diameter obtained as the accumulated median diameter, in other words, the 50% diameter, was assumed to be the average particle diameter.

The metal soap 45*c* having the above-described average particle diameter may be produced by, for example, a double decomposition process that involves causing an aqueous solution of a fatty acid salt to react with an aqueous solution or a dispersion liquid of an inorganic metal salt.

In Example 1, zinc stearate having an average particle diameter of 0.60 μm was used. Zinc stearate that served as the metal soap 45*c* was attached to the toner particles by being charged to a polarity opposite to the toner, and is supplied onto the photoconductor 1 during a non-image-forming period.

Next, the method for producing the toner particles is described. A known technique can be used to produce the toner particles, and examples thereof include a kneading and pulverizing method and a wet manufacturing method. From the viewpoints of uniform particle diameter and shape controllability, the wet manufacturing method can be used. Examples of the wet manufacturing method include a suspension polymerization method, a solution suspension method, an emulsion polymerization aggregation method, and an emulsion aggregation method.

In Example 1, the suspension polymerization method is described. In the suspension polymerization method, first, a polymerizable monomer composition is prepared by homogeneously dissolving or dispersing a polymerizable monomer for generating a binder resin, and other additives, such as a coloring agent, as needed by using a dispersing machine such as a ball mill or an ultrasonic dispersing machine. This step is referred to as a step of preparing a polymerizable monomer composition. During this step, a polyfunctional monomer, a chain transfer agent, wax serving as a release agent, a charge control agent, a plasticizer, and other appropriate agents can be added as appropriate and necessary. Examples of the polymerizable monomer used in the suspension polymerization method include the following vinyl-based polymerizable monomers: styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octyl styrene, p-n-nonyl styrene, p-n-decylstyrene, p-n-dodecylstyrene, p-methoxystyrene, and p-phenylstyrene; acryl-based polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxyethyl acrylate; methacryl-based polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate; methylene aliphatic monocarboxylic acid esters; vinyl esters such as vinyl acetate, vinyl propionate, vinyl benzoate, vinyl butyrate, and vinyl formate; vinyl ethers such as vinyl methyl ether, vinyl ethyl ether, and vinyl isobutyl ether; and ketones such as vinyl methyl ketone, vinyl hexyl ketone, and vinyl isopropyl ketone.

Next, the above-described polymerizable monomer composition is injected into an aqueous medium prepared in advance, and droplets formed of the polymerizable monomer composition are formed to have the desired toner particle size by using a stirrer or a dispersing machine that has a high shear force. This step is referred to as a particle forming step. The aqueous medium in the particle forming step can contain a dispersion stabilizer in order to control the particle diameters of the toner particles, yield a sharp particle size distribution, and suppress coalescence of toner particles during the manufacturing process. In general, the dispersion stabilizer is roughly categorized into a polymer that exhibits a repelling force due to steric hindrance and a sparingly water-soluble inorganic compound that stabilizes the dispersion by an electrostatic repelling force. The fine particles of the sparingly water-soluble inorganic compound dissolve in acids and alkalis and thus can be easily removed by washing with and dissolving in an acid or an alkali after the polymerization.

The dispersion stabilizer of the sparingly water-soluble inorganic compound can contain one selected from magnesium, calcium, barium, zinc, aluminum, and phosphorus. More preferably, the dispersion stabilizer of the sparingly water-soluble contains magnesium, calcium, aluminum, or phosphorus. Specific examples are as follows: magnesium phosphate, tricalcium phosphate, aluminum phosphate, zinc phosphate, magnesium carbonate, calcium carbonate, magnesium hydroxide, calcium hydroxide, aluminum hydroxide, calcium metasilicate, calcium sulfate, barium sulfate, and hydroxyapatite.

The dispersion stabilizer described above may be used in combination with an organic compound, for example, polyvinyl alcohol, gelatin, methyl cellulose, methyl hydroxypropyl cellulose, ethyl cellulose, carboxymethyl cellulose sodium salt, or starch. These dispersion stabilizers can be used in an amount of 0.01 parts by mass or more and 2.00 parts by mass or less relative to 100 parts by mass of the polymerizable monomer.

Furthermore, in order to make these dispersion stabilizer finer, 0.001 parts by mass or more and 0.1 parts by mass or less of a surfactant can be used in combination relative to 100 parts by mass of the polymerizable monomer. Specifically, commercially available nonionic, anionic, and cationic surfactants can be used. Examples thereof include sodium dodecyl sulfate, sodium tetradecyl sulfate, sodium pentadecyl sulfate, sodium octyl sulfate, sodium oleate, sodium laurate, potassium stearate, and calcium oleate.

After or during the particle forming step, the temperature can be set to 50° C. or more and 90° C. or less so as to polymerize the polymerizable monomer contained in the polymerizable monomer composition so as to obtain a toner particle dispersion liquid. This step is referred to as a polymerizing step. In the polymerizing step, stirring can be performed to make the temperature distribution inside the reactor even. When a polymerization initiator is to be added, the timing of addition and the length of time of the addition can be any. In order to obtain the desired molecular weight distribution, the temperature may be elevated in the latter half of the polymerization reaction. Moreover, in order to remove the unreacted polymerizable monomer to outside the system, by-products, and the like, the aqueous medium may be partly distilled away by distillation operation in the latter half of the reaction or after termination of the reaction. The distillation operation can be performed at normal pressure or a reduced pressure.

Typically, an oil-soluble initiator is used as the polymerization initiator to be used in the suspension polymerization method. Specific examples are as follows: azo compounds such as 2,2'-azobisisobutyronitrile, 2,2'-azobis-2,4-dimethylvaleronitrile, 1,1'-azobis(cyclohexane-1-carbonitrile), and 2,2'-azobis-4-methoxy-2,4-dimethylvaleronitrile; and peroxide-based initiators such as acetylcyclohexylsulfonyl peroxide, diisopropylperoxycarbonate, decanonyl peroxide, lauroyl peroxide, stearoyl peroxide, propionyl peroxide, acetyl peroxide, tert-butyl peroxy-2-ethyl hexanoate, benzoyl peroxide, tert-butylperoxyisobutyrate, cyclohexanone peroxide, methyl ethyl ketone peroxide, dicumyl peroxide, tert-butyl hydroperoxide, di-tert-butyl peroxide, tert-butyl peroxypivalate, and cumene hydroperoxide.

These polymerization initiators can be used alone or in combination, and, in order to control the degree of polymerization of the polymerizable monomer, a chain transfer agent, a polymerization inhibitor, and the like may be further added.

The water washing transition amount of the inorganic silica is adjusted by using a Henschel Mixer (produced by NIPPON COKE & ENGINEERING CO., LTD.) and by changing the external addition amount, the rotation speed (peripheral speed) of the leading edge of a blade, and the time (duration) for which the blade is rotated, which are the external addition conditions. The external addition conditions of the toner a are indicated in Table 1 below. The details of the peripheral speed and the time, which are external addition conditions, are as described in Japanese Patent Laid-Open No. 2016-38591. Furthermore, 0.20 wt % of zinc stearate was externally added to the toner a used in Example 1.

These polymerization initiators can be used alone or in combination, and, in order to control the degree of polymerization of the polymerizable monomer, a chain transfer agent, a polymerization inhibitor, and the like may be further added.

The water washing transition amount of the inorganic silica is adjusted by using a Henschel Mixer (produced by NIPPON COKE & ENGINEERING CO., LTD.) and by changing the external addition amount, the rotation speed (peripheral speed) of the leading edge of a blade, and the time (duration) for which the blade is rotated, which are the external addition conditions. The external addition conditions of the toner a are indicated in Table 1 below. The details of the peripheral speed and the time, which are external addition conditions, are as described in Japanese Patent Laid-Open No. 2016–38591. Furthermore, 0.20 wt % of zinc stearate was externally added to the toner a used in Example 1.

TABLE 1

| | Inorganic silicon particles | | | | | | | | | |
|---|---|---|---|---|---|---|---|---|---|---|
| | First stage external addition conditions | | | | Second stage external addition conditions | | | | Metal soap | |
| | Silica content (wt %) | Apparatus | Peripheral speed (m/s) | Time (sec) | Silica content (wt %) | Apparatus | Peripheral speed (m/s) | Time (sec) | Type | External addition amount (wt %) |
| Toner a | 0.8 | Surface modifying apparatus | 40 | 300 | 0.8 | Surface modifying apparatus | 40 | 60 | Zinc stearate | 0.2 |

6. Influence of Corona Products on Photoconductor

When an image forming operation is executed by using the image forming apparatus 100 and when discharge is performed with the charging roller 2, corona products such as ozone and NOx occur and may adhere to the surface of the photoconductor 1. The corona products are scraped off by the cleaning blade 8 or the like abutting against the photoconductor 1; however, when the amount of adherence is larger than the amount scraped off, the corona products gradually build up on the surface of the photoconductor 1 as a result of repeated image forming operation. A contact charging method involves a smaller discharge amount compared to the corona charging method that uses a corona charger, and generates less corona products. However, since the position where the corona products occur is a minute gap between the photoconductor 1 and the charging roller 2, the corona products easily adhere to the surface of the photoconductor 1 although the amount of the generated corona products is small. When the corona products adhere to the surface of the photoconductor 1, the corona products absorb moisture, and the electrical resistance of the surface of the photoconductor 1 is decreased. The decrease in resistance affects the potential formation on the photoconductor 1 by the discharge using the charging roller 2, and desired Vd and VL cannot be formed. Thus, appropriate image forming is no longer possible, and the images are adversely affected. The main adverse effects on the image include blank areas and blurring of contours in the image boundary portion that occur by latent image blurring in some parts or all parts of the image, and fogging caused by potential deviation.

Thus, in order to mitigate the adverse effects of the corona products, the metal soap 45*c* is supplied to the surface of the photoconductor 1 in Example 1 so as to suppress adherence of the corona products onto the surface of the photoconductor 1.

7. Metal Soap Application Operation

As described above, in Example 1, a development nip is formed in the developing portion when the developing roller 4 contacts the photoconductor 1. Furthermore, since the surficial moving speed difference is created between the surface of the developing roller 4 and the surface of the photoconductor 1, the toner 10 rotates in the development nip portion and the metal soap 45*c* is supplied to the photoconductor 1. Hereinafter, the ratio of the surficial moving speed of the developing roller 4 relative to the surficial moving speed of the photoconductor 1 is referred to as the DD peripheral speed ratio. When the metal soap 45*c* is applied to the photoconductor 1, increasing the DD peripheral speed ratio tends to suppress image smearing. This is presumably because increasing the DD peripheral speed ratio increases the rolling of the toner 10, and the chances that the metal soap 45*c* and the photoconductor 1 come into contact with each other are increased. When the DD peripheral speed ratio is 100% or less, the contact area of the developing roller 4 per unit area of the photoconductor 1 exhibits a decreasing tendency, and thus the amount of the metal soap 45*c* supplied onto the surface of the photoconductor 1 is decreased. Thus, the DD peripheral speed ratio can be larger than 100%. In other words, the surficial moving speed of the developing roller 4 can be higher than the surficial moving speed of the photoconductor 1. Note that the DD peripheral speed ratio is one indicator that expresses the difference in surficial moving speed between the surface of the photoconductor 1 and the surface of the developing roller 4; alternatively, for example, a surficial moving speed difference (DD peripheral speed difference) may be used as the index instead of the DD peripheral speed ratio. When changing the DD peripheral speed ratio or the DD peripheral speed difference, the rotation speed of the developing roller 4 may be changed, or the rotation speed of the photoconductor 1 may be changed.

However, when the image forming operation is always executed in a state in which the DD peripheral speed ratio is large, the metal soap 45*c* is excessively supplied in the initial stage, resulting in depletion of the metal soap 45*c* in the developing chamber 3*a* and the toner storing unit 3*b*. In addition, the number of times the toner 10 is rubbed is increased, the toner 10 is deteriorated, and the chargeability is inhibited.

Thus, in Example 1, separately from the normal image forming operation, metal soap application operation is provided. In the metal soap application operation, the developing roller 4 is rotated while abutting against the surface of the photoconductor 1, and the DD peripheral speed ratio is set to be larger than that during the image forming operation. During the metal soap application operation, a charging voltage is applied to control the photoconductor 1 to have a dark potential Vd and the developing voltage is set to be equal to that during the image forming operation so as to perform a so-called solid white printing.

The timing of executing the metal soap application operation can be during rotation of the photoconductor 1 before the image forming operation or during rotation of the photoconductor 1 after the image forming operation. In other words, the metal soap application operation is executed when the image forming operation is not being performed. Alternatively, the metal soap application operation may be executed at the timing designated by the user.

During the metal soap application operation, the light quantity of the pre-exposure unit 27 is preferably set to be smaller than that during the image forming operation, and more preferably the pre-exposure unit 27 is turned OFF. This is because image smearing is satisfactorily suppressed when the pre-exposure light quantity during the metal soap application operation is small. The cause for this tendency is presumably the following phenomenon. Decreasing the pre-exposure light quantity causes remnant electrification due to un-erased charges remaining on the surface of the photoconductor 1. Thus, the metal soap 45*c* that has a positive polarity, which is opposite to the normal polarity, exhibits stronger electrical adherence to the photoconductor 1, and thus becomes difficult to remove from the surface of the photoconductor 1. When the cleaning blade 8 and the developing roller 4 pass over the metal soap 45*c* on the photoconductor 1 in such a state, the metal soap 45*c* is physically pressed into the photoconductor 1 and adheres to the photoconductor 1 more firmly. In other words, it is considered that decreasing the pre-exposure light quantity to a level lower than that during the image forming operation increases the ability of the metal soap 45*c* to adhere to the photoconductor 1 by the metal soap application operation, and thus the metal soap 45*c* can adhere more firmly to the photoconductor 1. In contrast, increasing the exposure amount at which the surface of the photoconductor 1 is exposed with light weakens the electrical adherence of the positive polarity-metal soap 45*c* to the photoconductor 1, and the metal soap 45*c* may easily detach from the surface of the photoconductor 1.

In addition, the potential difference $\Delta Vr$ ($=Vdc-Vr$) of the supplying roller 5 with respect to the developing roller 4 can have a polarity opposite to that of the metal soap 45*c*. In other words, the potential difference $\Delta Vr$ is controlled so that a potential difference that generates an electrostatic force that induces the metal soap 45*c* to move from the supplying roller 5 to the developing roller 4 is formed in a contact portion where the supplying roller 5 and the developing roller 4 contact each other. Since Vr is set to have a polarity opposite to the polarity at which the metal soap 45*c* is charged, the metal soap 45*c* moves toward the developing roller 4, thus suppressing movement of the metal soap 45*c* toward the supplying roller 5; thus, a large quantity of the metal soap 45*c* can be supplied onto the surface of the photoconductor 1. In Example 1, $\Delta Vr=-50$ V and the metal soap 45*c* is charged to have a positive polarity; thus, the metal soap 45*c* actively moves toward the developing roller 4.

8. Control Procedure for Metal Soap Application Operation

Figure 5:
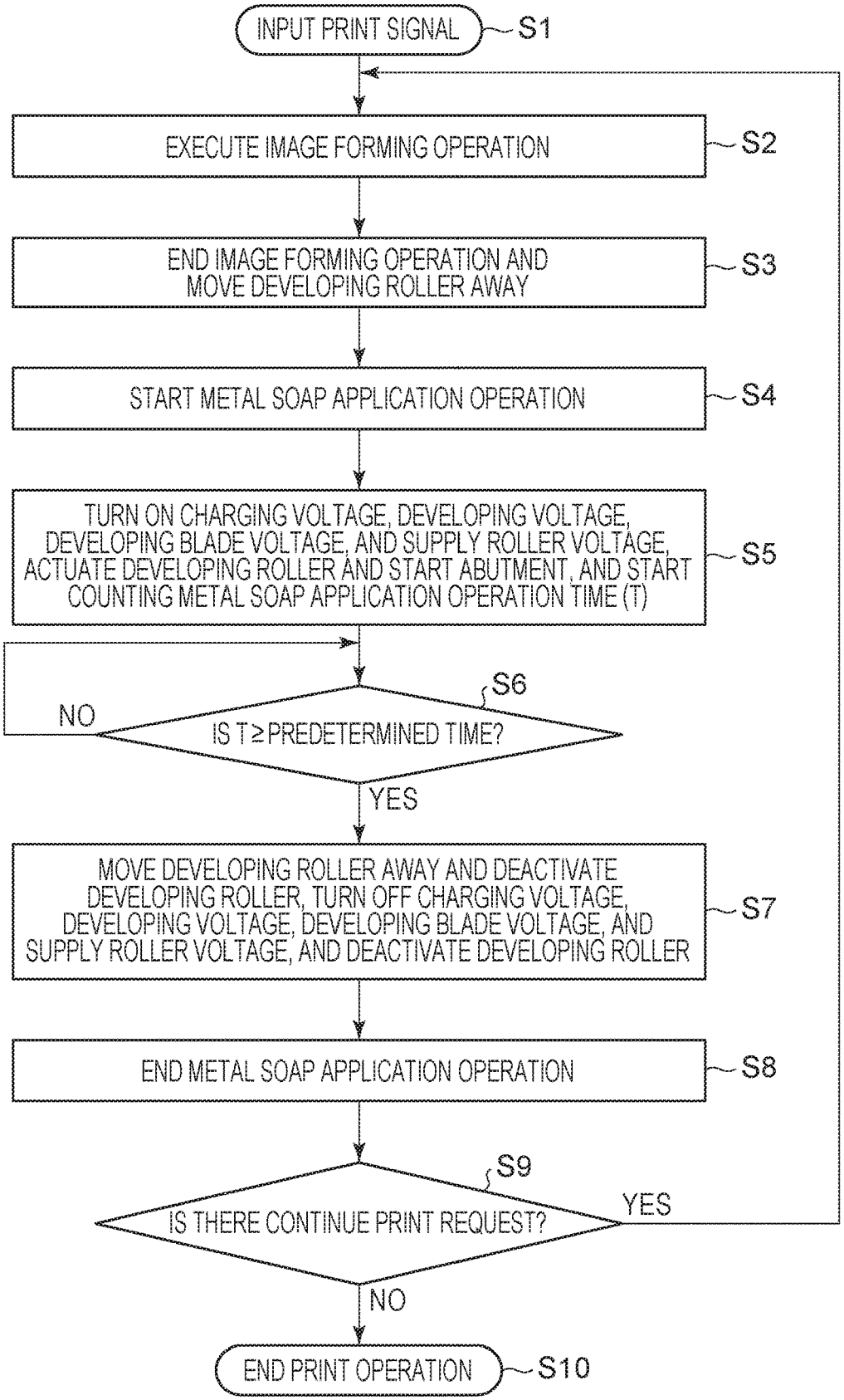
FIG. 5 is a flowchart in Example 1.

The control procedure for the metal soap application operation will now be described with reference to the flowchart in FIG. 5. In Example 1, the control unit 202 executes the metal soap application operation. As one example of execution of the metal soap application operation, the case in which the metal soap application operation is executed after the image forming operation is described.

When the image forming apparatus 100 is ready for image formation and the user inputs a print signal (S1), the image forming operation is executed (S2). After the image forming operation is ended, the developing roller 4 is moved away from the photoconductor 1 and deactivated, and various voltages are turned OFF (S3). Subsequently, the metal soap application operation is executed (S4).

First, a charging voltage, a developing voltage, a developing blade voltage, and a supplying voltage are applied, the developing roller 4 and the photoconductor 1 are actuated so that the developing roller 4 abuts against the photoconductor 1, and the count of the metal soap application operation time (T) is started (S5). The metal soap application operation is continued until a predetermined time T is reached (S6). Upon reaching the predetermined time T, the developing roller 4 is moved away from the photoconductor 1, the developing roller 4 and the photoconductor 1 are deactivated, the applied voltages are turned OFF (S7), and the metal soap application operation is ended (S8). Next, whether there is a continue print request is determined (S9), and if there is no request, the process moves to a print end operation (S10) and if there is a request, the operations from S2 to S9 are repeated until there is no longer a continue print request. In Example 1, the predetermined time T is set to 5 seconds. The predetermined time is not limited to 5 seconds and can be set as appropriate.

The metal soap application operation in S4 may be performed immediately after the image forming operation in S2 without performing the operation of moving the developing roller 4 away, or may be executed while various voltages are being applied and various devices are being actuated.

9. Effect of Metal Soap Application Operation

The effect achieved when the metal soap application operation described in Example 1 was executed was studied. The DD peripheral speed ratio and the voltage settings of the metal soap application operation are as indicated in Table 2. The operation execution frequency was set to the time when the number of sheets subjected to image formation reached 600, and the duration of executing the metal soap application operation was set to 5 seconds.

TABLE 2

| | Image forming operation | Metal soap application operation | | |
|---|---|---|---|---|
| | | Comparative Example 1 | Comparative Example 2 | Example 1 |
| DD peripheral speed ratio (%) | 140 | Not executed | 140 | 300 |
| Dark potential (V) | −500 | | −500 | −500 |
| Developing voltage (V) | −300 | | −300 | −300 |

In Comparative Example 1, the metal soap application operation described in Example 1 was not executed. In Comparative Example 2, the DD peripheral speed ratio of the metal soap application operation was set to be the same as the DD peripheral speed ratio (140%) during the image formation, and the metal soap application operation was performed every 600 sheets for 5 seconds each time. In Example 1, the DD peripheral speed ratio of the metal soap application operation was set to 300%, which was larger than that during the image formation, and the voltage settings were set to be the same as those during the image formation.

The results obtained from studying the actual effect are described below. In order to study occurrence of image smearing in Example 1, Comparative Example 1, and Comparative Example 2, 10,000 sheets were continuously passed in one day at a printing ratio of 1%, the photoconductor was left to stand in the apparatus for one day, and whether there was image smearing after being left to stand was compared. The reason for leaving the photoconductor to stand for one day is that the corona products generated on the surface of the photoconductor 1 sufficiently absorb moisture by being left to stand for one day, and thus the effect of decreasing the surface resistance of the photoconductor 1 becomes prominent. A sample for determining whether image smearing occurred was obtained by printing a halftone image on one sheet and used for evaluation. The evaluation standard is as follows.

○: No image smearing occurred. There were no blank areas or blurring of contours in the image boundary portion that occurred by latent image blurring in all parts of the image.

□: Slight image smearing occurred. Blank areas or blurring of contours in the image boundary portion caused by latent image blurring occurred in some parts of the image.

x: Image smearing occurred. There were blank areas and blurring of contours in the image boundary portion that occurred by latent image blurring in all parts of the image.

TABLE 3

| | Number of sheets passed (× 1000 sheets) | | | |
|---|---|---|---|---|
| | 20 | 40 | 60 | 80 |
| Comparative Example 1 | ○ | x | x | x |
| Comparative Example 2 | ○ | ○ | x | x |
| Example 1 | ○ | ○ | ○ | ○ |

As indicated in Table 3, in Comparative Example 1, image smearing is satisfactorily suppressed up to 20,000 sheets, but image smearing occurs after 40,000 sheets. In the initial stage, the metal soap 45*c* is supplied together with the toner 10, and thus the image smearing is minor; however, as the image formation is repeated, the amount of the metal soap 45*c* that stays on the surface of the photoconductor 1 becomes smaller than the amount of the metal soap 45*c* that can be supplied. Presumably thus, the supply of the metal soap 45*c* merely by the image forming operation was not enough, and image smearing occurred.

In Comparative Example 2, the lifetime was longer by 20,000 sheets compared to Comparative Example 1, but image smearing occurred after 60,000 sheets. The lifetime was extended compared to Comparative Example 1 since the metal soap application operation was executed. However, since the DD peripheral speed ratio during the metal soap application operation was not different from that during the image forming operation, the metal soap 45*c* could not be sufficiently applied during the metal soap application operation, and the effect of the metal soap application operation was not exhibited. Presumably thus, image smearing occurred.

In contrast, in Example 1, image smearing was satisfactorily suppressed until 80,000 sheets. This is presumably because the DD peripheral speed ratio during the metal soap application operation was increased, as a result of which the metal soap 45*c* was actively supplied onto the surface of the photoconductor and the effect of suppressing image smearing was exhibited.

The toner 10 with the metal soap 45*c* externally added thereto is effective for suppressing image smearing; however, as the image formation was repeated, the deficiency in the metal soap 45*c* that can be supplied occurred, and the image smearing could not be sufficiently suppressed. However, in the structure of Example 1, the metal soap 45*c* is incorporated into the toner 10, and image smearing is suppressed by performing the following control. The control unit 202 that controls the speed ratio between the surficial moving speed of the photoconductor 1 and the surficial moving speed of the developing roller 4 executes the image forming operation and the metal soap application operation that involves moving the toner 10 from the developing roller 4 to the photoconductor 1 so as to apply the metal soap 45*c* to the surface of the photoconductor 1. Here, the metal soap application operation is controlled so that the speed ratio between the surficial moving speed of the photoconductor 1 and the surficial moving speed of the developing roller 4 is larger than the speed ratio during the image forming operation. As a result, even when the metal soap 45*c* became deficient, the photoconductor 1 could be replenished with the metal soap 45*c*, and the image smearing could be suppressed over a long term.

Note that in Example 1, the metal soap 45*c* externally added to the toner 10 was supplied to the surface of the photoconductor 1 from the developing roller 4; however, the supply source is not limited to the developing chamber 3*a* and the toner storing unit 3*b* disposed in the developing unit 3. For example, an application unit different from the developing unit 3 can be disposed above the photoconductor 1 to supply the metal soap 45*c*.

In the structure of the image forming apparatus 100 used in Example 2, the same components as those of Example 1 are denoted by the same reference signs and descriptions thereof are omitted.

In Example 2, during the metal soap application operation, the DD peripheral speed ratio is set to be larger than that during the image forming operation as in Example 1, and the back contrast Vback, which is the potential difference between the dark potential Vd and the developing voltage is set to be larger than that during normal image formation. This is because the metal soap 45*c* charged to have an opposite polarity to the toner 10 electrically adheres to the surface of the photoconductor 1 in larger quantities as the magnitude of the Vback is high, and thus the metal soap 45*c* on the developing roller 4 can efficiently adhere to the surface of the photoconductor 1. In Example 1, Vback is set to 200 V during normal image formation and metal soap application operation; in contrast, in Example 2, Vback is set to 300 V during the metal soap application operation. Specifically, the developing voltage is set to −300 V to −200 V. Alternatively, in order to set the dark potential to −500 V to −600 V, a charging voltage of −1100 V including extra −100 V may be applied to the charging roller 2.

However, setting Vback to a large value to move the metal soap 45*c* to the photoconductor 1 also has detrimental effects. An excessively large Vback causes fogging, that is, a phenomenon in which the toner 10 charged into a polarity opposite to the normal polarity of the toner 10 migrates to the surface of the photoconductor 1, and results in excess toner consumption. Thus, in Example 2, Vback during the metal soap application operation is preferably 200 V or more and 500 V or less and more preferably 300 V or more and 400 V or less. Vback during the metal soap application operation is set to be larger than Vback during the image forming operation, and the difference ΔVback between Vback during the metal soap application operation and Vback during the image forming operation is preferably 0 V or more and 300 V or less and more preferably 100 V or more and 200 V or less.

In Example 2, the back contrast Vback, which is the difference between the surface potential of the photoconductor 1 charged by the charging roller 2 in the developing portion and the developing voltage applied to the developing roller 4, is larger during the metal soap application operation than during the image forming operation. As a result, the photoconductor 1 could be replenished with the metal soap 45*c*, and, furthermore, the image smearing could be suppressed over a long term.

In Example 3, the surface of the photoconductor 1 is subjected to a roughening treatment. When a photoconductor 1 subjected to an appropriate roughening treatment is used, grooves formed in the surface of the photoconductor 1 are filled with the metal soap 45*c*, and thus the metal soap 45*c* can remain unremoved on the surface of the photoconductor 1. Thus, the effect of the metal soap application operation lasts longer, and the metal soap 45*c* can be stably applied to the surface of the photoconductor 1 over a long term.

In order to achieve the aforementioned effects, a photoconductor 1 that is subjected to a roughening treatment and satisfies the following conditions is used. A ten-point average surface roughness (Rz) of the peripheral surface of the photoconductor 1 is $0<Rz\leq0.70$ (μm) and preferably $0.10\leq Rz\leq0.50$ (μm), and the average interval (Sm) of concavities and convexities on the peripheral surface is $0<Sm\leq70$ (μm) and preferably $5\leq Sm\leq70$ (μm). Within the aforementioned ranges, the metal soap 45*c* can be stably maintained on the surface of the photoconductor 1, and, as a result, image smearing can be suppressed over a long term. Thus, Example 3 features a long lifetime structure in which image smearing is suppressed by a simple structure while maintaining the endurance of the photoconductor 1 by performing the roughening treatment for forming appropriate concavities and convexities on the surface of the photoconductor 1.

1. Roughening Treatment on Photoconductor

The photoconductor 1 of Example 3 is subjected to a roughening treatment for forming fine concavities and convexities on the surface in order to sustain the effects of the metal soap 45*c*. According to Japanese Patent Publication No. 4027407, grooves are formed side-by-side in the peripheral surface of the photoconductor 1 so as to extend in the longitudinal direction (generatrix direction or the rotational axis direction of the photoconductor 1), and have a width within the range of 0.5 μm or more and 40 μm or less in a substantially circumferential direction of the peripheral surface.

Figure 6:
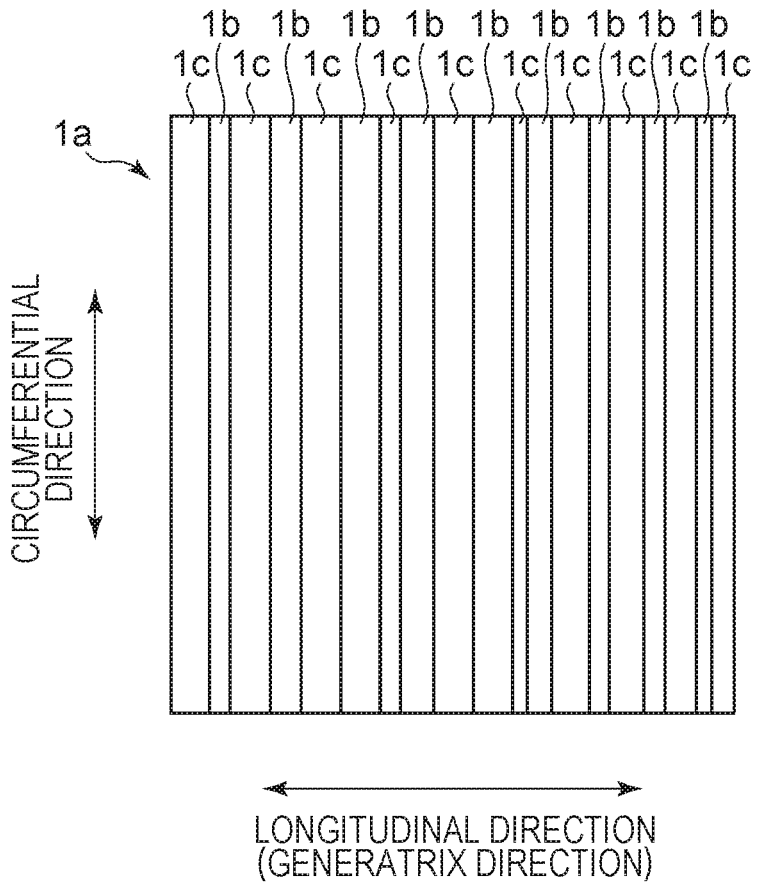
FIG. 6 is a schematic diagram of a photoconductor surface subjected to a roughening treatment in Example 3.

FIG. 6 illustrates one example of the state of grooves 1*b* formed in a peripheral surface 1*a* of the photoconductor 1. As illustrated in FIG. 6, each of the grooves 1*b* is a ring-shaped groove extending in the circumferential direction on the peripheral surface 1*a* of the photoconductor 1, and the grooves 1*b* are arranged side-by-side in the generatrix direction of the peripheral surface 1*a* at particular intervals. In other words, the peripheral surface 1*a* has a structure in which flat portions 1*c* where the grooves 1*b* are not formed, and the grooves 1*b* are alternately formed in the generatrix direction. Note that the regions where the grooves 1*b* are formed in the peripheral surface 1*a* are to at least include regions that abut against the cleaning blade 8, and do not have to be formed on the entire peripheral surface 1*a* in the longitudinal direction.

As mentioned in the aforementioned publication, the grooves 1*b* are not limited to the structure that extends in a direction coincident with the circumferential direction as illustrated in FIG. 6. For example, the grooves 1*b* may be formed so that an angle of 10° is formed with respect to the circumferential direction. Alternatively, the grooves 1*b* may be formed so that an angle of ±30 is formed with respect to the circumferential direction and that the grooves 1*b* having different angles intersect one another. In this embodiment, the "substantially circumferential direction" refers to directions that are close to the circumferential direction as well as the direction completely coincident with the circumferential direction, and "directions that are close to the circumferential direction" specifically refers to directions that are within the range of ±60 (excluding 60°) with respect to the circumferential direction.

Figure 7:
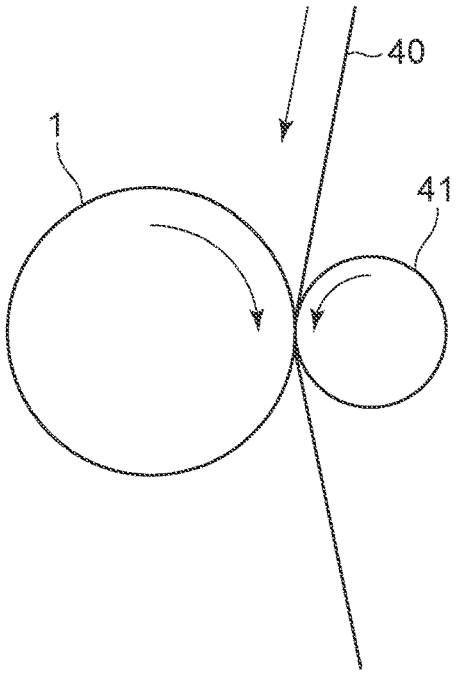
FIG. 7 is a schematic view of a polishing apparatus that polishes the photoconductor surface in Example 3.

Next, a polishing method for polishing the surface of the photoconductor 1 is described. FIG. 7 is a schematic view of a polishing apparatus that polishes the surface of the photoconductor 1. A polishing sheet 40 is taken up in the arrow direction by a take-up mechanism (not illustrated). The photoconductor 1 rotates in the arrow direction. A backup roller 41 rotates in the arrow direction. Regarding the polishing conditions, a polishing sheet produced by RIKEN CORUNDUM CO., LTD., (trade name: GC #3000, base layer sheet thickness: 75 μm) was used as the polishing sheet 40. As the backup roller 41, a urethane roller (outer diameter: 50 mm) having a hardness of 20 was used, and polishing was conducted for 5 to 30 seconds at an inroad amount of 2.5 mm and a sheet feed amount of 200 to 400 mm/s while having the feed direction of the polishing sheet 40 and the rotation direction of the photoconductor 1 to be coincident with each other. The surface roughness of the photoconductor 1 after polishing was measured under the following conditions by using a surface roughness meter (trade name: SE700, SMB-9 produced by Kosaka Laboratory Ltd.). Measurement was performed at positions 30, 110, and 185 mm from the application upper end in the longitudinal direction of the photoconductor 1. After the photoconductor 1 was rotated 1200 toward the front side, measurement was performed in the same manner at positions 30, 110, and 185 mm from the application upper end. Furthermore, after the photoconductor 1 was further rotated 1200 toward the front side, measurement was conducted in the same manner, totaling the number of measurement point to 9. Measurement conditions were as follows:

measurement length: 2.5 mm, cut-off value: 0.8 mm, feed speed: 0.1 mm/s, filter property: 2CR, leveling: straight line (all parts).

Table 4 indicates Rz and Sm of the photoconductor 1 used in Example 3. Photoconductors a to f in Table 4 were prepared by changing the polishing time etc., among the aforementioned roughening treatment conditions. The photoconductor g is the photoconductor 1 used in Example 1 and Example 2 not subjected to the roughening treatment.

TABLE 4

| | Rz [μm] | Sm [μm] |
|---|---|---|
| Photoconductor a | 0.36 | 12.6 |
| Photoconductor b | 0.44 | 8.6 |
| Photoconductor c | 0.68 | 8.2 |
| Photoconductor d | 0.21 | 67.3 |
| Photoconductor e | 0.75 | 7.5 |
| Photoconductor f | 0.19 | 78.5 |
| Photoconductor g | 0.04 | 416.6 |

The ten-point average surface roughness (Rz) of the peripheral surface of the photoconductor 1 and the average interval (Sm) of the concavities and convexities are on the basis of the JIS standard (JIS B 0601) and were measured under the following conditions by using a surface roughness meter, Surfcorder SE3500 produced by Kosaka Laboratory Ltd.

Detector: R2 μm
0.7 mN diamond needle
Filter: 2CR
Cut-off value: 0.8 mm
Measurement length: 2.5 mm
Feed speed: 0.1 mm In Example 3, measurement was performed on four positions in the circumferential direction at each of three positions in the generatrix direction of the photoconductor 1, that is, at a total of twelve positions. The average interval (Sm) of the concavities and convexities on the peripheral surface of the photoconductor 1 can be defined as, as illustrated in FIG. 6, the interval between the grooves 1*b*, which are arranged in the generatrix direction of the peripheral surface 1*a*, in the generatrix direction (longitudinal direction) or the interval between the flat portions 1*c* in the generatrix direction (longitudinal direction).

2. Effect of Metal Soap Application Operation on Photoconductor Subjected to Roughening Treatment The effect achieved when the metal soap application operation was executed by using the photoconductor 1 described in Example 3 was studied. The DD peripheral speed ratio and the voltage settings of the metal soap application operation are as described in Example 2. In Example 3, photoconductors a to d indicated in Table 4 were used as the photoconductor 1. In Comparative Example 3, a photoconductor e was used. In Comparative Example 4, a photoconductor f was used.

The results obtained from studying the actual effect are described below. In order to study occurrence of image smearing in Example 3, Comparative Example 3, and Comparative Example 4, 10,000 sheets were continuously passed in one day at a printing ratio of 1%, the photoconductor was left to stand in the apparatus for one day, and whether there was image smearing after being left to stand was compared. A sample for determining whether image smearing occurred was obtained by printing a halftone image on one sheet and used for evaluation. Other conditions were the same as in Example 2. The evaluation standard is as follows.

○: No image smearing occurred. There were no blank areas or blurring of contours in the image boundary portion that occurred by latent image blurring in all parts of the image.

□: Slight image smearing occurred. Blank areas or blurring of contours in the image boundary portion caused by latent image blurring occurred in some parts of the image.

x: Image smearing occurred. There were blank areas and blurring of contours in the image boundary portion that occurred by latent image blurring in all parts of the image.

The sheets were passed and the sample was output in an environment of 30° C./80% RH. The total number of sheets that were passed was up to 120,000. The results are indicated in Table 5.

TABLE 5

| | | Number of sheets passed (× 1000 sheets) | | | |
|---|---|---|---|---|---|
| | Photoconductor | 40 | 80 | 100 | 120 |
| Example 3 | Photoconductor a | ○ | ○ | ○ | ○ |
| | Photoconductor b | ○ | ○ | ○ | ○ |
| | Photoconductor c | ○ | ○ | ○ | ○ |
| | Photoconductor d | ○ | ○ | ○ | ○ |
| Comparative Example 3 | Photoconductor e | ○ | ○ | ○ | □ |
| Comparative Example 4 | Photoconductor f | ○ | ○ | ○ | □ |

As indicated in Table 5, image smearing did not occur up to 120,000 sheets when the photoconductors a to d of Example 3 were used. This is the result of forming appropriate grooves in the surface of the photoconductor 1 at appropriate intervals so that the metal soap 45*c* can be retained on the surface of the photoconductor 1.

The shapes of concavities and convexities on the surface of the photoconductor 1 subjected to the roughening treatment in Example 3 were set so that the range of the ten-point average surface roughness (Rz) of the peripheral surface was $0<Rz\leq0.70$ (μm) and the average interval of the concavities and convexities on the peripheral surface was $0<Sm\leq70.0$ (μm). The effect of the metal soap application operation lasts by using the photoconductor 1 that satisfies the aforementioned conditions.

The photoconductor e of Comparative Example 3 had Rz=0.75 (μm), and deep grooves were formed in the surface of the photoconductor 1. Thus, a large quantity of metal soap 45*c* was needed to sufficiently fill the grooves, and the effects thereof were not sufficiently exhibited under such conditions. Since satisfactory results were obtained from the photoconductor c of Example 3 having Rz=0.68 (μm), it became clear that the effects of the roughening treatment are strengthened when Rz is below 0.70 (μm). It was also found that the metal soap 45*c* having an average particle diameter of 0.15 μm to 2.0 μm has a shape that can be easily applied to the grooves having the depth described above.

The photoconductor f of Comparative Example 4 has Sm=78.5 (μm) and has many portions free of grooves; presumably thus, an adverse effect was moderately displayed since the metal soap 45*c* was removed by the cleaning blade 8. Since satisfactory results were obtained from the photoconductor d of Example 3 having Sm=67.3 (μm), it became clear that the effects of the roughening treatment are strengthened when Sm is below 70.0 (μm).

Based on the results described above, the shape of the surface of the photoconductor 1 subjected to the roughening treatment in Example 3 is set such that the range of the ten-point average surface roughness (Rz) of the peripheral surface is $0<Rz\leq0.70$ (μm) and the average interval of the concavities and convexities on the peripheral surface is $0<Sm\leq70.0$ (μm). More preferably, the ten-point average surface roughness (Rz) of the peripheral surface is $0.10\leq Rz\leq0.50$ (μm) and the average interval (Sm) of the concavities and convexities on the peripheral surface is $5\leq Sm\leq70$ (μm). When $0.10\leq Rz\leq0.50$ (μm) and $5\leq Sm\leq70$ (μm), the concavities and convexities work effectively, and the metal soap 45*c* can more easily remain on the surface of the photoconductor 1. As a result, a structure in which the metal soap 45*c* can be stably maintained on the surface of the photoconductor 1 is obtained. Thus, subjecting the photoconductor 1 to a roughening treatment as in Example 3 can suppress occurrence of image smearing by a simple structure even in a long-lifetime structure while maintaining the endurance of the photoconductor.

In Examples 1, 2, and 3, the case in which a toner having inorganic silicon fine particles externally added thereto was used is described as illustrated in FIG. 4. In Example 4 described below, the case in which the toner was changed to an organic silicon polymer toner that has a surface layer containing an organic silicon polymer is described.

When a toner with inorganic silicon externally added thereto is used as in Examples 1, 2, and 3, the inorganic silicon detaches from the toner when the operation that frequently involves rubbing between the photoconductor 1 and the developing roller 4 is executed, as in the metal soap application operation. The inorganic silicon detached from the toner is supplied to the surface of the photoconductor 1 along with the toner. Thus, when a long-lifetime structure is concerned, the ability of applying the metal soap 45*c* is degraded in the latter half of the lifetime. Due to the aforementioned reasons, in some cases, the metal soap 45*c* cannot be stably applied to the surface of the photoconductor 1 over a long term when a toner with inorganic silicon externally added thereto is used.

When an organic silicon polymer toner is used as in Example 4, the organic silicon polymer rarely detaches from the toner even when mechanically rubbed, and thus only the metal soap 45*c* can be efficiently supplied to the photoconductor 1 by the metal soap application operation. Thus, the effect of the metal soap application operation lasts longer, and the metal soap 45*c* can be stably applied to the surface of the photoconductor 1 over a long term. Moreover, the original effect achieved by externally added inorganic silica, which is controlling the toner charges and toner physical property values, can also be achieved by the organic silicon polymer contained in the surface layer; thus, the image is not adversely affected.

Thus, Example 4 features a long lifetime structure in which image smearing is suppressed by a simple structure while maintaining the endurance of the photoconductor 1 by using an organic silicon polymer toner having a surface layer that contains an organic silicon polymer. The parts that overlap with Examples 1, 2, and 3 are omitted from the description.

1. Toner Having Surface Layer Containing Organic Silicon Polymer

Figure 8:
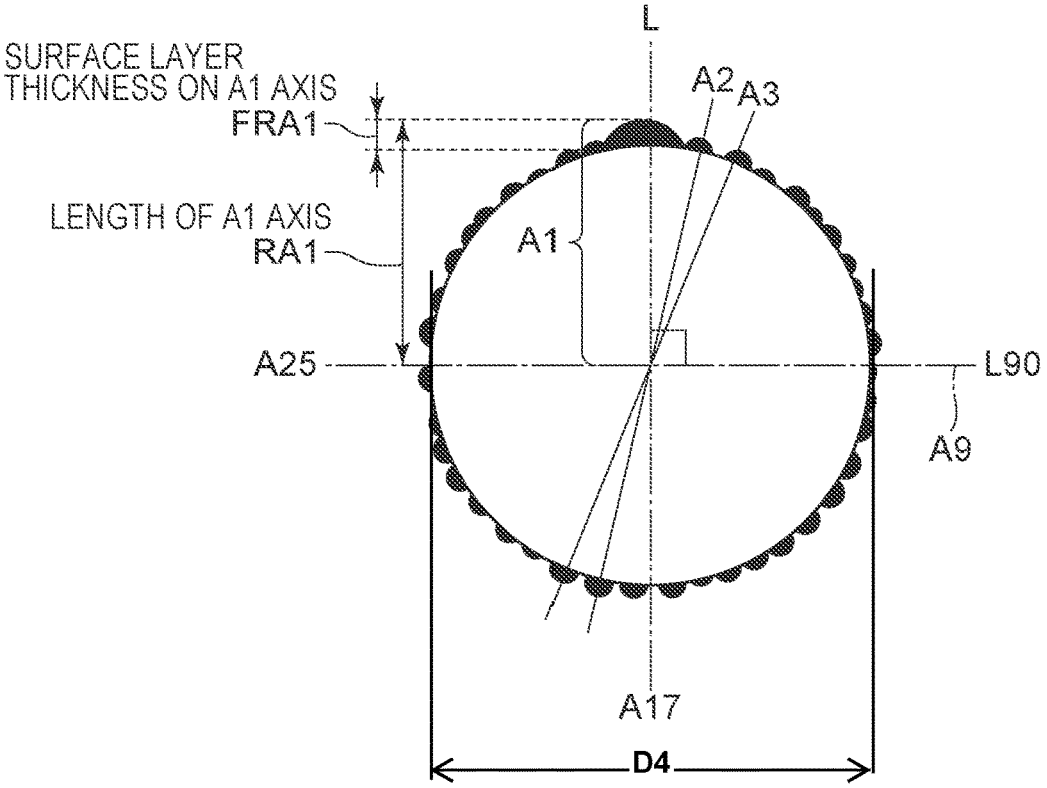
FIG. 8 is a schematic diagram illustrating the thickness of a surface layer containing an organic silicon compound in Example 4.

In Example 4, as illustrated in FIG. 8, a toner having a toner particle and an organic silicon polymer covering the surface of the toner particle and having a structure represented by formula (1) below is used.

$$R—SiO3/2 \quad (1)$$

(R represents a hydrocarbon group having 1 to 6 carbon atoms.)

The surface of the toner particle is covered with the organic silicon polymer having the structure represented by formula (1), and has a surface layer that exists at the uppermost surface of the toner particle. The surface layer is hard compared to a typical toner particle. Thus, from the viewpoint of fixability, some parts of the toner particle surface may be free of the surface layer. The ratio of the number of dividing axes on which the thickness of the surface layer containing the organic silicon polymer is 2.5 nm or less (hereinafter this ratio is referred to as the ratio of the surface layer having a thickness of 2.5 nm or less) can be 20.0% or less. This condition approximates that at least 80.0% of the surface of the toner particle is constituted by a surface layer containing an organic silicon polymer having a thickness of 2.5 nm or more. In other words, when this condition is satisfied, the surface of the toner particle is sufficiently covered with the surface layer containing the organic silicon polymer. More preferably, the ratio of the surface layer having a thickness of 2.5 nm or less is 10.0% or less. Cross-sectional observation with a transmission electron microscope (TEM) can be used for measurement. The details are described below.

Next, the organic silicon polymer having a structure represented by formula (1) is described. In the organic silicon polymer having a structure represented by formula (1), one of four valences of a Si atom is bonded to R and the remaining three valences are bonded to O atoms. The O atom constitutes a state in which both valences are bonded to Si, in other words, a siloxane bond (Si—O—Si). In view of Si and O atoms in the organic silicon polymer, two Si atoms have three O atoms, and thus this is expressed as —SiO3/2. Moreover, in a chart obtained by 29Si-NMR measurement of the tetrahydrofuran (THF)-insoluble matter of the toner particles, the ratio of the peak area attributed to the structure of formula (1) relative to the total peak area of the organic silicon polymer can be 20% or more. Although the details of the measurement method are described below, this approximates that there are 20% or more of the partial structure represented by R—SiO3/2 in the organic silicon polymer.

As described above, the structure —SiO3/2 means that, of four valences of the Si atom, three bonds to the oxygen atoms and these oxygen atoms further bond with other Si atoms. If one of the oxygen atoms is a silanol group, the structure of that organic silicon polymer is expressed as R—SiO2/2-OH. Furthermore, if two oxygen atoms are silanol groups, the structure can be expressed as R—SiO1/2(—OH)2. When these structures are compared, a structure in which a larger number of oxygen atoms form crosslinking structures with Si atoms is close to the silica structure represented by SiO2. When there are more —SiO3/2 skeletons, the surface free energy at the toner particle surface can be decreased; thus, excellent effects are exhibited in terms of environmental stability and component contamination resistance. Moreover, due to the endurance achieved by the structure represented by formula (1) and the hydrophobicity and chargeability of R in formula (1), bleeding of easily bleeding low-molecular-weight (Mw: 1000 or less) resins and resins with low glass transition temperatures (Tg: 40° C. or less) that are present on the inner side of the surface layer is suppressed. In some cases, bleeding of the release agent is suppressed as well.

The ratio of the peak area of the structure represented by formula (1) can be controlled by the type and amount of the organic silicon compound used in forming the organic silicon polymer, and the reaction temperature, the reaction time, the reaction solvent, and pH of hydrolysis, addition polymerization, and condensation polymerization performed during formation of the organic silicon polymer. In the structure represented by (1), R represents a hydrocarbon group having 1 to 6 carbon atoms. This stabilizes the charge amount. In particular, the hydrocarbon can be an aliphatic hydrocarbon group having 1 to 6 carbon atoms or a phenyl group since the environmental stability is excellent. In the embodiments of the present disclosure, R is more preferably an aliphatic hydrocarbon group having 1 to 3 carbon atoms in order to further improve chargeability and fogging prevention. When chargeability is excellent, the transferability is excellent, and there is less transfer residual toner. Thus, contamination of the photoconductor 1 and the charging roller 2 is suppressed. Examples of the aliphatic hydrocarbon group having 1 to 3 carbon atoms include a methyl group, an ethyl group, a propyl group, and a vinyl group. From the viewpoint of environmental stability and storage stability, R is more preferably a methyl group. A sol-gel method can be used to manufacture the organic silicon polymer. A sol-gel method involves hydrolyzing and condensation-polymerizing a liquid raw material used as a starting material, and gelling the material via a sol state, and is employed in synthesis of glass, ceramics, organic-inorganic hybrid materials, and nanocomposites. According to this manufacturing method, functional material of various shapes, such as a surface layer, fibers, a bulk body, and fine particles, can be manufactured from a liquid phase at low temperatures. The organic silicon polymer present in the surface layer of the toner particle can be generated by hydrolysis and condensation polymerization of a silicon compound, specifically, an alkoxysilane. Forming a surface layer containing this organic silicon polymer on the toner particle improves environmental stability, and thus a toner that undergoes little performance degradation over a long-term use and has excellent storage stability can be obtained.

Furthermore, since the sol-gel method involves using a liquid as a starting material and gelling the liquid to form a material, various microstructures and shapes can be formed. In particular, when toner particles are manufactured in an aqueous medium, it becomes easy to precipitate the organic silicon compound on the toner particle surfaces due to the hydrophilicity of hydrophilic groups such as silanol groups of the organic silicon compound. The microstructure and shape can be adjusted through the reaction temperature, the reaction time, the reaction solvent, pH, and the type and amount of the organic metal compound, etc. The organic silicon polymer can be a polycondensation product of an organic silicon compound having a structure represented by formula (Z) below:

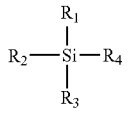

(Z)

(In formula (Z), $R_1$ represents a hydrocarbon group having 1 to 6 carbon atoms, and $R_2$, $R_3$, and $R_4$ each independently represent a halogen atom, a hydroxy group, an acetoxy group, or an alkoxy group.)

The hydrocarbon group represented by $R_1$ can improve hydrophobicity, and thus toner particles having excellent environmental stability can be obtained. The hydrocarbon group may be an aromatic hydrocarbon group, such as an aryl group. For example, a phenyl group can be used. When hydrophobicity of $R_1$ is high, the charge amount fluctuations tend to be large in various environments; thus, in view of the environmental stability, $R_1$ is preferably an aliphatic hydrocarbon group having 1 to 3 carbon atoms and more preferably a methyl group. In other words, the number of carbon atoms directly bonded to the silicon atom in the organic silicon polymer can be 1 or more and 3 or less. $R_2$, $R_3$, and $R_4$ each independently represent a halogen atom, a hydroxy group, an acetoxy group, or an alkoxy group (hereinafter, may also be referred to as a "reactive group"). These reactive groups form crosslinked structures by undergoing hydrolysis, addition polymerization, and condensation polymerization, and thus a toner having excellent component contamination resistance and development endurance can be obtained. From the viewpoint of mild hydrolysability at room temperature and precipitation properties and coating properties at the surfaces of the toner particles, an alkoxy group having 1 to 3 carbon atoms is preferable, and a methoxy group or an ethoxy group is more preferable. The hydrolysis, addition polymerization, and condensation polymerization of $R_2$, $R_3$, and $R_4$ can be controlled by the reaction temperature, the reaction time, the reaction solvent, and pH.

In order to obtain an organic silicon polymer used in the embodiment of the present disclosure, one or a combination of two or more organic silicon compounds (hereinafter may be referred to as "trifunctional silanes") having three reactive groups ($R_2$, $R_3$, and $R_4$) in one molecule except $R_1$ in formula (Z) described above may be used. Examples of the compounds represented by formula (Z) above include the followings: trifunctional methyl silanes such as methyltrimethoxysilane, methyltriethoxysilane, methyldiethoxymethoxysilane, methylethoxydimethoxysilane, methyltrichlorosilane, methylmethoxydichlorosilane, methylethoxydichlorosilane, methyldimethoxychlorosilane, methylmethoxyethoxychlorosilane, methyldiethoxychlorosilane, methyl triacetoxysilane, methyldiacetoxymethoxysilane, methyldiacetoxyethoxysilane, methylacetoxydimethoxysilane, methylacetoxymethoxyethoxysilane, methylacetoxydiethoxysilane, methyltrihydroxysilane, methylmethoxydihydroxysilane, methylethoxydihydroxysilane, methyldimethoxyhydroxysilane, methylethoxymethoxyhydroxysilane, and methyldiethoxyhydroxysilane; trifunctional silanes such as ethyltrimethoxysilane, ethyltriethoxysilane, ethyltrichlorosilane, ethyltriacetoxysilane, ethyltrihydroxysilane, propyltrimethoxysilane, propyltriethoxysilane, propyltrichlorosilane, propyltriacetoxysilane, propyltrihydroxysilane, butyltrimethoxysilane, butyltriethoxysilane, butyltrichlorosilane, butyltriacetoxysilane, butyltrihydroxysilane, hexyltrimethoxysilane, hexyltriethoxysilane, hexyltrichlorosilane, hexyltriacetoxysilane, and hexyltrihydroxysilane; and trifunctional phenylsilanes such as phenyltrimethoxysilane, phenyltriethoxysilane, phenyltrichlorosilane, phenyltriacetoxysilane, and phenyltrihydroxysilane.

As long as the effects of Example 4 are not impaired, an organic silicon polymer obtained by using the following compound along with the organic silicon compound having a structure represented by formula (Z) may be used. An organic silicon compound having four reactive groups in a molecule (tetrafunctional silane), an organic silicon compound having two reactive groups in a molecule (difunctional silane), and an organic silicon compound having one reactive group in a molecule (monofunctional silane). Examples thereof include the following: trifunctional vinyl silanes such as dimethyldiethoxysilane, tetraethoxysilane, hexamethyldisilazane, 3-aminopropyltrimethoxysilane, 3-aminopropyltriethoxysilane, 3-(2-aminoethyl)aminopropyltrimethoxysilane, 3-(2-aminoethyl)aminopropyltriethoxysilane, vinyltriisocyanatesilane, vinyltrimethoxysilane, vinyltriethoxysilane, vinyldiethoxymethoxysilane, vinylethoxydimethoxysilane, vinylethoxydihydroxysilane, vinyldimethoxyhydroxysilane, vinylethoxymethoxyhydroxysilane, and vinyldiethoxyhydroxysilane.

As long as the effects of Example 4 are not impaired, an organic silicon polymer obtained by using the following compound along with the organic silicon compound having a structure represented by formula (Z) may be used. An organic silicon compound having four reactive groups in a molecule (tetrafunctional silane), an organic silicon compound having two reactive groups in a molecule (difunctional silane), and an organic silicon compound having one reactive group in a molecule (monofunctional silane). Examples thereof include the following: trifunctional vinyl silanes such as dimethyldiethoxysilane, tetraethoxysilane, hexamethyldisilazane, 3-aminopropyltrimethoxysilane, 3-aminopropyltriethoxysilane, 3-(2-aminoethyl)aminopropyltrimethoxysilane, 3-(2-aminoethyl)aminopropyltriethoxysilane, vinyltriisocyanatesilane, vinyltrimethoxysilane, vinyltriethoxysilane, vinyldiethoxymethoxysilane, vinylethoxydimethoxysilane, vinylethoxydihydroxysilane, vinyldimethoxyhydroxysilane, vinylethoxymethoxyhydroxysilane, and vinyldiethoxyhydroxysilane.

The organic silicon polymer content in the toner particles can be 0.5 mass % or more and 10.5 mass % or less. When the organic silicon polymer content is 0.5 mass % or more, the surface free energy of the surface layer can be further decreased, the flowability is improved, and component contamination and fogging can be suppressed. When the content is 10.5 mass % or less, charge-up can be suppressed. The organic silicon polymer content can be controlled by the type and amount of the organic silicon compound used in forming the organic silicon polymer, and the toner particle manufacturing method, the reaction temperature, the reaction time, the reaction solvent, and pH during the preparation of the organic silicon polymer. The surface layer containing the organic silicon polymer and the toner core particle can be in contact with each other without any gap. In this manner, bleeding of the resin components, the release agent, etc., on the inner side of the surface layer of the toner particles is suppressed, and a toner having excellent storage stability, environmental stability, and development endurance can be obtained. The surface layer may contain, in addition to the aforementioned organic silicon polymer, a resin such as a styrene-acryl-based copolymer resin, a polyester resin, or a urethane resin, and various additives.

2. Method for Confirming Partial Structure by NMR Measurement

Next, the method for confirming the partial structure of the toner particles by NMR measurement is described. The tetrahydrofuran (THF)-insoluble matter of the toner particles described above is prepared as follows. First, 10.0 g of the toner particles are weighed, placed in a cylindrical filter (No. 86R produced by Toyo Roshi Kaisha, Ltd.), and set in a Soxhlet extractor. Extraction is performed for 20 hours using 200 mL of THF as a solvent, and the residue in the cylindrical filter is vacuum dried at 40° C. for several hours. The resulting product is used as the THF insoluble matter of the toner particles for NMR measurement. When the surfaces of the toner particles have been treated with an external additive or the like, the external additive is removed by the following method to obtain toner particles.

To 100 mL of ion exchange water, 160 g of sucrose (produced by Kishida Chemical Co., Ltd.) is added and dissolved on a hot water bath to prepare a sucrose heavy solution. Into a tube (volume: 50 mL) for centrifugal separation, 31 g of the sucrose heavy solution and 6 mL Contaminon N (produced by Wako Pure Chemical Corporation, a 10 mass % aqueous solution of a neutral detergent for washing precision measurement instruments, the detergent having a pH of 7 and containing a nonionic surfactant, an anionic surfactant, and an organic builder) are placed, and a dispersion liquid is prepared. To this dispersion liquid, 1.0 g of the toner is added, and toner lumps are loosened with a spatula or the like.

The tube for centrifugal separation is shaken for 20 minutes with a shaker at 350 spm (strokes per minute). After shaking, the liquid is placed in a glass tube (volume: 50 mL) for a swing rotor, and separated at 3500 rpm for 30 minutes with a centrifugal separator (H-9R produced by Kokusan Co., Ltd.). As a result, the toner particles and the detached external additive separate from each other. After visually confirming that the toner is sufficiently separated from the aqueous solution, the toner that has separated to form the top layer is sampled with a spatula or the like. The sampled toner is filtered through a vacuum filter and dried in a drier for 1 hour or more to obtain toner particles. This process is performed several times to secure the required amount.

The following method is employed to confirm the partial structure represented by formula (1) in the organic silicon polymer contained in the toner particles. The hydrocarbon group represented by R in formula (1) is confirmed by $^{13}$C-NMR.

Measurement Conditions of $^{13}$C-NMR (Solid)

Instrument: JNM-ECX500II produced by JEOL RESONANCE Inc.

Sample tube: 3.2 mmϕ

Sample: tetrahydrofuran insoluble matter of toner particles for NMR measurement, 150 mg Measurement temperature: room temperature Pulse mode: CP/MAS Measurement nucleus frequency: 123.25 MHz ($^{13}$C)

Standard substance: adamantane (external standard: 29.5 ppm)

Sample rotation speed: 20 kHz

Contact time: 2 ms

Delay time: 2 s

Number of runs: 1024

This method was used to identify the hydrocarbon group represented by R in formula (1) on the basis of whether there was a signal derived from a group bonded to a silicon atom, such as a methyl group (Si—$CH_3$), an ethyl group (Si—$C_2H_5$), a propyl group (Si—$C_3H_7$), a butyl group (Si—$C_4H_9$), a pentyl group (Si—$C_5H_{11}$), a hexyl group (Si—$C_6H_{13}$), or a phenyl group (Si—$C_6H_5$). Next, a method for calculating the ratio of the peak area attributable to the structure represented by formula (1) in the organic silicon polymer contained in the toner particles is described.

The $^{29}$Si-NMR (solid) measurement of the THF insoluble matter of the toner particles is conducted under the following conditions.

Measurement conditions of $^{29}$Si-NMR (solid)

Instrument: JNM-ECX500II produced by JEOL RESONANCE Inc.

Sample tube: 3.2 mmϕ

Sample: tetrahydrofuran insoluble matter of toner particles for NMR measurement, 150 mg Measurement temperature: room temperature Pulse mode: CP/MAS Measurement nucleus frequency: 97.38 MHz ($^{29}$Si)

Standard substance: DSS (external standard: 1.534 ppm)

Sample rotation speed: 10 kHz

Contact time: 10 ms

Delay time: 2 s

Number of runs: 2000 to 8000

After the measurement described above, the peaks of multiple silane components with different substituents and bonding groups in the tetrahydrofuran insoluble matter of the toner particles are separated, by curve fitting, into the X1 structure, X2 structure, X3 structure, and X4 structure described below, and the peak area of each structure is calculated.

X1 structure:$(Ri)(Rj)(Rk)SiO_{1/2}$ formula (2)

X2 structure:$(Rg)(Rh)Si(O_{1/2})_2$ formula (3)

X3 structure: $RmSi(O_{1/2})_3$ Formula (4)

X4 structure: $Si(O_{1/2})_4$ Formula (5)

X1 structure:

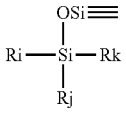

(2)

-continued

X2 structure:

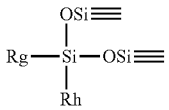

(3)

X3 structure:

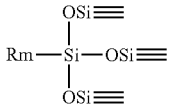

(4)

X4 structure:

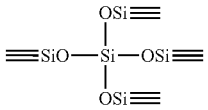

(5)

In formulae (2), (3), and (4), Ri, Rj, Rk, Rg, Rh, and Rm each independently represent an organic group, such as a hydrocarbon group having 1 to 6 carbon atoms, a halogen atom, a hydroxy group, an acetoxy group, or an alkoxy group bonded to silicon.

In the embodiment of the present disclosure, in a chart obtained by $^{29}$Si-NMR measurement of the THF-insoluble matter of the toner particles, the ratio of the peak area attributable to the structure represented by formula (1) relative to the total peak area of the organic silicon polymer can be 20% or more.

When the structure represented by formula (1) needs to be confirmed in further detail, identification may be carried out by using the measurement results of $^{1}$H-NMR in addition to the measurement results of $^{13}$C-NMR and $^{29}$Si-NMR described above.

3. Method for Measuring the Surface Layer Thickness by Cross-Sectional Observation of Toner Particle Next, a method for measuring the ratio of the surface layer containing an organic silicon polymer and having a thickness of 2.5 nm or less as measured by a cross-sectional observation of the toner particles with a transmission electron microscope (TEM) is described. In Example 4, cross-sectional observation of the toner particles is conducted by the following method.

Toner particles are thoroughly dispersed in a room temperature-curable epoxy resin, and then the resin is cured in a 40° C. atmosphere for 2 days. A thin strip of a sample is cut out from the obtained cured product with a microtome equipped with a diamond blade. Cross sections of toner particles in this sample are observed with a transmission electron microscope (TEM) (JEM-2800 produced by JEOL Ltd.) at a magnification of 10,000× to 100,000×. Since there is a difference in atomic weight between the binder resin and the surface layer material and a portion with a large atomic weight appears in lighter shade, identification can be carried out. In order to enhance the contrast between materials, a ruthenium tetroxide staining method or an osmium tetroxide staining method is employed. The particles used in the measurement are particles that have an equivalent circle diameter Dtem in the range of ±10% of the weight-average particle diameter D4 of the toner particles, Dtem being determined from cross sections of the toner particles in the aforementioned TEM image.

As described above, a dark field image of toner particle cross sections is obtained by using JEM-2800 produced by JEOL Ltd., at an acceleration voltage of 200 kV. Next, mapping image is obtained by a three window method using an EELS detector, GIF Quantam produced by Gatan, Inc., to confirm surface layers.

As illustrated in FIG. 8, for each toner particle having an equivalent circle diameter Dtem within the range of ±10% of the weight-average particle diameter D4 of the toner particles, the toner particle cross section is equally divided into sixteen parts with respect to the intersection between the long axis L of the toner particle cross section and an axis L90 that passes through the center of the long axis L and is perpendicular to the long axis L. Next, dividing axes each extending from the aforementioned center to the surface layer are represented by An (n=1 to 32) each, the length of each dividing axis is represented by RAn, and the thickness of the surface layer is represented by FRAn. The number of the dividing axes on which the thickness of the surface layer containing the organic silicon polymer is 2.5 nm or less is counted and the ratio of these axes relative to the thirty two dividing axes is determined. Ten toner particles are measured, and the average per toner particle is calculated.

The equivalent circle diameter Dtem determined from the cross sections of toner particles obtained from a TEM image is determined by the following method. First, for one toner particle, the equivalent circle diameter Dtem determined from the cross section of that toner particle obtained from the TEM image is determined from the following formula.

Equivalent circle diameter (Dtem) obtained from a cross section of a toner particle obtained from a TEM image=(RA1+RA2+RA3+RA4+RA5+RA6+RA7+RA8+RA9+RA10+RA11+RA12+RA13+RA14+RA15+RA16+RA17+RA18+RA19+RA20+RA21+RA22+RA23+RA24+RA25+RA26+RA27+RA28+RA29+RA30+RA31+RA32)/16

The equivalent circle diameters of ten toner particles are determined and averaged to determine the equivalent circle diameter (Dtem) determined from the cross sections of the toner particles.

The ratio of the surface layer containing the organic silicon polymer and having a thickness of 2.5 nm or less is expressed by the following formula:

Ratio of surface layer containing organic silicon polymer and having thickness(FRAn) of 2.5 nm or less=[(number of dividing axes on which thickness(FRAn) of surface layer containing organic silicon polymer is 2.5 nm or less)/32]×100

This calculation is conducted for ten toner particles, and the ratios of the surface layer containing organic silicon polymer and having a thickness (FRAn) of 2.5 nm or less are averaged, and the result is used as the ratio of the surface layer containing organic silicon polymer having a thickness (FRAn) of 2.5 nm or less.

4. Toner Manufacturing Method

Hereinafter, the toner used in Example 4 is described in specific details; however, these examples are not limiting. In the examples and comparative examples, the "parts" of each material is on a mass basis unless otherwise noted.

First, a step for preparing an aqueous medium 1 is described. To 1000.0 parts of ion exchange water in a reactor, 14.0 parts of sodium phosphate (dodecahydrate) (produced by RASA Industries, LTD.) was added, and the temperature was kept at 65° C. for 1.0 hour under nitrogen purging. While stirring the mixture with a T.K. Homomixer (produced by Tokushu Kika Kogyo Co., Ltd.) at 12000 rpm, an aqueous solution of calcium chloride prepared by dissolving 9.2 parts of calcium chloride (dihydrate) in 10.0 parts of ion exchange water was added to the mixture in a single batch to prepare an aqueous medium containing a dispersion stabilizer. A 10 mass % hydrochloric acid was added to the aqueous medium to adjust the pH to 5.0, and an aqueous medium 1 was obtained as a result.

Next, a step of hydrolyzing the organic silicon compound for the surface layer is described. Into a reactor equipped with a stirrer and a thermometer, 60.0 parts of ion exchange water was weighed, and the pH was adjusted to 3.0 by using 10 mass % hydrochloric acid. While stirring the mixture, the temperature was adjusted to 70° C. Subsequently, 40.0 parts of methyltriethoxysilane serving as an organic silicon compound for a surface layer was added thereto, followed by stirring for 2 hours or more to perform hydrolysis. Completion of the hydrolysis was visually confirmed when oil and water no longer separated and formed one layer, followed by cooling. As a result, a hydrolyzed liquid of the organic silicon compound for a surface layer was obtained.

When a surface layer having an organic silicon polymer is to be formed as in Example 4 and when toner particles are formed in an aqueous medium, the surface layer can be formed by, as described above, adding a hydrolyzed liquid of the organic silicon polymer while performing a polymerizing step described below in an aqueous medium. Alternatively, the surface layer may be formed by using the dispersion liquid of the toner particles after polymerization as the core particle dispersion liquid and by adding a hydrolyzed liquid of the organic silicon compound thereto. Alternatively, when the aqueous medium is not used such as when a kneading and pulverizing method is employed, the obtained toner particles are dispersed in an aqueous medium, and this core particle dispersion liquid is combined with the hydrolyzed liquid of the organic silicon compound as described above. As a result, a surface layer can be formed.

Next, a step of preparing a polymerizable monomer composition is described.

Styrene: 60.0 parts

C.I. Pigment Blue 15:3: 6.5 parts

The aforementioned materials were placed in an attritor (produced by Mitsui Miike Chemical Engineering Machinery, Co., Ltd.) and dispersed with zirconia beads 1.7 mm in diameter at 220 rpm for 5.0 hours to prepare a pigment dispersion liquid. The following materials were added to the pigment dispersion liquid.

Styrene: 20.0 parts n-Butyl acrylate: 20.0 parts

Crosslinking agent (divinylbenzene): 0.3 parts

Saturated polyester resin: 5.0 parts (polycondensation product between propylene oxide-modified bisphenol A (2 mol adduct) and terephthalic acid (molar ratio of 10:12), glass transition temperature Tg=68° C., weight-average molecular weight Mw=10000, molecular weight distribution Mw/Mn=5.12)

Fischer-Tropsch wax (melting point: 78° C.): 7.0 parts

The resulting mixture was kept at a temperature of 65° C., and homogeneously dissolved and dispersed at 500 rpm by using a T.K. Homomixer (produced by Tokushu Kika Kogyo Co., Ltd.) so as to prepare a polymerizable monomer composition.

Next, the particle forming step is described. While the temperature of the aqueous medium 1 was kept at 70° C. and the rotation speed of the T.K. Homomixer was kept at 12000 rpm, the polymerizable monomer composition was added to the aqueous medium 1, and 9.0 parts of t-butylperoxy pivalate serving as a polymerization initiator was added thereto. While maintaining 12000 rpm with the stirrer, particles were formed for 10 minutes.

Next, the polymerizing step is described. After the particle forming step, the stirrer was replaced by a propeller stirring blade, and, while the mixture was being stirred at 150 rpm, polymerization was carried out for 5.0 hours by holding a temperature to 70° C., and the polymerization reaction was performed by elevating the temperature to 85° C. and heating at that temperature for 2.0 hours to obtain core particles. The temperature of the slurry containing the core particles was decreased to 55° C., and the pH was measured. The pH value was 5.0. While stirring was continued at 55° C., formation of the surface layer of the toner was started by adding 20.0 parts of the hydrolyzed liquid of the organic silicon compound for a surface layer. After the mixture was held under the same condition for 30 minutes, the resulting slurry was adjusted to a pH of 9.0 for terminating condensation by using an aqueous solution of sodium hydroxide, and the slurry was held under this condition for 300 minutes to form surface layers.

Lastly, washing and drying step is described. Upon completion of the polymerization step, the slurry of toner particles was cooled, hydrochloric acid was added to the slurry of toner particles to adjust the pH to 1.5 or less, and the resulting mixture was stirred for 1 hour and left to stand still. Then solid-liquid separation was performed with a pressurized filter to obtain a toner cake. The toner cake was again formed into a slurry with ion exchange water to again prepare a dispersion liquid, and the dispersion liquid was subjected to solid-liquid separation by the aforementioned filter. Preparation of slurry and solid-liquid separation were repeated until the electrical conductivity of the filtrate was 5.0 S/cm or less, and then solid-liquid separation was performed for the last time to obtain a toner cake. The obtained toner cake was dried in an air stream drier, Flashjet Drier (produced by Seishin Enterprise Co., Ltd.), and coarse particles were removed by using a multizone classifier that utilizes the Coanda effect. As a result, toner particles 1 were obtained. The conditions of drying were adjusted such that the blowing temperature was 90° C. and the dryer outlet temperature was 40° C., and the toner cake feeding speed was adjusted according to the water content in the toner cake so that the outlet temperature did not deviate from 40° C.

Silicon mapping was performed in the cross-sectional TEM observation of the toner particles 1 to confirm that silicon atoms were present in the surface layers and that the ratio of the number of dividing axes on which the thickness of the surface layers of the toner particles containing the organic silicon polymer was 2.5 nm or less was 20.0% or less. In Example 4, the obtained toner particles were directly used as the toner of Example 4 without externally adding at least inorganic silicon.

The adherence ratio of the organic silicon polymer having a structure represented by formula (1) and covering the surface of the toner particle can be 30% or more and 100% or less at the surface of the toner particle. This is because, when the area of the surface layer portion free of the organic silicon polymer increases, the adherence force between the toner particles increases, and the chargeability is changed.

In Example 4, an organic silicon polymer and inorganic silicon fine particles are not externally added to the base particles; alternatively a toner in which an organic silicon polymer covers the surface of the toner particle is used. Since the organic silicon polymer does not easily detach (the adherence ratio is high) compared to the toner subjected to external addition, only the metal soap 45*c* can be efficiency supplied to the photoconductor 1, and thus the effect of the metal soap 45*c* of suppressing image smearing can last longer.

5. Confirming Effects of Toner Particles that Use Organic Silicon Polymer

In Example 4, toners b to e were prepared by the above-described toner manufacturing method but with different adherence ratios of the organic silicon polymer covering the surfaces of the toner particles. The adherence ratio varies depending on the toner manufacturing conditions. In Example 4, toners with different adherence ratios were prepared by changing the conditions of adding the hydrolyzed liquid in the polymerizing step and the retention time after the addition. The pH was adjusted by using hydrochloric acid and a sodium hydroxide aqueous solution. Table 6 indicates the conditions for preparing the toners having different adherence ratios. According to the toners b to e prepared by the above-described method, 0.20 mass % of zinc stearate was added as the metal soap 45*c* by the same method as in Example 1. However, for the toner e, the step of hydrolyzing the organic silicon compound for the surface layer was omitted. Instead, 30 parts of methyltriethoxysilane as the organic silicon compound for the surface layer was directly added as in the form of monomer in the step of preparing the polymerizable monomer composition. In the polymerizing step, pH was measured after cooling to 70° C., and the subsequent addition of the hydrolyzed liquid was omitted. While stirring was continued at 70° C., the pH of the slurry was adjusted to 9.0 to terminate condensation by using an aqueous solution of sodium hydroxide, and then the condition was retained for 300 minutes to form surface layers.

TABLE 6

| | Conditions for adding hydrolyzed liquid | | | Conditions after adding hydrolyzed liquid Retention period | |
|---|---|---|---|---|---|
| | Slurry pH | Slurry temperature (° C.) | Parts of hydrolyzed liquid added (parts) | until adjusting pH for terminating condensation (min) | Adherence ratio (%) |
| Toner b | 5.0 | 55 | 20 | 30 | 97 |
| Toner c | 7.0 | 65 | 20 | 3 | 95 |
| Toner d | 9.0 | 70 | 20 | 0 | 90 |
| Toner e | Hydrolysis was not conducted, and addition was done in dissolving step (see the description) | | | | 85 |

The results obtained from studying the actual effect are described below. In order to study occurrence of image smearing in toner e of Comparative Example 5, and the toners b, c, and d of Example 4, 10,000 sheets were continuously passed in one day at a printing ratio of 1%, the photoconductor was left to stand in the apparatus for one day, and whether there was image smearing after being left to stand was compared. A sample for determining whether image smearing occurred was obtained by printing a half-tone image on one sheet and used for evaluation. The evaluation standard is as follows.

○: No image smearing occurred. There were no blank areas or blurring of contours in the image boundary portion that occurred by latent image blurring in all parts of the image.

□: Slight image smearing occurred. Blank areas or blurring of contours in the image boundary portion caused by latent image blurring occurred in some parts of the image.

x: Image smearing occurred. There were blank areas and blurring of contours in the image boundary portion that occurred by latent image blurring in all parts of the image.

The sheets were passed and the sample was output in an environment of 30° C./80% RH. The total number of sheets that were passed was up to 160,000. The photoconductor 1 was the photoconductor 1 used in Example 3, which was subjected to the roughening treatment and satisfied the conditions for Rz and Sm, and other conditions were the same as in Example 2. The examination results are indicated in Table 7.

TABLE 7

| | | Number of sheets passed (× 1000 sheets) | | | | |
|---|---|---|---|---|---|---|
| | Toner | 50 | 100 | 120 | 140 | 160 |
| Example 4 | Toner b | ○ | ○ | ○ | ○ | ○ |
| | Toner c | ○ | ○ | ○ | ○ | ○ |
| | Toner d | ○ | ○ | ○ | ○ | ○ |
| Comparative Example 5 | Toner e | ○ | ○ | ○ | □ | □ |

As indicated in Table 7, compared to when the toner e of Comparative Example 5 was used, the image smearing did not occur up to 160,000 sheets when toners b, c, and d in Example 4 in which the organic silicon polymer covered the surfaces of the toner particles were used, and satisfactory images were obtained.

When the adherence ratio of the organic silicon polymer is high, the organic silicon polymer is rarely supplied to the grooves in the surface of the photoconductor 1, and thus it is easy to supply the metal soap 45*c* to the grooves in the surface of the photoconductor 1. This is because the organic silicon polymer rarely detaches from the toner, and only the metal soap 45*c* can be efficiently supplied to the photoconductor 1 by the metal soap application operation. When the adherence ratio of the organic silicon polymer is 90% or more as in Example 4, the metal soap 45*c* can be actively supplied onto the surface of the photoconductor 1. Thus, the image smearing suppressing effect of the metal soap 45*c* by the metal soap application operation lasts longer, and the metal soap 45*c* can be stably applied to the surface of the photoconductor 1 over a long term.

According to the structure of Example 4, since an organic silicon polymer toner having a surface layer containing an organic silicon polymer is used, the image smearing suppressing effect of the metal soap 45*c* by the metal soap application operation lasts long.

As a result, the surface of the photoconductor 1 can stably retain the metal soap 45*c*, and a long lifetime structure can be obtained in which image smearing is suppressed by a simple structure while maintaining the endurance of the photoconductor 1.

Although reversal development was employed in Examples 1, 2, 3, and 4, this is not limiting and normal development may be employed. Although a negatively chargeable photoconductor 1 was used in Examples 1, 2, 3, and 4, this is not limiting, and a positively chargeable photoconductor may be used.

Although a color laser printer was used as the image forming apparatus 100 in Examples 1, 2, 3, and 4, an image forming apparatus 100 having a single cartridge structure, such as a black-and-white laser printer, may be used instead.

Alternatively, instead of the intermediate transfer system that uses the intermediate transfer belt 31, a direct transfer system in which the toner image on the surface of the photoconductor 1 is directly transferred onto the recording material S may be employed.

The setting conditions used in the descriptions of Examples 1, 2, 3, and 4 are all exemplary and should not be considered as limiting.

1. Control Mode of Image Forming Apparatus

Figure 9:
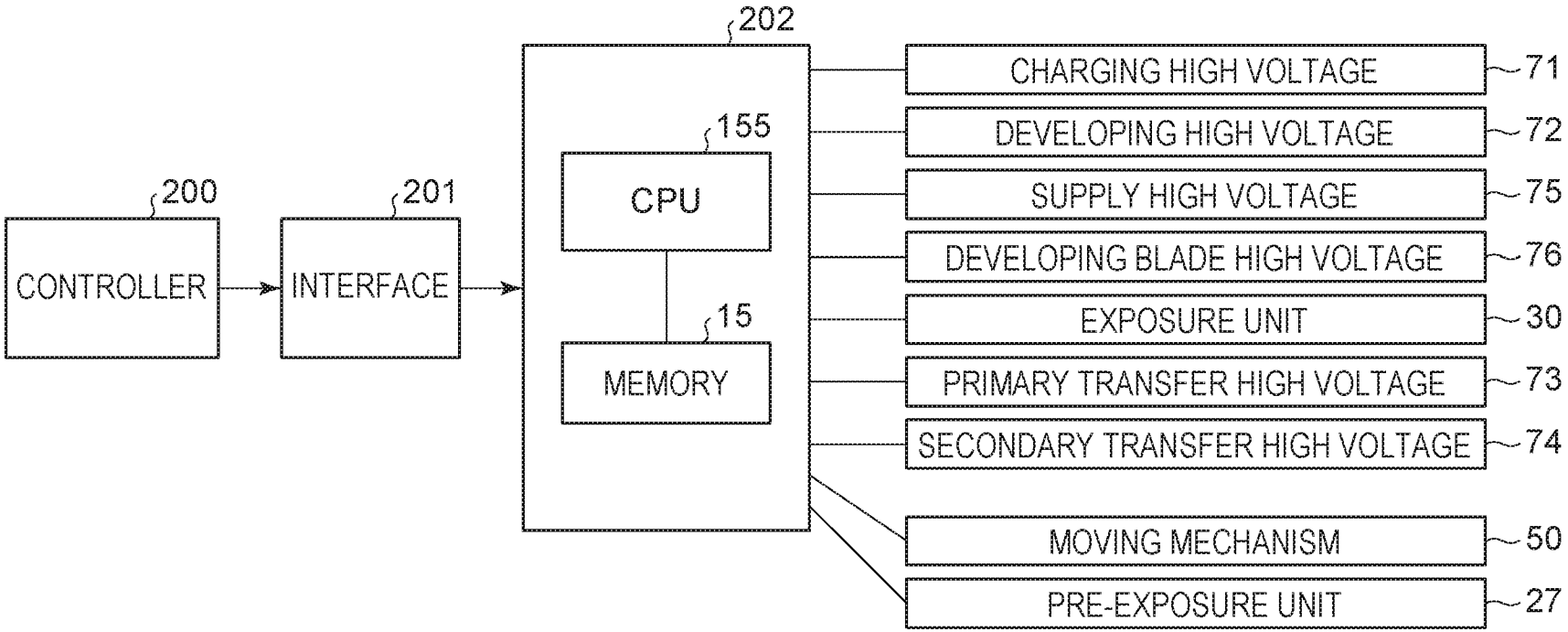
FIG. 9 is a control block diagram illustrating a control mode of an image forming apparatus in Example 5.
Figure 10:
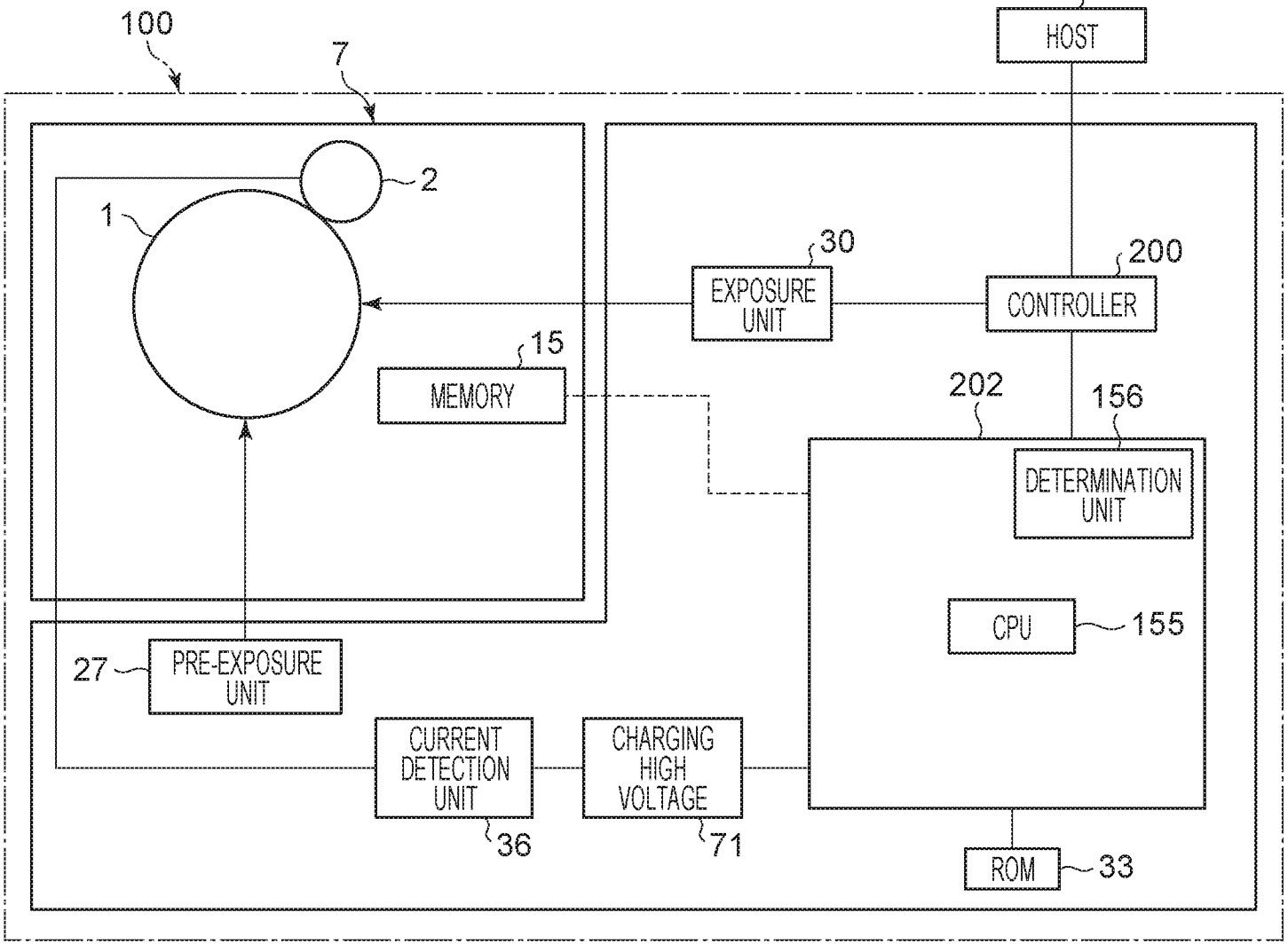
FIG. 10 is a block diagram illustrating a control mode of a current detection unit in Example 5.

FIG. 9 is a block diagram illustrating a schematic control mode of relevant parts of the image forming apparatus 100 of Example 5. FIG. 10 is a diagram illustrating a mode related to the control of a current detection unit 36 that serves as a charging current detecting unit, which is the feature of this embodiment. The control unit 202 includes a CPU 155, which is a central device for performing various calculation processes, and is connected to storage elements such as a RAM and a ROM 33, a memory 15 serving as a storage unit, etc. In addition, a determination unit 156 that determines whether or not the metal soap application operation described below can be executed according to the charging current value that flows during the application of the charging voltage is provided. The RAM stores detection results from sensors, count results from counters, calculation results, etc., and the ROM 33 stores control programs and data tables obtained by preliminary experiments and the like. The control unit 202 also controls the pre-exposure unit 27 that exposes the surface of the photoconductor 1 that has passed the transfer portion with light, and other components. In Example 5, the control unit 202 controls the aforementioned high voltages and the like to perform a metal soap application operation described in detail below.

In Example 5, the memory 15 is a storage unit of the process cartridge 7. The memory 15 may be any memory, and examples thereof include a contact non-volatile memory, a noncontact non-volatile memory, and a volatile memory having a power source. In Example 5, a noncontact non-volatile memory is loaded onto the process cartridge 7. The noncontact non-volatile memory 15 has an antenna (not illustrated) serving as a memory-side information transmitting unit, and reading and writing of the information is enabled by wirelessly communicating with the CPU 155 in the main body of the image forming apparatus 100. In Embodiment 1, the CPU 155 has a function of an image forming apparatus 100-side information transmitting unit and a function of a unit that reads and writes information on the memory 15. The memory 15 stores the initial charging current value and the threshold value for the charging current value.

2. Structure of Photoconductor

In Example 5, the photoconductor 1 includes a support member. The support member can be a conductive support member having electroconductivity. Examples of the shape of the support member include a cylindrical shape, a belt shape, and a sheet shape. In particular, the support member can have a cylindrical shape. The surface of the support member may be subjected to an electrochemical treatment such as anodizing, blasting, machining, or the like.

The material for the support member can be a metal, a resin, glass, or the like. Examples of the metal include aluminum, iron, nickel, copper, gold, stainless steel, and alloys thereof. For example, the support member can be composed of aluminum. Moreover, electroconductivity can be imparted to a resin or glass by mixing a conductive material or coating the resin or glass with a conductive material, for example.

In Example 5, an aluminum cylinder having a diameter of 24 mm and a length of 257.5 mm (JIS-A 3003, aluminum alloy) was used as a support member (conductive support member). In this embodiment, a conductive layer may be formed on the support member. Scratches and irregularities on the surface of the support member can be covered and reflection of light at the surface of the support member can be controlled by forming the conductive layer.

The conductive layer can contain conductive particles and a resin. Examples of the material for the conductive particles include metal oxides, metals, and carbon black. Examples of the metal oxide include zinc oxide, aluminum oxide, indium oxide, silicon oxide, zirconium oxide, tin oxide, titanium oxide, magnesium oxide, antimony oxide, and bismuth oxide. Examples of the metal include aluminum, nickel, iron, nichrome, copper, zinc, and silver.

Among these, a metal oxide is preferably used to form conductive particles, and more preferably, titanium oxide, tin oxide, or zinc oxide is used to form the conductive particles.

When a metal oxide is used as the conductive particles, the surface of the metal oxide may be treated with a silane coupling agent or the like, or the metal oxide may be doped with an element such as phosphorus or aluminum, or an oxide thereof.

Alternatively, the conductive particles may have a multilayer structure that has a core material particle and a covering layer that covers the core material particle. Examples of the core material particle include titanium oxide, barium sulfate, and zinc oxide. Examples of the covering layer include metal oxides such as tin oxide.

When a metal oxide is used as the conductive particles, the volume average particle diameter thereof is preferably 1 nm or more and 500 nm or less and more preferably 3 nm or more and 400 nm or less.

Examples of the resin include a polyester resin, a polycarbonate resin, a polyvinyl acetal resin, an acrylic resin, a silicone resin, an epoxy resin, a melamine resin, a polyurethane resin, a phenol resin, and an alkyd resin.

The conductive layer may further contain a masking agent such as silicone oil, resin particles, and titanium oxide.

The conductive layer preferably has an average thickness of 1 μm or more and 50 μm or less and more preferably has an average thickness of 3 μm or more and 40 m or less.

The conductive layer can be formed by preparing a conductive layer-forming coating solution containing the aforementioned materials and a solvent, forming a coating film of this coating solution, and drying the coating film. Examples of the solvent used in the coating solution include alcohol solvents, sulfoxide solvents, ketone solvents, ether solvents, ester solvents, and aromatic hydrocarbon solvents. Examples of the method for dispersing the conductive particles in the conductive layer coating solution includes methods that use a paint shaker, a sand mill, a ball mill, and a liquid-collision-type high-speed disperser.

In Example 5, the following materials were prepared.

Titanium oxide ($TiO_2$) particles (average primary particle diameter: 230 nm) covered with oxygen-deficient tin oxide ($SnO_2$) and serving as metal oxide particles: 214 parts Phenol resin (monomer/oligomer of a phenol resin) (trade name: PLYOPHEN J-325 produced by DIC Corporation, resin solid content: 60 mass %) serving as a binder material: 132 parts 1-Methoxy-2-propanol serving as a solvent: 98 parts These materials were placed in a sand mill containing 450 parts of glass beads having a diameter of 0.8 mm, and the resulting mixture was dispersed at a rotation speed of 2000 rpm for a dispersing treatment time of 4.5 hours, and a cooling water set temperature of 18° C. As a result, a dispersion liquid was obtained. The glass beads were removed from the dispersion liquid by using a mesh (opening: 150 m). Next, silicone resin particles (trade name: Tospearl 120 produced by Momentive Performance Materials, average particle diameter: 2 μm) serving as a surface roughening material was added to the dispersion liquid. The amount of the silicone resin particles added was set such that the amount was 10 mass % relative to the total mass of the binder material and the metal oxide particles in the dispersion liquid after removal of the glass beads. Furthermore, silicone oil (trade name SH28PA produced by Dow Corning Toray Co., Ltd.) serving as a leveling agent was added to the dispersion liquid so that the amount thereof was 0.01 mass % relative to the total mass of the binder material and the metal oxide particles in the dispersion liquid. Next, a mixed solvent (mass ratio=1:1) of methanol and 1-methoxy-2-propanol was added to the dispersion liquid, followed by stirring, so as to prepare a conductive layer-forming coating solution. The amount of the mixed solvent added was set such that the total mass (in other words, the mass of the solid component) of the metal oxide particles, the binder material, and the surface roughening material in the dispersion liquid was 67 mass % relative to the mass of the dispersion liquid. This conductive layer-forming coating solution was applied to the support member by dip coating, and the applied solution was heated for 30 minutes at 150° C. to form a conductive layer having a thickness of 30.0 μm.

In Example 5, an undercoat layer may be formed on the support member or the conductive layer. The bonding function between the layers is enhanced when an undercoat layer is formed, and thus a charge injection-preventing function can be imparted. The undercoat layer can contain a resin. Alternatively, the undercoat layer may be formed as cured film obtained by polymerizing a composition that contains a monomer having a polymerizable functional group. Examples of the resin include a polyester resin, a polycarbonate resin, a polyvinyl acetal resin, an acrylic resin, an epoxy resin, a melamine resin, a polyurethane resin, a phenol resin, a polyvinylphenol resin, an alkyd resin, a polyvinyl alcohol resin, a polyethylene oxide resin, a polypropylene oxide resin, a polyamide resin, a polyamic acid resin, a polyimide resin, a polyamide imide resin, and a cellulose resin.

Examples of the polymerizable functional group in the monomer having the polymerizable functional group include an isocyanate group, a blocked isocyanate group, a methylol group, an alkylated methylol group, an epoxy group, a metal alkoxide group, a hydroxyl group, an amino group, a carboxyl group, a thiol group, a carboxylic anhydride group, and a carbon-carbon double bond group.

For the purpose of enhancing the electrical characteristics, the undercoat layer may further contain an electron transport material, a metal oxide, a metal, a conductive polymer, and the like. Among these, an electron transport material and a metal oxide are preferably used.

Examples of the electron transport material include quinone compounds, imide compounds, benzimidazole compounds, cyclopentadienylidene compounds, fluorenone compounds, xanthone compounds, benzophenone compounds, cyanovinyl compounds, halogenated aryl compounds, silole compounds, and boron-containing compounds. Alternatively, an undercoat layer may be formed as a cured film obtained by copolymerizing an electron transport material having a polymerizable functional group and the aforementioned monomer having a polymerizable functional group.

Examples of the metal oxide include indium tin oxide, tin oxide, indium oxide, titanium oxide, zinc oxide, aluminum oxide, and silicon dioxide. Examples of the metal include gold, silver, and aluminum.

The undercoat layer may further contain additives.

The undercoat layer preferably has an average thickness of 0.1 μm or more and 50 μm or less, more preferably 0.2 μm or more and 40 μm or less, and yet more preferably 0.3 μm or more and 30 μm or less.

The undercoat layer can be formed by preparing an undercoat layer-forming coating solution containing the aforementioned materials and a solvent, forming a coating film of this coating solution, and drying and/or curing the coating film. Examples of the solvent used in the coating solution include alcohol solvents, ketone solvents, ether solvents, ester solvents, and aromatic hydrocarbon solvents.

In this example, the following materials were prepared.

Electron transport material represented by formula (E) below: 4 parts

Blocked isocyanate (trade name: DURANATE SBN-70D produced by Asahi Kasei Chemicals Corporation): 5.5 parts Polyvinyl butyral resin (S-LEC KS-5Z produced by Sekisui Chemical Co., Ltd.): 0.3 parts Zinc(II) hexanoate (produced by Mitsuwa Chemical Co., Ltd.) serving as a catalyst: 0.05 parts These materials were dissolved in a mixed solvent containing 50 parts of tetrahydrofuran and 50 parts of 1-methoxy-2-propanol to prepare the undercoat layer-forming coating solution. This undercoat layer-forming coating solution was applied to the conductive layer by dip coating, and the applied solution was heated for 30 minutes at 170° C. to form an undercoat layer having a thickness of 0.7 μm.

(E)

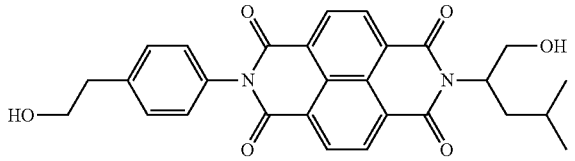

Next, the charge generation layer is described. The charge generation layer can contain a charge generation material and a resin.

Examples of the charge generation material include azo pigments, perylene pigments, polycyclic quinone pigments, indigo pigments, and phthalocyanine pigments. Among these, azo pigments and phthalocyanine pigments are preferable. Among phthalocyanine pigments, oxytitanium phthalocyanine pigments, chlorogallium phthalocyanine pigments, and hydroxygallium phthalocyanine pigments are preferable.

The charge generation material content in the charge generation layer relative to the total mass of the charge generation layer is preferably 40 mass % or more and 85 mass % or less and more preferably 60 mass % or more and 80 mass % or less.

Examples of the resin include polyester resins, polycarbonate resins, polyvinyl acetal resins, polyvinyl butyral resins, acrylic resins, silicone resins, epoxy resins, melamine resins, polyurethane resins, phenol resins, polyvinyl alcohol resins, cellulose resins, polystyrene resins, polyvinyl acetate resins, and polyvinyl chloride resins. Among these, polyvinyl butyral resins are more preferable.

The charge generation layer may further contain additives such as an antioxidant and a UV absorber. Specific examples thereof include hindered phenol compounds, hindered amine compounds, sulfur compounds, phosphorus compounds, and benzophenone compounds.

The charge generation layer preferably has an average thickness of 0.1 m or more and 1 μm or less and more preferably has an average thickness of 0.15 μm or more and 0.4 μm or less.

The charge generation layer can be formed by preparing a charge generation layer-forming coating solution containing the aforementioned materials and a solvent, forming a coating film of this coating solution, and drying the coating film. Examples of the solvent used in the coating solution include alcohol solvents, sulfoxide solvents, ketone solvents, ether solvents, ester solvents, and aromatic hydrocarbon solvents.

In Example 5, 10 parts of hydroxygallium phthalocyanine having a crystal structure having peaks at 7.5° and 28.4° in a chart obtained by Cu K-α X-ray diffraction, and 5 parts of a polyvinyl butyral resin (trade name: S-LEC BX-1 produced by Sekisui Chemical Co., Ltd.) were prepared. These were added to 200 parts of cyclohexanone, the resulting mixture was dispersed for 6 hours in a sand mill with glass beads 0.9 mm in diameter, and 150 parts of cyclohexanone and 350 parts of ethyl acetate were further added to the resulting mixture to dilute and obtain the charge generation layer-forming coating solution. The coating solution was applied to the undercoat layer by dip coating, and the applied solution was dried for 10 minutes at 95° C. to form a charge generation layer having a thickness of 0.20 μm. The X-ray diffraction measurement was performed under the following conditions.

Powder X-ray diffraction measurement

Measurement instrument: X-ray diffractometer RINT-TTR II produced by Rigaku Corporation X-ray tube: Cu Tube voltage: 50 kV Tube current: 300 mA Scan method: 2θ/θ scan Scan speed: 4.0°/min Sampling interval: 0.02°

Start angle (2θ): 5.0°

Stop angle (2θ): 40.0°

Attachment: standard sample holder

Filter: not used

Incident monochromator: used

Counter monochromator: not used

Divergence slit: open

Divergence vertical limitation slit: 10.00 mm

Scatter slit: open

Receiving slit: open

Flat monochromator: used

Counter: scintillation counter

Next, the charge transport layer is described. The charge transport layer is a surface layer in this example. The charge transport layer can contain a charge transport material and a resin. Examples of the charge transport material include polycyclic aromatic compounds, heterocyclic compounds, hydrazone compounds, styryl compounds, enamine compounds, benzidine compounds, triarylamine compounds, and resins having groups derived from these substances. Among these, triarylamine compounds and benzidine compounds are preferable.

Formula (A-1)

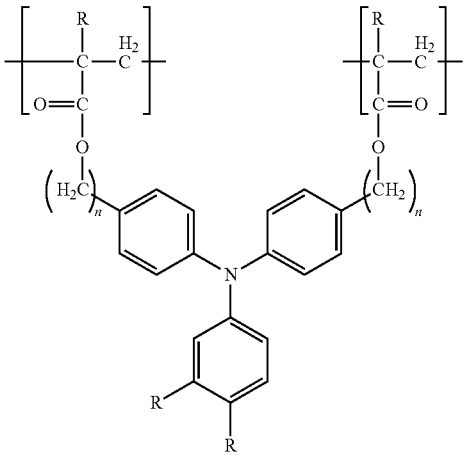

Formula (A-2)

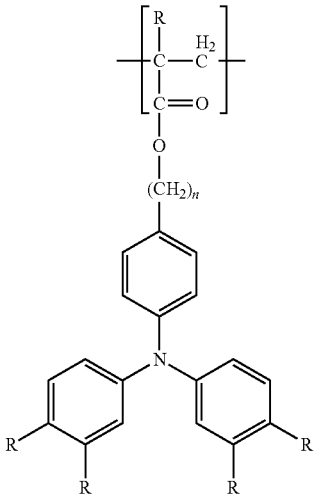

(In the formulae, R represents a hydrogen atom or a methyl group, and n represents an integer of 2 or more and 5 or less.)

As in this example, when the charge transport layer is the surface layer, the charge transport layer can contain, as the charge transport material, both a structure represented by formula (A-1) above and a structure represented by formula (A-2) above.

Examples of the resin include a polyester resin, a polycarbonate resin, an acrylic resin, and a polystyrene resin. Among these, a polycarbonate resin and a polyester resin are preferable. The polyester resin is particularly preferably a polyarylate resin.

When the charge transport layer is the surface layer, the total ratio of the structural units represented by formula (A-1) and (A-2) in the charge transport layer can be 60 mass % or more.

When the charge transport layer is not the surface layer, the charge transport material content in the charge transport layer relative to the total mass of the charge transport layer is preferably 25 mass % or more and 70 mass % or less and more preferably 30 mass % or more and 55 mass % or less. The content ratio (mass ratio) of the charge transport material to the resin is preferably 4:10 to 20:10 and more preferably 5:10 to 12:10.

The charge transport layer may contain additives such as an antioxidant, a UV absorber, a plasticizer, a leveling agent, a lubrication imparter, a wear resistance improver, and the like. Specific examples thereof include hindered phenol compounds, hindered amine compounds, sulfur compounds, phosphorus compounds, benzophenone compounds, siloxane-modified resins, silicone oil, fluororesin particles, polystyrene resin particles, polyethylene resin particles, silica particles, alumina particles, and boron nitride particles.

The charge transport layer preferably has an average thickness of 5 μm or more and 50 μm or less, more preferably 8 μm or more and 40 μm or less, and yet more preferably 10 μm or more and 30 μm or less.

The charge transport layer can be formed by preparing a charge transport layer-forming coating solution containing the aforementioned materials and a solvent, forming a coating film of this coating solution, and drying the coating film. Examples of the solvent used in the coating solution include alcohol solvents, ketone solvents, ether solvents, ester solvents, and aromatic hydrocarbon solvents. Among these solvents, ether solvents and aromatic hydrocarbon solvents are preferable.

In this example, the following materials were prepared.

Compound (charge transport material (hole transport compound)) represented by formula (C-1) below: 6 parts Compound (charge transport material (hole transport compound)) represented by formula (C-2) below: 3 parts Compound (charge transport material (hole transport compound)) represented by formula (C-3) below: 1 part Polycarbonate (trade name: Iupilon Z400 produced by Mitsubishi Engineering-Plastics Corporation): 10 parts Polycarbonate resin having copolymerization units (C-4) and (C-5): 0.02 parts (x/y=9/1, Mw=20,000)

These materials were dissolved in an o-xylene 25 parts/methyl benzoate 25 parts/dimethoxymethane 25 parts mixed solvent to prepare a charge transport layer-forming coating solution. This charge transport layer-forming coating solution was applied to the charge generation layer by dip coating to form a coating film, and the coating film was dried for 30 minutes at 120° C. to form a charge transport layer having a thickness of 16 μm.

(C-1)

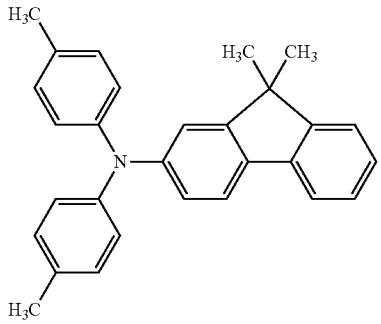

-continued (C-2)

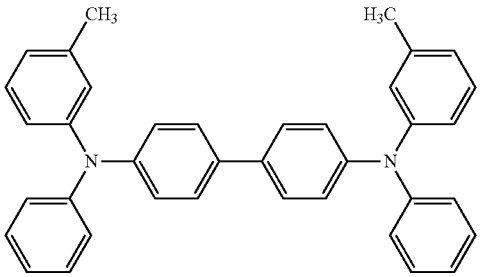

(C-3)

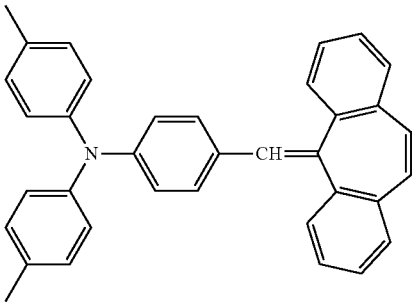

(C-4)

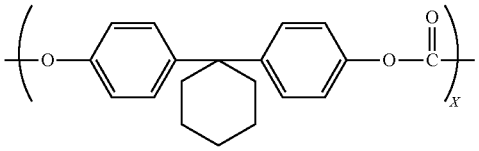

(C-5)

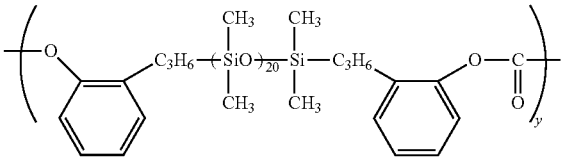

Thus, a photoconductor h was manufactured as a cylindrical (drum-shaped) photoconductor 1 having a support member, an undercoat layer, a charge generation layer, and a charge transport layer disposed in this order.

As described above, the photoconductor 1 of this embodiment is constituted by a metal support member having electroconductivity, a conductive layer that serves as an undercoat layer of the support member, and photosensitive layers (charge generation layer and charge transport layer) formed on the undercoat layer. The photoconductor 1 is obtained by forming a photosensitive material, such as an organic photosemiconductor (OPC), amorphous selenium, or amorphous silicon, on a cylinder-shaped drum base that serves as a support, is composed of aluminum, nickel, or the like, and has an outer diameter ϕ of 24 mm.

3. Metal Soap Application Operation

Regarding the image smearing described above, suppressing the wear of the photoconductor 1 causes refreshing of the surface of the photoconductor 1 to be more difficult; in particular, in a high-humidity environment, blurring of an electrostatic latent image is likely to occur. The image smearing is likely to occur when the wear ratio is 0.05 μm/1000 sheets or less.

The timing of executing the metal soap application operation can be during rotation of the photoconductor 1 before the image forming operation or during rotation of the photoconductor 1 after the image forming operation. In other words, the metal soap application operation is executed when the image forming operation is not being performed. However, as long as the current can be highly accurately detected, the current detection may be executed during the image forming operation. In Example 5, whether or not the metal soap application operation can be executed is determined by the determination unit 156 according to the value of the charging current that flows during application of the charging voltage. In this example, the process is controlled so that the metal soap application operation is executed when the predetermined threshold value for the charging current value is exceeded.

During the metal soap application operation, the back contrast Vback, which is the potential difference between the dark potential Vd and the developing voltage, can be larger than that during normal image formation. This is because the metal soap 45*c* charged to have an opposite polarity to that of the toner 10 electrically adheres to the surface of the photoconductor 1 in larger quantities as the magnitude of the Vback is increased, and thus the metal soap 45*c* on the developing roller 4 can efficiently adhere to the surface of the photoconductor 1. In Example 5, Vback is set to 200 V during normal image formation; in contrast, Vback is set to 300 V during the metal soap application operation. Specifically, the developing voltage is set to −300 V to −200 V. Alternatively, in order to set the dark potential to −500 V to −600 V, a charging voltage of −1100 V including extra −100 V may be applied to the charging roller 2.

4. Control Procedure for Metal Soap Application Operation

Next, the timing of the metal soap application operation is described.

In Example 5, the charging current flowing in the charging roller 2 is detected by the charging current detection unit 36, and the timing of the metal soap application operation is determined on the basis of the charging current value.

In order to detect the charging current flowing in the charging roller 2, in Example 5, the charging current detection unit 36 is provided as illustrated in FIG. 10. The charging current detection unit 36 that has received a signal from the CPU 155 detects the charging current value while applying a DC voltage to the charging roller 2.

Figure 11:
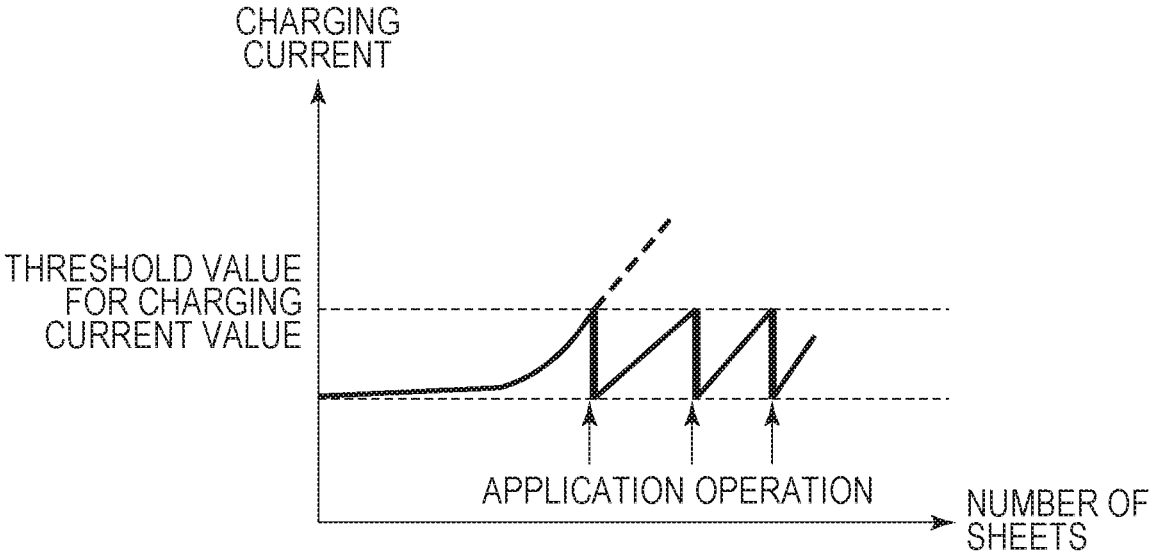
FIG. 11 is a graph illustrating the endurance transition of a charging current value in Example 5.

FIG. 11 illustrates transition in endurance of the charging current value detected when the pre-exposure is OFF. From the initial stage of printing to the intermediate stage in terms of the number of printouts made, the charging current value is stable even when the sheets are passed; however, as the corona products build up on the surface of the photoconductor 1 and the applied amount of the metal soap 45*c* decreases, the charging current value increases. Furthermore, as endurance is continued, the charging current value increases further, and image smearing occurs (indicated by a thick dotted line in the graph). In Example 5, the threshold value is set in the range in which image smearing does not occur with respect to the initial normal charging current ("Threshold value for charging current value" in the graph), and the timing of the metal soap application operation is determined by comparing this predetermined threshold value and the present value of the charging current flowing during application of the charging voltage detected when pre-exposure is OFF. The timing of the metal soap application operation is determined by the aforementioned method, and the metal soap application operation is executed. In Example 5, the threshold value for the charging current value was set to 25 μA. It was confirmed that minor image smearing occurred in the output image when the charging current value exceeded 25 μA. When the charge transport layer of the photoconductor 1 is 16 μm in thickness and the applied charging voltage is 1000 V, the initial charging current value is set to 20 μA. The threshold value can be in the range of 25 to 32 μA. The Δ between the initial current value and the threshold value is 2 to 5 μA, and this Δ indicates the amount of the corona products adhering to the surface of the photoconductor 1. The range of the threshold value and the range of Δ are described in detail below. The feature of this example is that, in the metal soap application operation, the metal soap is applied to suppress adherence of the corona product until Δ is substantially zero.

The feature of Example 5 is that, when the detected charging current value exceeds the predetermined threshold value, the metal soap application operation is executed; however, the execution conditions for the metal soap application operation are not limited to this. For example, the operation may be executed when the value of Δ exceeds a predetermined value. In other words, the process may be designed such that when the charging current value of the charging current detected by the charging current detection unit 36 is a first current value, the application operation is not executed, but when the charging current value is a second current value having an absolute value larger than the first current value, the application operation is executed. Here, Δ can be set as appropriate, and the effect is that the corona products generated on the surface of the photoconductor 1 can be removed by executing the metal soap application operation as soon as A shows a slight increase.

Figure 12:
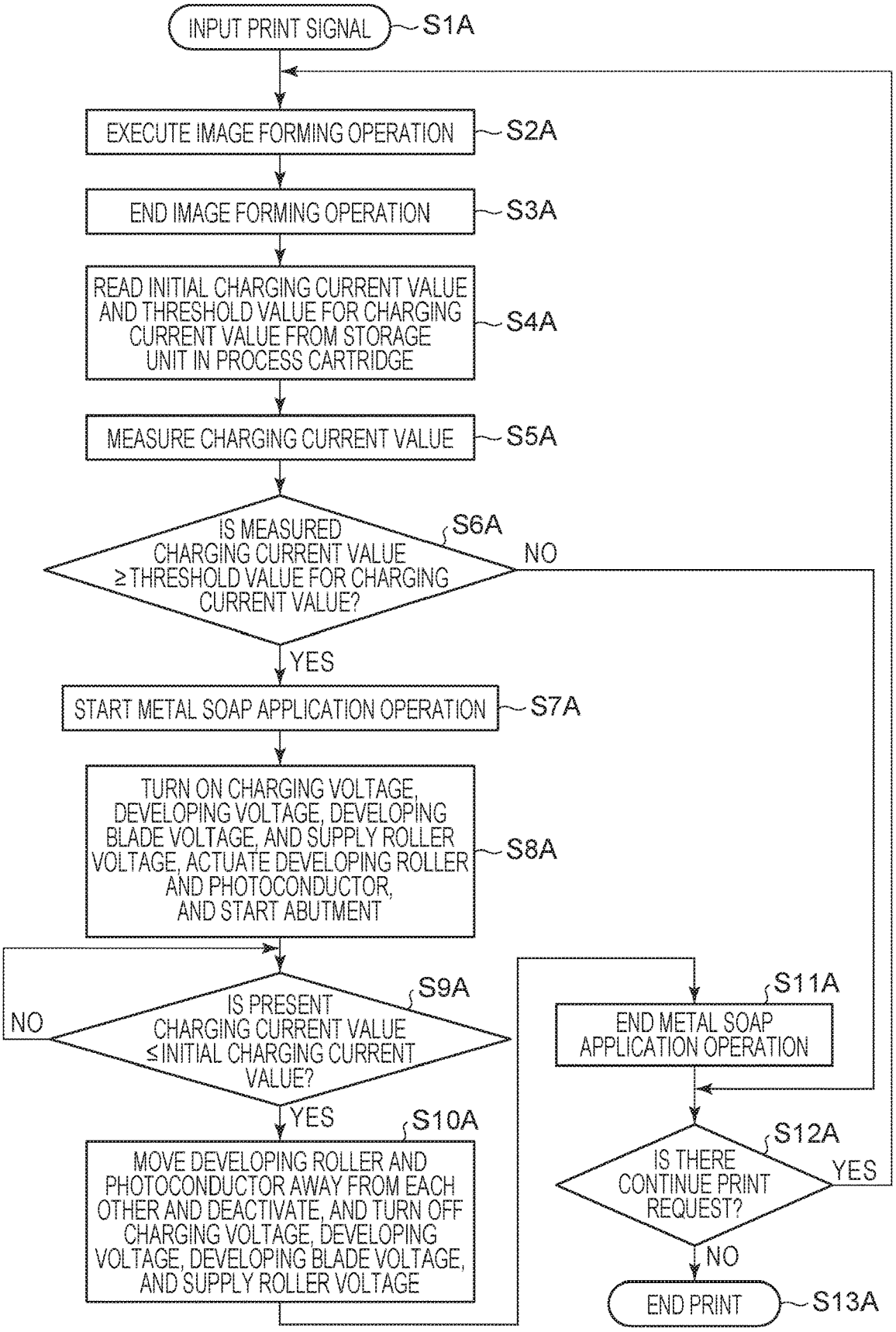
FIG. 12 is a flowchart illustrating a metal soap application operation in Example 5.

Next, referring to the flowchart in FIG. 12, the control procedure for the metal soap application operation for avoiding image smearing is described. In Example 5, the control unit 202 executes the metal soap application operation.

The process cartridge 7 is equipped with the memory 15, and the memory 15 stores the initial charging current value and the threshold value for the charging current value described above. When a print signal is input (S1A), image forming operation is executed (S2A). When the image forming operation is ended (S3A), the CPU 155 in the image forming apparatus 100 communicates with the memory 15 and reads the initial charging current value and the threshold value for the charging current value (S4A).

Next, the CPU 155 detects the charging current through the current detection unit 36, and measures the present charging current value at a desired charging voltage (S5A). Next, the present charging current value and the set threshold value for the charging current value are compared to determined whether this is the timing of executing the metal soap application operation (S6A).

If the present charging current value exceeds the set threshold value, it is the timing of executing the metal soap application operation, and thus the metal soap application operation is started (S7A).

First, a charging voltage, a developing voltage, a blade voltage, and a toner supplying voltage are applied while the developing roller 4 and the photoconductor 1 are actuated and the developing roller 4 is caused to abut against the photoconductor 1 (S8A).

Next, while detecting the charging current, execution of the metal soap application operation is continued until the initial charging current value is reached (S9A).

When the initial charging current value is reached, the developing roller 4 is moved away from the photoconductor 1, the developing roller 4 and the photoconductor 1 are deactivated, the voltages applied are turned OFF (S10A), and the metal soap application operation is ended (S11A).

After the metal soap application operation is ended, whether there is a continue print request is determined (S12A), and if there is no request, the process moves to end print operation (S13A) and if there is a request, the operations from S2A to S12A are repeated until there is no longer a continue print request.

The metal soap application operation in S8A may be executed directly after completion of the image forming operation in S3 without performing the operation of moving the developing roller 4 away and while the various voltages are still applied and various devices are still activated.

Figure 13:
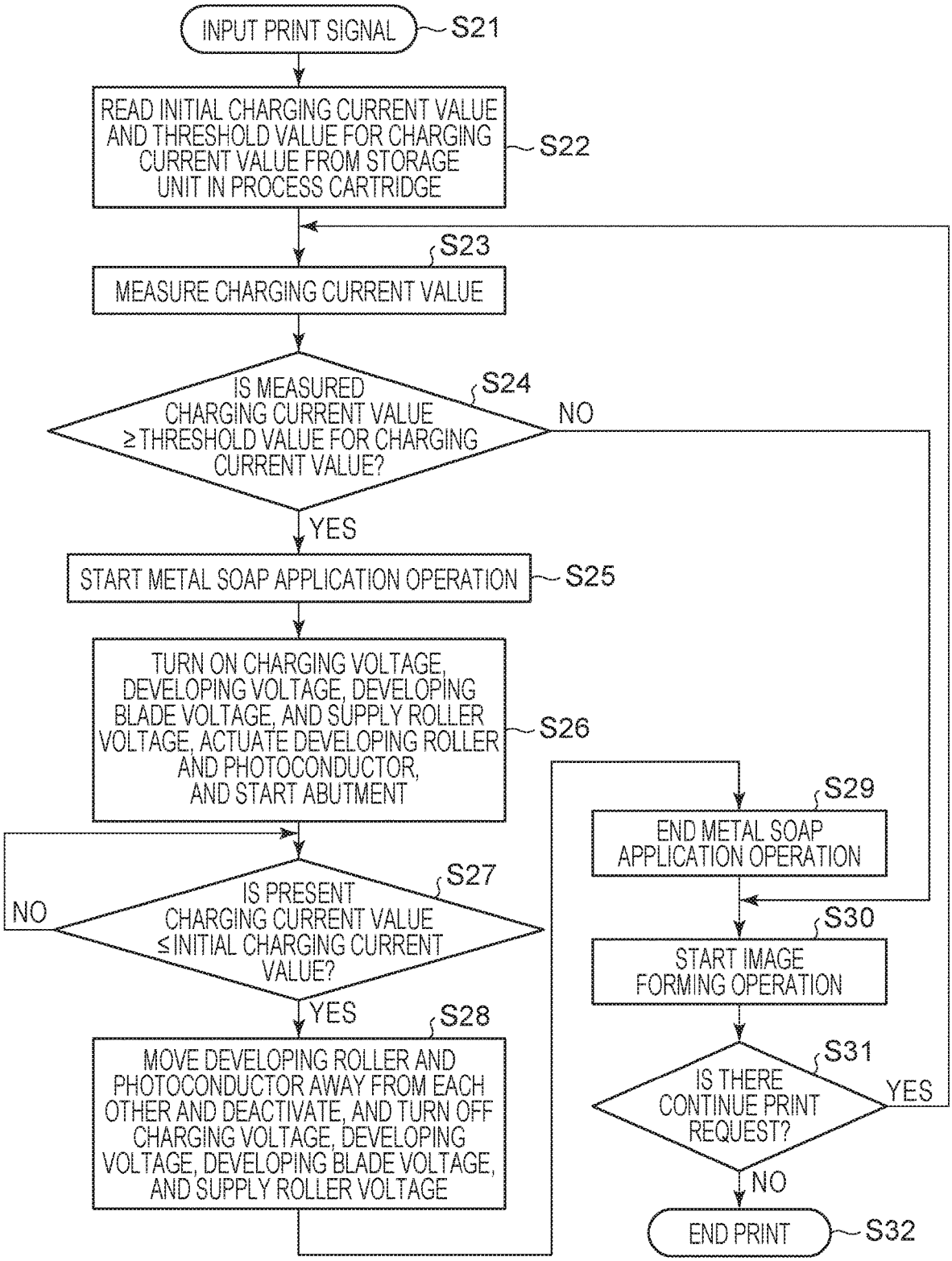
FIG. 13 is a flowchart illustrating a metal soap application operation in Example 5.

Alternatively, as illustrated in a flowchart in FIG. 13, current detection may be performed before executing the image forming operation, and then the metal soap application operation may be performed. The flowchart in FIG. 13 will now be described.

When a print signal is input (S21), the CPU 155 in the image forming apparatus 100 communicates with the memory 15 and reads the initial charging current value and the threshold value for the charging current value (S22).

Next, the CPU 155 detects the charging current through the charging current detection unit 36, and measures the present charging current value at a desired charging voltage (S23). Next, the present charging current value and the set threshold value for the charging current value are compared to determine whether this is the timing of executing the metal soap application operation (S24).

If the present charging current value exceeds the set threshold value, it is the timing of executing the metal soap application operation, and thus the metal soap application operation is started (S25).

First, a charging voltage, a developing voltage, a blade voltage, and a toner supplying voltage are applied while the developing roller 4 and the photoconductor 1 are actuated and the developing roller 4 is caused to abut against the photoconductor 1 (S26).

Next, while detecting the charging current, execution of the metal soap application operation is continued until the initial charging current value is reached (S27).

When the initial charging current value is reached, the developing roller 4 is moved away from the photoconductor 1, the developing roller 4 and the photoconductor 1 are deactivated, the voltages applied are turned OFF (S28), the metal soap application operation is ended (S29), and the image forming operation is started (S30).

After image forming operation is ended, whether there is a continue print request is determined (S31), and if there is no request, the process moves to an end print operation (S32) and if there is a request, the operations from S23 to S31 are repeated until there is no longer a continue print request.

The metal soap application operation is executed until Δ reaches 0, and the duration of the metal soap application operation can be 2 to 30 seconds. The minimum duration is the time taken for the photoconductor 1 to rotate once. Downtime is generated if the duration of the metal soap application operation is excessively long; thus, the time period is set as appropriate. Current detection may be performed by the charging current detection unit 36 during execution of the metal soap application so that the metal soap application operation may be ended when Δ reaches 0 by checking the detected charging current value.

5. Effect of Metal Soap Application Operation

The effect achieved when the metal soap application operation described in Example 5 was executed was studied. The DD peripheral speed ratio and the voltage settings of the metal soap application operation in Comparative Examples 6 and 7 and Example 5 are as indicated in Table 8. The metal soap application operation and whether the charging current detection can be executed or not when the metal soap application operation is being executed are indicated in Table 9.

TABLE 8

| | Image forming operation | Metal soap application operation | | |
|---|---|---|---|---|
| | | Comparative Example 6 | Comparative Example 7 | Example 5 |
| DD peripheral speed ratio (%) | 140 | Not executed | 300 | 300 |
| Dark potential (V) | −500 | | −500 | −500 |
| Developing voltage (V) | −300 | | −200 | −200 |
| Vback (V) | 200 | | 300 | 300 |

TABLE 9

| | Metal soap application operation | Charging current detection |
|---|---|---|
| Comparative Example 6 | x | x |
| Comparative Example 7 | ○ | x |
| Example 5 | ○ | ○ |

As shown in Tables 8 and 9, the metal soap application operation described in Example 5 was not executed in Comparative Example 6. In Comparative Example 7, the metal soap application operation was executed every predetermined number of sheets (100 sheets) for 5 seconds each without executing charging current detection. Meanwhile, in Example 5, when the current value exceeded the threshold value as a result of conducting charging current detection, the metal soap application operation was performed and was continued until the current value reached the initial charging current value.

The results obtained from studying the actual effect are described below. In order to study occurrence of image smearing in Example 5, Comparative Example 6, and Comparative Example 7, 10,000 sheets were continuously passed in one day at a printing ratio of 1%, the photoconductor was left to stand in the apparatus for one day, and whether there was image smearing after being left to stand was compared. The reason for leaving the photoconductor to stand for one day is that the corona products generated on the surface of the photoconductor 1 sufficiently absorb moisture by being left to stand for one day, and thus the effect of reducing the surface resistance of the photoconductor 1 becomes prominent. A sample for determining whether image smearing occurred was obtained by printing a halftone image on one sheet and used for evaluation. The evaluation standard is as follows.

○: No image smearing occurred. There were no blank areas or blurring of contours in the image boundary portion that occurred by latent image blurring in all parts of the image.

x: Image smearing occurred. Blank areas and blurring of contours in the image boundary portion resulting from latent image blurring occurred in some or all parts of the image. The sheets were passed and the sample was output in an environment of 30° C./80% RH. The total number of sheets that were passed was up to 120,000. The results are indicated in Table 10.

TABLE 10

| | Number of sheets passed (× 1000 sheets) | | | | | |
|---|---|---|---|---|---|---|
| | 20 | 40 | 60 | 80 | 100 | 120 |
| Comparative Example 6 | ○ | x | x | x | x | x |
| Comparative Example 7 | ○ | ○ | ○ | ○ | x | x |
| Example 5 | ○ | ○ | ○ | ○ | ○ | ○ |

As indicated in Table 10, in Comparative Example 6, image smearing is satisfactorily suppressed up to 20,000 sheets, but image smearing occurs after the 40,000 sheets. In the initial stage, the metal soap 45*c* is supplied together with the toner 10, and thus the image smearing is minor; however, as the image formation is repeated, the amount of the metal soap 45*c* that stays on the surface of the photoconductor 1 becomes smaller than the amount of the metal soap 45*c* that can be supplied. Presumably thus, the supply of the metal soap 45*c* merely by the image forming operation was not enough, and thus image smearing occurred.

In Comparative Example 7, the lifetime was longer by 60,000 sheets compared to Comparative Example 6, but image smearing occurred after 100,000 sheets. The lifetime was extended compared to Comparative Example 6 since the metal soap application operation was executed. This is presumably because the metal soap 45*c* was actively supplied onto the surface of the photoconductor 1 during the metal soap application operation, and thus the effect of suppressing image smearing was exhibited. However, since the metal soap application operation was executed at the same timing in a uniform manner from the initial stage, the amount of the metal soap 45*c* needed could not be supplied onto the surface of the photoconductor 1 in the latter stage in which the depletion of the metal soap 45*c* becomes prominent. The metal soap 45*c* that was supplied in excess during the initial stage was scraped off by the cleaning blade 8 and the effect did not last as long as in Example 5. Furthermore, since the metal soap application operation was executed regularly, throughput was also decreased.

In contrast, in Example 5, image smearing was sufficiently suppressed even after reaching 120,000 sheets. This is presumably because, in addition to the effect of the metal soap application operation, charging current detection was executed so that an appropriate amount of the metal soap 45*c* adhered to the photoconductor 1 at an appropriate timing.

The toner 10 with the metal soap 45*c* externally added thereto is effective for suppressing image smearing; however, as the image formation is repeated, the deficiency in the metal soap 45*c* that can be supplied occurred, and the image smearing could not be sufficiently suppressed when the current detection was not conducted. However, in the structure of Example 5, the metal soap 45*c* is incorporated into the toner 10, and image smearing can be suppressed by performing the following control. The image forming apparatus 100 of Example 5 includes a current detection unit 36 that detects a current flowing from the charging roller 2 to the photoconductor 1 while a charging voltage is being applied to a charging voltage applying unit 71, which is a first voltage applying unit, and a control unit 202 that controls the charging voltage applying unit 71. The toner 10 contains the metal soap 45*c*, and an image forming operation for forming a toner image on a recording material S and an application operation for applying the metal soap 45*c* to the surface of the photoconductor 1 are executed. The control unit 202 controls the process so that the metal soap application operation is executed on the basis of the current value of the current flowing from the charging roller 2 to the photoconductor 1 and detected by the current detection unit 36. The metal soap application operation is executed when the current value of the current flowing from the charging roller 2 to the photoconductor 1 and detected by the current detection unit 36 exceeds a predetermined threshold value. In addition, the metal soap application operation is controlled so that the speed ratio between the surficial moving speed of the photoconductor 1 and the surficial moving speed of the developing roller 4 is larger than the speed ratio during the image forming operation. Moreover, the back contrast Vback, which is the difference between the surface potential of the photoconductor 1 charged by the charging roller 2 in the developing portion and the developing voltage applied to the developing roller 4, is larger in the metal soap application operation than in the image forming operation. As a result, even when the metal soap 45*c* became deficient, the photoconductor 1 could be replenished with the metal soap 45*c*, and the image smearing could be suppressed over a long term.

However, in general, suppressing the wear of the photoconductor 1 causes refreshing of the photoconductor surface to be more difficult, and image defects caused by image smearing occur in a high-humidity environment. Although the toner with the metal soap 45*c* externally added thereto is effective for suppressing image smearing, repeating image formation caused shortage of the metal soap 45*c* that can be supplied, and image smearing could not be suppressed. However, according to the structure of Example 5, the photoconductor 1 could be replenished with the metal soap 45*c* at an appropriate timing as a result of current detection, and the image smearing could be suppressed.

Although the metal soap application operation was conducted by detecting the charging current while pre-exposure was OFF in Example 5, it is sufficient if it is possible to determine the metal soap application operation timing; for example, the metal soap application operation may be performed by turning the pre-exposure ON based on the detection result of detecting the charging current during the image formation performed while the pre-exposure is ON.

In Example 5, the charging current detection unit 36 was connected to the charging roller 2 to detect the current that flows during application of the charging voltage; alternatively, a current detection unit may be connected between the photoconductor 1 and the earth of the photoconductor 1 to perform detection.

In the structure of the image forming apparatus 100 used in Example 6, the same components as those of Examples 1 to 5 are denoted by the same reference signs and descriptions thereof are omitted.

Example 6 features that the metal soap application operation is executed at an appropriate timing even when the thickness of the photoconductor 1 decreased due to the repeated image formation and the dark potential (Vd) increased as a result. Since Vd increases by repeating image formation, in Example 6, the developing voltage, the developing blade voltage, and the toner supplying voltage are changed as appropriate according to the increase in Vd. The wear ratio of the photoconductor 1 used in Example 6 was 0.048 to 0.050 (m/1000 sheets). Thus, considering the scraping of the surface of the photoconductor 1, the threshold value is changed as appropriate. Specifically, the initial thickness of the photoconductor 1 is 16 μm, and the thickness of the photoconductor 1 after 120,000 sheets of printing is about 10 μm. When the thickness is less than 10 μm, the images may be adversely affected due to the decreased resistance of the surface of the photoconductor 1; thus, the lifetime of the photoconductor 1 in Example 6 is set to 10 μm. In Example 6, the threshold value for the charging current value at the time the thickness of the charge transport layer of the photoconductor 1 was 10 μm was set to 32 μA. When the thickness of the charge transport layer of the photoconductor 1 was 10 μm and the applied charging voltage was 1000 V, the charging current value was set to 30 μA, and the Δ between the current value and the threshold value was set to 2 μA. As the thickness of the photoconductor 1 decreases and the charging current value increases, the amount of the corona products generated increases; thus, Δ is set to a low value. Since the charging current value changes according to the number of sheets subjected to image formation, the threshold value is set so that A decreases gradually.

1. Timing of Executing Metal Soap Application Operation

First, the metal soap application operation timing in Example 6 is described.

Figure 14:
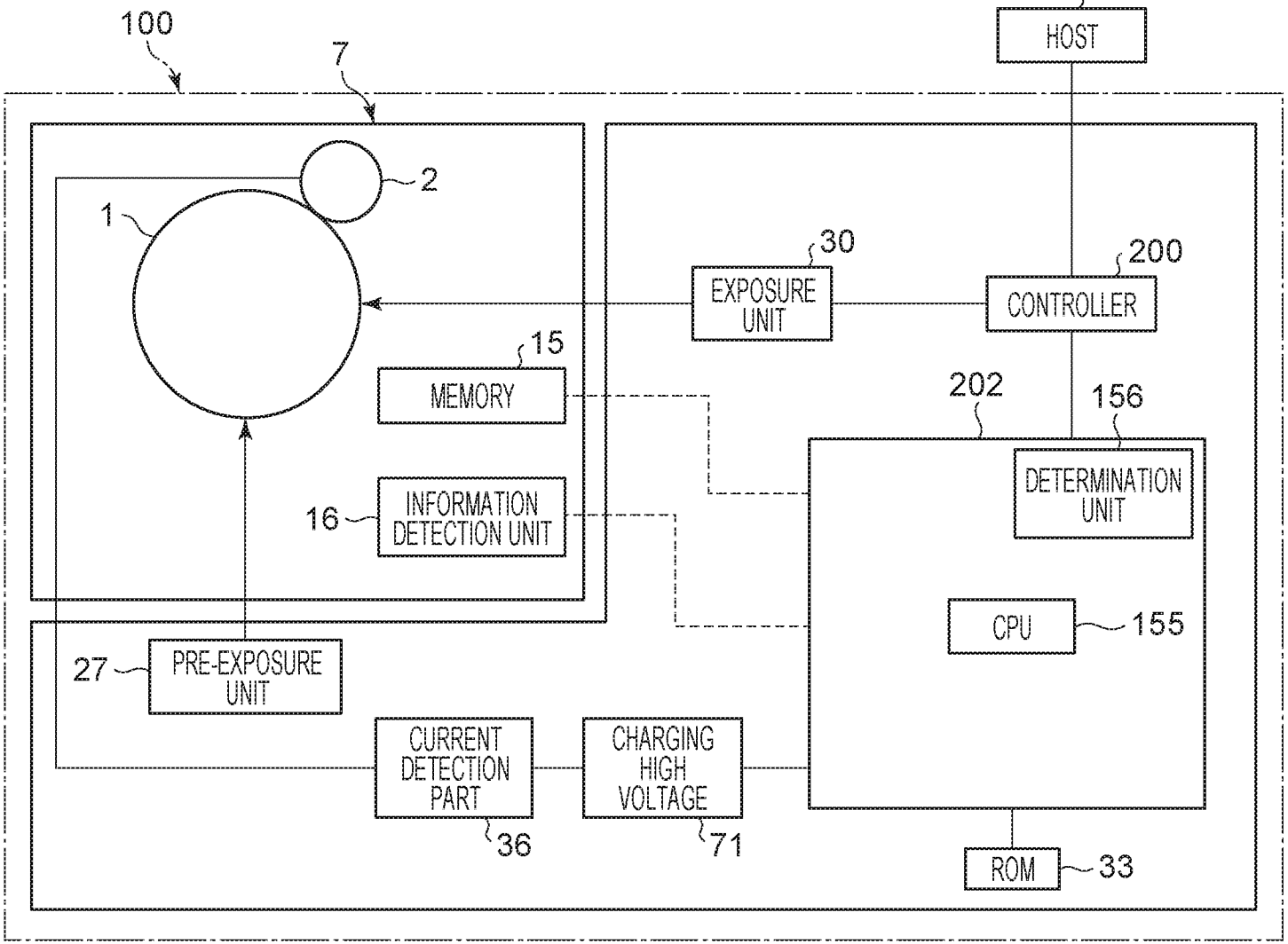
FIG. 14 is a block diagram illustrating a control mode of a current detection unit in Example 6.

As illustrated in FIG. 14, in Example 6, the image forming apparatus 100 is further equipped with an information detection unit 16 that detects the use information regarding the photoconductor 1 and the charging roller 2, and the threshold value for the charging current value is set by using the information regarding the thickness of the photoconductor 1, which is the information detected by the information detection unit 16. Then, the metal soap application operation timing is determined by comparing the threshold value and the value of the charging current flowing in the charging roller 2.

Figure 15:
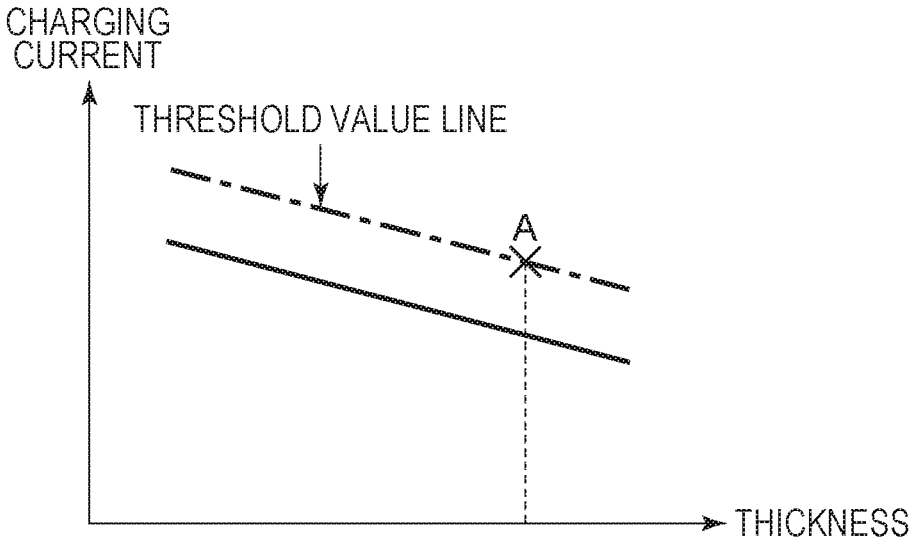
FIG. 15 is a graph illustrating the relationship between the thickness of a photoconductor and a charging current in Example 6.

FIG. 15 is a graph showing the relationship between the thickness of the photoconductor 1 and the charging current in a 30° C./80% RH (H/H) environment. The charging voltage is a voltage that sets the initial dark potential Vd to −500 V. The graph shows that the charging current increases linearly as the thickness of the photoconductor 1 decreases. The point A in FIG. 15 is the initial threshold value for the charging current value. When the thickness of the photoconductor 1 is decreased, the threshold value for the charging current value can be set by drawing a straight line passing the point A and being parallel to the aforementioned line.

Thus, a calculation formula for calculating the estimated present charging current value corresponding to the thickness change on the basis of the measured data and the threshold value for the charging current value is determined, and this data is stored in advance in the ROM 33 of the main body of the image forming apparatus 100. The estimated present charging current value and the threshold value for the charging current value can be calculated by employing the data on the approximation formula stored in the ROM 33 and the information regarding the thickness of the photoconductor 1 stored in the memory 15.

The information regarding the thickness of the photoconductor 1 will now be described in detail.

The information regarding the thickness of the photoconductor 1 is calculated by the following method. As mentioned above, the thickness of the photoconductor 1 decreases as the surface of the photoconductor 1 is deteriorated by discharge and is scraped off due to passing of the recording material S (sheet passing) or rubbing caused by abutment against the cleaning blade 8.

In the image forming apparatus 100 of Example 6, the decrease in the thickness of the photoconductor 1 is correlated with the charging voltage application time. Moreover, the charge voltage application time is proportional to the number of sheets subjected to image formation. Thus, the rate of decrease in the thickness of the photoconductor 1 can be expressed as a linear function of the number of sheets subjected to image formation. Moreover, there is also a correlation between the number (P) of sheets subjected to image formation and the number of rotations (surface moving distance) of the photoconductor 1. Furthermore, there is also a correlation between the number (P) of sheets subjected to image formation and the number of sheets of the recording material (S) used in printing. Thus, the information regarding the thickness of the photoconductor 1 may be calculated by using at last one of the number (P) of sheets subjected to image formation, the number of sheets of the recording material S that has passed through the image forming apparatus 100, the number of rotations of the photoconductor 1, and the voltage application time by the voltage applying unit 71.

In Example 6, the memory 15 loaded onto the process cartridge 7 stores, as the information regarding the thickness of the photoconductor 1, the number (P) of sheets subjected to image formation. Then, the timing of executing the metal soap application operation is determined by calculating the threshold value for the charging current value by using this information by the aforementioned method, and then comparing the threshold value with the value of the charging current flowing in the charging roller 2.

2. Control Procedure for Metal Soap Application Operation

Figure 16:
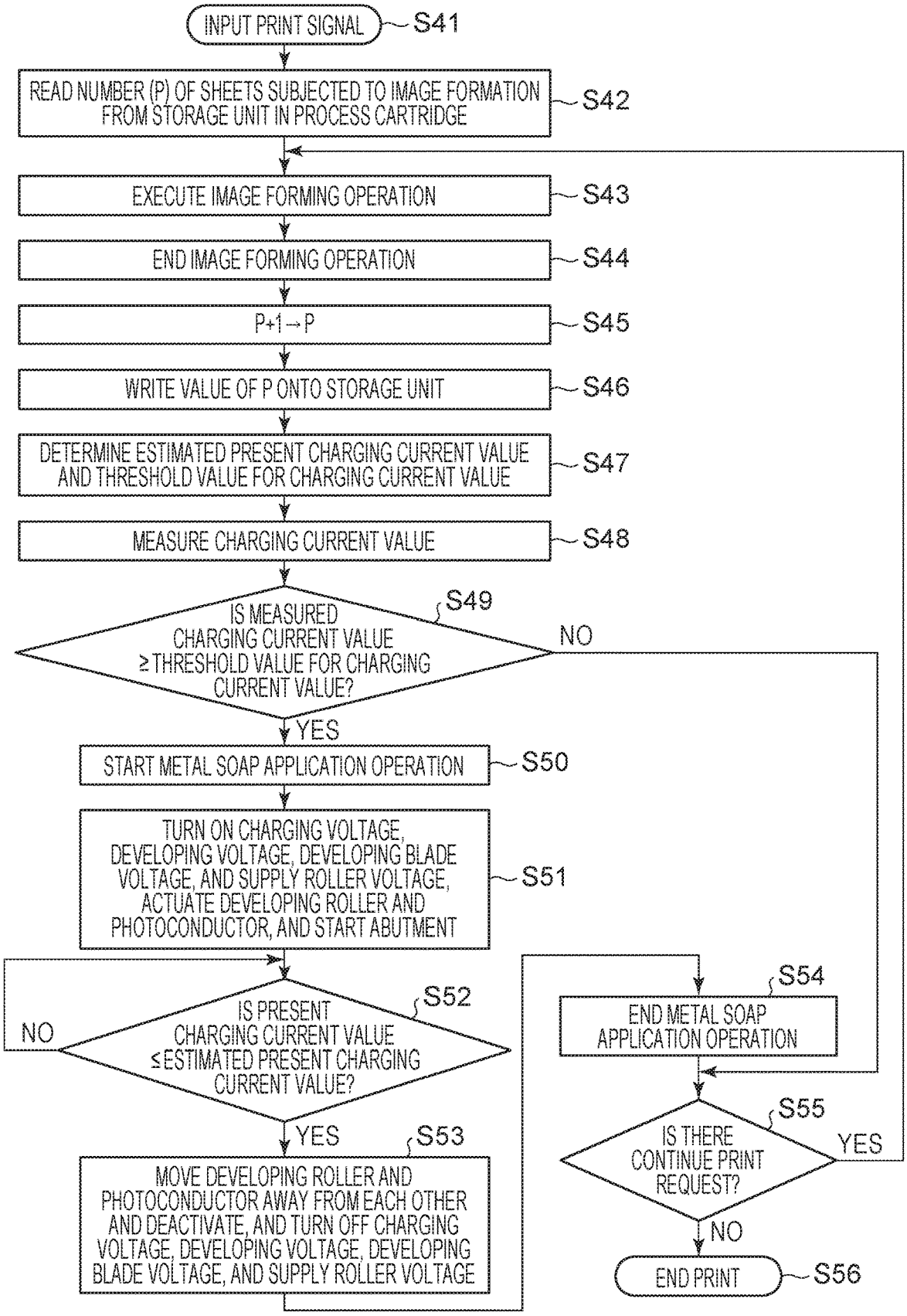
FIG. 16 is a flowchart illustrating a metal soap application operation in Example 6.

Next, referring to the flowchart in FIG. 16, the control procedure for the metal soap application operation for suppressing image smearing in Example 6 is described. In Example 6, the control unit 202 executes the metal soap application operation.

The process cartridge 7 is equipped with the memory 15, and the memory 15 stores the number (P) of sheets subjected to image formation. When a print signal is input (S41), the CPU 155 in the image forming apparatus main body 100 communicates with the memory 15, reads the number (P) of sheets subjected to image formation (S42), and executes the image forming operation (S43). Upon completion of the image forming operation (S44), the count of the number of sheets subjected to image formation is increased by 1 (S45), and the count of the number of sheets subjected to image formation in the memory 15 in the process cartridge 7 is rewritten (S46).

Next, the estimated charging current value corresponding to the number of sheets subjected to image formation, the threshold value for the charging current value, and the number (P) of sheets subjected to image formation read into the CPU 155 are compared, and the estimated present charging current value and the threshold value and the threshold value for the charging current value are determined (S47).

The charging current is detected and the present charging current value at the desired charging voltage is measured (S48); and then the measured charging current value and the determined threshold value for the charging current value are compared to determine whether this is the timing of executing the metal soap application operation (S49).

If the measured charging current value exceeds the determined threshold value, it is the timing of executing the metal soap application operation, and thus the metal soap application operation is started (S50).

First, a charging voltage, a developing voltage, a developing blade voltage, and a supplying voltage are applied while the developing roller 4 and the photoconductor 1 are actuated and the developing roller 4 is caused to abut against the photoconductor 1 (S51).

Next, while detecting the charging current, execution of the metal soap application operation is continued until the estimated present charging current value is reached (S52).

When the estimated present charging current value is reached, the developing roller 4 is moved away from the photoconductor 1, the developing roller 4 and the photoconductor 1 are deactivated, the voltages applied are turned OFF (S53), and the metal soap application operation is ended (S54).

After the metal soap application operation is ended, whether there is a continue print request is determined (S55), and if there is a request, the operations from S43 to S55 are repeated until there is no longer a continue print request. If there is no request, the process moves to an end print operation (S56).

According to the structure of Example 6, the metal soap application operation can be executed at an appropriate timing even when the dark potential (Vd) has increased due to the decrease in thickness of the photoconductor 1. As a result, the surface of the photoconductor 1 can stably retain the metal soap 45*c* irrespective of the thickness, and a long lifetime structure can be obtained in which image smearing is suppressed by a simple structure while maintaining the endurance of the photoconductor 1.

Figure 17:
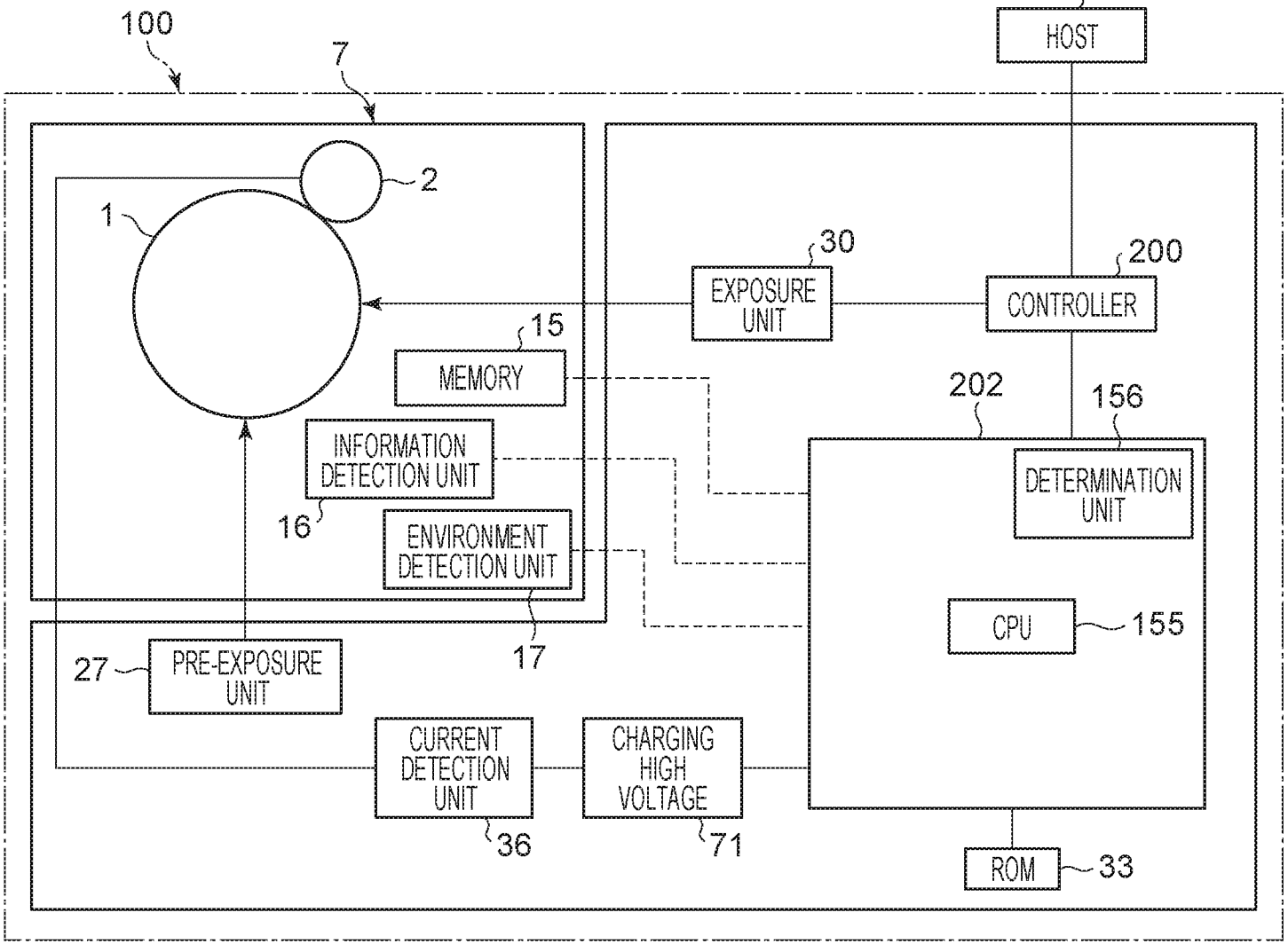
FIG. 17 is a block diagram illustrating a control mode of a current detection unit in Example 7.

In Examples 5 and 6, the charging voltage remained constant from the initial stage to the final stage of the image forming. The feature of Example 7 is that the charging voltage is changed depending on the use of the image forming apparatus 100 and the environment of use so that the dark potential (Vd) is substantially constant throughout. As illustrated in FIG. 17, the image forming apparatus 100 of Example 7 is further equipped with an environment detection unit 17. The environment detection unit 17 detects one or both of the temperature and the relative humidity. When both are to be detected, the absolute humidity may be calculated from the detection results.

Although the structure in which the environment detection unit 17 is formed in the cartridge 7 is employed in Example 7, the environment detection unit 17 may be formed in the main body of the image forming apparatus 100.

1. Timing of Metal Soap Application Operation

The metal soap application operation timing of this example will now be described.

In Example 7, the threshold value for the charging current value is set by using the information regarding the thickness of the photoconductor 1, the information regarding the use environment; and the information regarding the charging voltage, in other words, the chargeability and the environment, and the metal soap application operation timing is determined by comparing the threshold value with the value of the charging current flowing in the charging roller 2. The information regarding the chargeability of the charging roller 2 is calculated by using the information regarding the thickness of the photoconductor 1 and the charging voltage.

Figure 18:
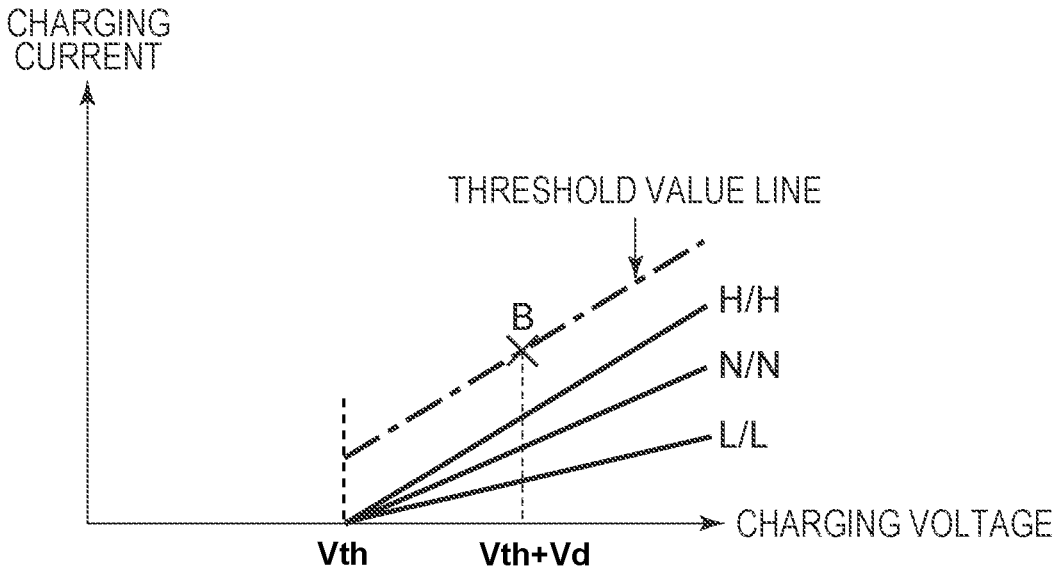
FIG. 18 is a graph illustrating the relationship between the charging voltage and the charging current in different environments in Example 7.

FIG. 18 is a graph showing the relationship between the charging voltage and the charging current when the apparatus is new in a 30° C./80% RH (H/H) environment, a 23° C./50% RH environment (N/N), and a 15° C./10% RH environment (L/L). The graph shows that the charging current increases linearly as the charging voltage increases. The graph also shows that at an equal charging voltage, the charging current increases in a high-temperature, high-humidity environment. The point B is a threshold value for the charging current value in a 30° C./80% RH environment. When the charging voltage is changed, the threshold value for the charging current value can be set by drawing a straight line passing the point B and being parallel to the aforementioned line. In other words, the threshold value is set higher as the charging voltage increases. The relationship between the thickness of the photoconductor 1 and the charging current is as described in Example 6.

Next, on the basis of these pieces of measured data (the relationship between the thickness of the photoconductor 1 and the charging current, the relationship between the use environment and the charging current, and the relationship between the charging voltage and the charging current), a calculation formula for calculating the estimated present charge current value and the threshold value for the charging current value is determined. This data is stored in the ROM 33 of the image forming apparatus 100 in advance. The estimated present charging current value and the threshold value for the charging current value can be calculated by employing the data on the approximation formula stored in the ROM 33, the data corresponding to the information regarding the thickness of the photoconductor 1, the information regarding the use environment, and the information regarding the charging voltage stored in the memory 15. The method for obtaining the approximation formula is not particularly limited, and examples thereof include various statistical techniques such as linear approximation, exponential approximation, polynomial approximation, cumulative approximation, and moving average approximation. An optimum approximation method can be employed as appropriate.

The information regarding the use environment is calculated by the following method. An environment sensor is provided as the environment detection unit 17 in the image forming apparatus 100, detects the temperature T and the relative humidity H every predetermined time, and rewrites the information regarding the use environment on the memory 15.

In Example 7, the memory 15 loaded onto the process cartridge 7 stores: as the information regarding the thickness of the photoconductor 1, the number (P) of sheets subjected to image formation; as the information regarding the use environment, the temperature T and the relative humidity H; and, as the information regarding the charging voltage, the charging voltage set value. Then, the metal soap application operation timing is determined by calculating the threshold value for the charging current value by the aforementioned method by using these three sets of information, and then comparing the threshold value with the value of the charging current flowing in the charging roller 2.

2. Control Procedure for Metal Soap Application Operation

Figure 19:
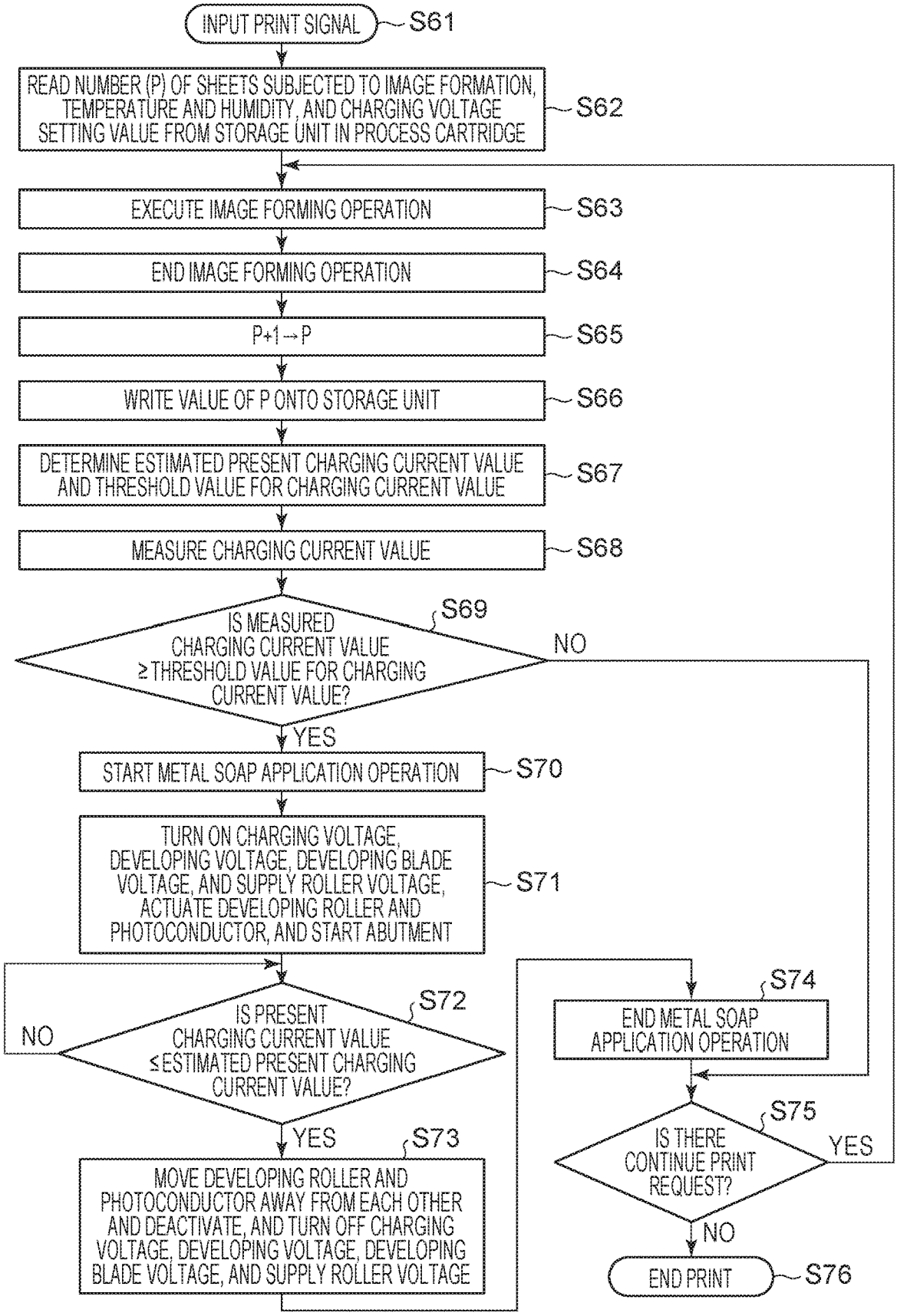
FIG. 19 is a flowchart illustrating a metal soap application operation in Example 7.

Next, referring to the flowchart in FIG. 19, the control procedure for the metal soap application operation for suppressing image smearing is described. In Example 7, the control unit 202 executes the metal soap application operation.

The process cartridge 7 is equipped with the memory 15, and the memory 15 stores the number (P) of sheets subjected to image formation, the temperature T and the humidity H, and the charging voltage set value. When a print signal is input (S61), the CPU 155 in the image forming apparatus main body 100 communicates with the memory 15, reads the number (P) of sheets subjected to image formation, the temperature T and the relative humidity H, and the charging voltage set value (S62), and executes the image forming operation (S63). Upon completion of the image forming operation (S64), the count of the number of sheets subjected to image formation is increased by 1 (S65), and the count of the number of sheets subjected to image formation in the memory 15 in the process cartridge 7 is rewritten (S66).

Next, the contents in the image forming apparatus 100-side ROM 33 that stores the estimated charging current value and the threshold value for the charging current value in advance are compared with the number (P) of sheets subjected to image formation, the temperature T and the relative humidity H, and the charging voltage set value to determine the charging current value and the threshold value for the charging current value (S67).

The charging current is detected, and the present charging current value at the desired charging voltage is measured (S68); and then the measured charging current value and the determined threshold value for the charging current value are compared to determine whether this is the timing of executing the metal soap application operation (S69).

If the measured charging current value exceeds the determined threshold value, it is the timing of executing the metal soap application operation, and thus the metal soap application operation is started (S70).

First, a charging voltage, a developing voltage, a developing blade voltage, and a supplying voltage are applied while the developing roller 4 and the photoconductor 1 are actuated and the developing roller 4 is caused to abut against the photoconductor 1 (S71).

Next, while detecting the charging current, execution of the metal soap application operation is continued until the estimated present charging current value is reached (S72).

When the estimated present charging current value is reached, the developing roller 4 is moved away from the photoconductor 1, the developing roller 4 and the photoconductor 1 are deactivated, the voltages applied are turned OFF (S73), and the metal soap application operation is ended (S74).

Next, whether there is a continue print request is determined (S75), and the operations from S63 to S75 are repeated until there is no longer a continue print request. If there is no request, the process moves to a print end operation (S76).

According to the structure of Example 7, the metal soap application operation can be executed at an appropriate timing even when the charging voltage is changed depending on the use history or use environment of the image forming apparatus so that the dark potential (Vd) is substantially constant throughout. As a result, the surface of the photoconductor 1 can stably retain the metal soap 45*c*, and a long lifetime structure can be obtained in which image smearing is suppressed by a simple structure while maintaining the endurance of the photoconductor 1.

Although the image forming operation was conducted in a 30° C./80% RH (H/H) environment in Example 7, the threshold value for the charging current value can be appropriately set by performing the aforementioned control process and the metal soap application operation can be executed at an appropriate timing even when the environment is changed.

Residual charges may be generated in the photosensitive layers in the photoconductor 1 and the light potential VL may fluctuate during image formation as a result of performing the exposing step during the image forming operation. Thus, the feature of Example 8 is that the charging current detection is performed while suppressing the increase in VL (referred to as VL up) caused by the residual charges.

1. Undercoat Layer of Photoconductor

The photoconductor i of Example 8 and the photoconductor j of Comparative Example 8 differ from the photoconductor h used in Examples 5 to 8 in the undercoat layer. The undercoat layers of the photoconductor i and the photoconductor j were prepared by the following method.

First, a method for preparing the undercoat layer of the photoconductor i of Example 8 is described. Toluene (500 parts) and 100 parts of rutile-form titanium oxide particles (average primary particle diameter: 50 nm produced by TAYCA CORPORATION) were mixed and stirred, and 5.0 parts of vinyltrimethoxysilane (trade name: KBM-1003 produced by Shin-Etsu Chemical Co., Ltd.) was added to the resulting mixture, followed by stirring for 8 hours. Subsequently, toluene was distilled away by reduced pressure distillation and dried for 3 hours at 120° C. to obtain rutile-form titanium oxide particles surface-treated with vinyltrimethoxysilane. To a mixed solvent containing 90 parts of methanol and 60 parts of 1-butanol, 18 parts of the rutile-form titanium oxide particles surface-treated with vinyltrimethoxysilane, 4.5 parts of N-methoxymethylated nylon (trade name: TORESIN EF-30T produced by Nagase ChemteX Corporation), and 1.5 parts of a copolymerized nylon resin (trade name: Amilan CM8000 produced by Toray Industries, Ltd.) were added to prepare a dispersion liquid. This dispersion liquid was dispersed in a vertical sand mill with glass beads having a diameter of 1.0 mm for 5 hours to prepare an undercoat layer-forming coating solution. This undercoat layer-forming coating solution was applied to the support member by dip coating, and the obtained coating film was dried for 10 minutes at 100° C. to form an undercoat layer having a thickness of 2.0 μm.

Next, a method for preparing the undercoat layer of the photoconductor j of Comparative Example 8 is described. In a methanol 450 parts/n-butanol 150 parts mixed solvent, 40 parts of a copolymerized nylon resin (trade name: Amilan CM4000 produced by Toray Industries, Ltd.) was dissolved to prepare an undercoat layer-forming coating solution. This undercoat layer-forming coating solution was applied to the conductive layer by dip coating, and the obtained coating film was dried to form an undercoat layer having a thickness of 0.8 μm.

2. VL-up

Figure 20A:
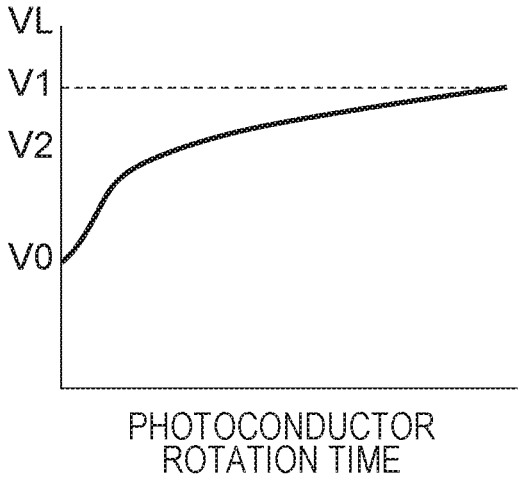
FIG. 20A is graph showing the VL-up amount in an L/L environment in Example 8 and FIG. 20B is graph showing the VL-up amount in an H/H environment in Example 8.
Figure 20B:
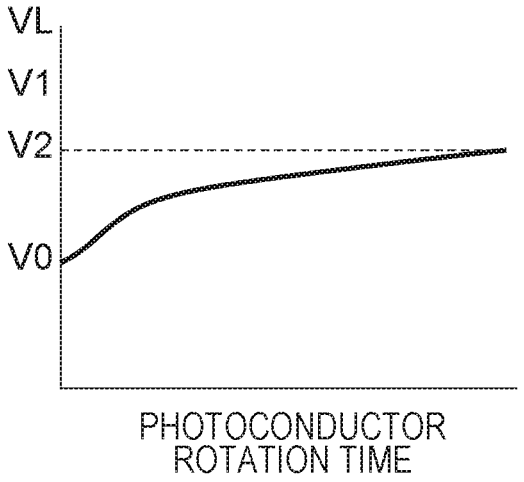

Next, a phenomenon caused by VL-up is described. FIG. 20A is a graph indicating the VL-up amount when images were continuously formed in a 15° C./10% RH environment (L/L), and FIG. 20B is a graph indicating the VL-up amount when images were continuously formed in a 30° C./80% RH environment (H/H). As illustrated in FIGS. 20A and 20B, the VL-up occurs in association with the image forming. As illustrated in FIG. 20A, the rate of increase in VL per unit time is confirmed to increase as the absolute humidity in the environment decreases, and VL increases from V0 up to V1. Meanwhile, as illustrated in FIG. 20B, in an environment with a high absolute humidity, the rate of increase in VL is small, and the VL does not increase as much and increases from V0 only up to V2 having an absolute value smaller than V1. It is considered that the VL-up is mainly caused by the increase in the number of residual charges inside the photosensitive layers caused by exposure of the photoconductor 1 during image forming. In other words, in an environment with a low absolute humidity, one of the photosensitive layers exhibited an increased resistance, which inhibited smooth migration and injection of charges and resulted in the VL-up. Thus, in an environment with a low absolute humidity, the residual charges build up in the layer having a high resistance as the image formation is conducted, and thus the VL-up occurs.

When the VL-up occurs, the development contrast Vcont, which is the difference between the developing voltage Vdc and VL, fluctuates by performing the step of exposing the photoconductor 1 during the image forming. This changes the toner bearing amount on the photoconductor 1 and causes image density fluctuations on the recording material S.

Thus, it is considered that the magnitude of the VL-up changes due to the resistance and formulation of the undercoat layer also. Moreover, it is assumed that, when the undercoat layer is exposed with light during image forming, the resistance of the undercoat layer gradually increases, smooth migration of charges is inhibited, and thus the VL-up becomes prominent. Thus, the influence of the VL-up was studied by changing the magnitude of the VL-up by changing the resistance and/or formulation of the undercoat layer. The VL-up amount that occurred when images were formed on 100,000 sheets was compared by using the photoconductor h used in Examples 5 to 7, the photoconductor i used in Example 8, and the photoconductor j used in Comparative Example 8. The results showed that, whereas substantially zero VL-up was observed from the photoconductor h and the photoconductor i, a VL-up of 50 V was observed from the photoconductor j.

3. Studying the Effect

The results obtained from studying the effect of the metal soap application operation in the charging current detection in Example 8 are described below. In order to study occurrence of image smearing in Example 5, Example 8, and Comparative Example 8, 10,000 sheets were continuously passed in one day at a printing ratio of 1%, the photoconductor was left to stand in the apparatus for one day, and whether there was image smearing after being left to stand was compared. The reason for leaving the photoconductor to stand for one day is that the corona products generated on the surface of the photoconductor 1 sufficiently absorb moisture by being left to stand for one day, and thus the effect of reducing the surface resistance of the photoconductor 1 becomes prominent. A sample for determining whether image smearing occurred was obtained by printing a halftone image on one sheet and used for evaluation. The evaluation standard is as follows.

○: No image smearing occurred. There were no blank areas or blurring of contours in the image boundary portion that occurred by latent image blurring in all parts of the image.

x: Image smearing occurred. Blank areas and blurring of contours in the image boundary portion resulting from latent image blurring occurred in some or all parts of the image.

The sheets were passed and the sample was output in an environment of 30° C./80% RH. The total number of sheets that were passed was up to 120,000. The results are indicated in Table 11.

TABLE 11

| | Number of sheets passed (× 1000 sheets) | | | | | |
|---|---|---|---|---|---|---|
| | 20 | 40 | 60 | 80 | 100 | 120 |
| Example 5 | ○ | ○ | ○ | ○ | ○ | ○ |
| Example 8 | ○ | ○ | ○ | ○ | ○ | ○ |
| Comparative Example 8 | ○ | ○ | ○ | ○ | x | x |

As shown in Table 11, image smearing did not occur even after 120,000 sheets of printing in Examples 5 and 8 in which the VL-up did not occur. In contrast, in Comparative Example 8, image smearing is satisfactorily suppressed up to 80,000 sheets, but image smearing occurs after the 100,000 sheets. Up to the intermediate stage of endurance, the toner level was high, and the metal soap 45*c* was sufficiently supplied, thus satisfactorily suppressing image smearing. However, it is considered that, as image forming was repeated, the toner level decreased, the metal soap 45*c* that could be supplied depleted, and thus the image smearing occurred. In Comparative Example 8, the undercoat layer was different compared to Example 5 and Example 8, and the carrier transporting capability degraded due to deterioration as the image forming was repeated. Eventually, negative charges accumulated in the undercoat layer and the light potential VL rose. The rise in light potential VL decreased the charging current value and kept the charging current value below the threshold value for the charging current; thus, the metal soap application operation was not executed, and image smearing occurred.

According to the structure of Example 8, the metal soap application operation can be executed at an appropriate timing by using the photoconductor 1 that does not undergo an increase in light potential VL despite repeated image formation. As a result, a structure with which the surface of the photoconductor 1 could stably retain the metal soap 45*c* was obtained, and, by suppressing the changes in VL, it was possible to suppress image smearing by a simple structure while maintaining the endurance of the photoconductor in a long lifetime structure also.

In Example 8, the value of VL changes when the surface of the photoconductor 1 is scraped. Thus, the feature described in Example 6 may be employed here to conduct control.

In Example 9, the case in which the light potential (VL) rises by repeated image formation as in Example 8 is described. The difference from Example 8 is that, whereas an undercoat layer that does not easily undergo VL-up was used in Example 8, the photoconductor j that undergoes the VL-up of Comparative Example 8 was used in Example 9. The feature of Example 9 is that the charging current detection is performed while taking into account the VL-up that would occur by the influence of the residual charges.

1. Timing of metal soap application operation

First, the metal soap application operation timing in Example 9 is described. In Example 9, the threshold value for the charging current value is set by using the information regarding image exposure and pre-exposure, and the metal soap application operation timing is determined by comparing the threshold value with the value of the charging current flowing in the charging roller 2.

Figure 21:
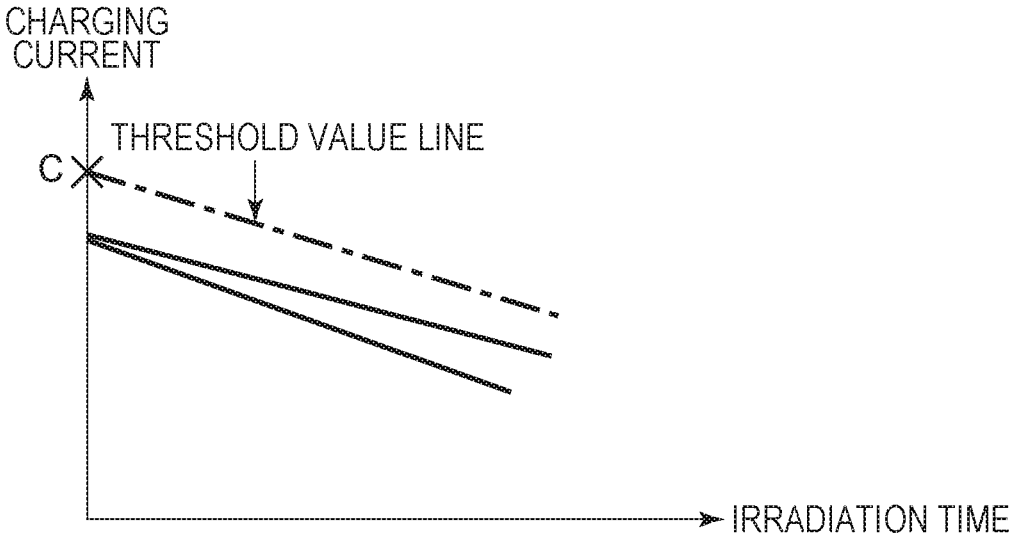
FIG. 21 is a graph showing the relationship between the length of time the photoconductor is irradiated with light and the charging current in Example 9.

FIG. 21 is a graph showing the relationship between the charging current and the irradiation time for the image exposure and the pre-exposure in a 30° C./80% RH environment. The graph shows that the charging current linearly decreases with the increase in the irradiation time for image exposure and pre-exposure. The reason for this is described below. As the image formation is repeated, negative charges accumulate in the undercoat layer. Thus, repeated image formation increased the light potential VL and decreased the charging current. The point C is the initial threshold value for the charging current value in a 30° C./80% RH environment. The threshold value for the charging current value can be set according to the irradiation time for image exposure and pre-exposure by drawing a straight line passing through the point C parallel to the aforementioned line.

On the basis of this measured data (relationship between the charging current and the irradiation time for image exposure and pre-exposure), a calculation formula for calculating the estimated present charging current value and the threshold value for the charging current value was obtained, and the resulting data is stored in advance in the ROM 33 in the image forming apparatus 100. The estimated present charging current value and the threshold value for the charging current value can be calculated by employing the data on the approximation formula stored in the ROM 33 and corresponding to the information regarding image exposure and pre-exposure stored in the memory 15.

In Example 9, the irradiation time is stored as the information regarding image exposure and pre-exposure in the memory 15 loaded onto the process cartridge 7. Then, the metal soap application operation timing is determined by calculating the threshold value for the charging current value by the aforementioned method by using this information, and then comparing the threshold value with the value of the charging current flowing in the charging roller 2.

2. Control Procedure for Metal Soap Application Operation

Figure 22:
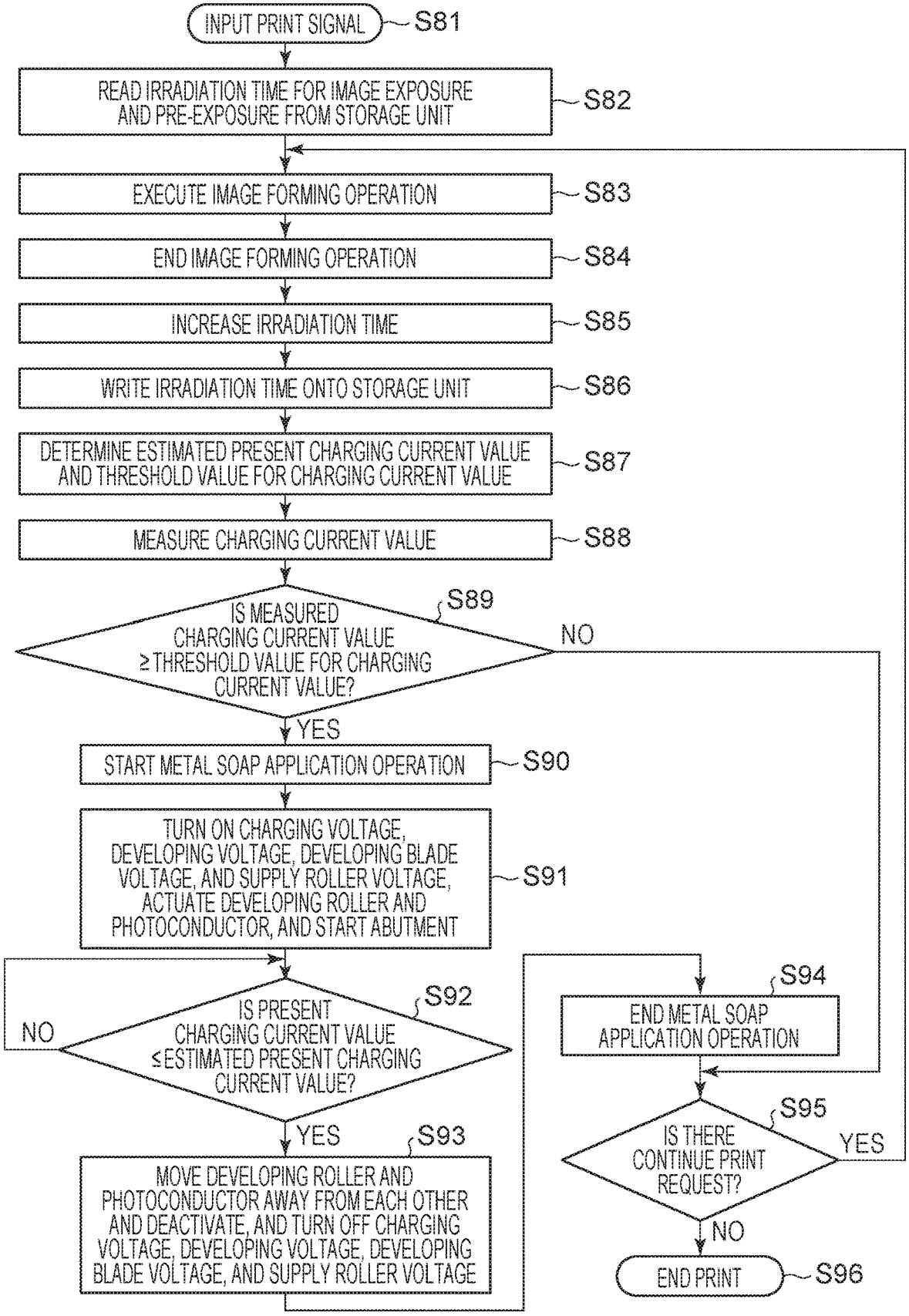
FIG. 22 is a flowchart illustrating a metal soap application operation in Example 9.

Next, referring to the flowchart in FIG. 22, the control procedure for the metal soap application operation for suppressing image smearing is described. In Example 9, the control unit 202 executes the metal soap application operation.

The process cartridge 7 is equipped with the memory 15, and the memory 15 stores the irradiation time for image exposure and pre-exposure. When a print signal is input (S81), the CPU 155 in the image forming apparatus 100 communicates with the memory 15, reads the irradiation time for image exposure and pre-exposure (S82), and executes the image forming operation (S83). Upon completion of the image forming operation (S84), the irradiation time for image exposure and pre-exposure is accumulated (S85), and the irradiation time for image exposure and pre-exposure is rewritten onto the memory 15 in the process cartridge 7 (S86).

Next, the charging current value corresponding to the irradiation time for image exposure and pre-exposure and the threshold value for the charging current value are compared with the irradiation time for image exposure and pre-exposure read into the CPU 155 as described above, and the estimated present charging current value and the threshold value for the charging current value are determined (S87).

The charging current is detected, and the present charging current value at the desired charging voltage is measured (S88); and then the measured charging current value and the determined threshold value for the charging current value are compared to determine whether this is the timing of executing the metal soap application operation (S89).

If the measured charging current value exceeds the determined threshold value, it is the timing of executing the metal soap application operation, and thus the metal soap application operation is started (S90).

First, a charging voltage, a developing voltage, a developing blade voltage, and a supplying voltage are applied while the developing roller 4 and the photoconductor 1 are actuated and the developing roller 4 is caused to abut against the photoconductor 1 (S91).

Next, while detecting the charging current, execution of the metal soap application operation is continued until the estimated present charging current value is reached (S92).

When the estimated present charging current value is reached, the developing roller 4 is moved away from the photoconductor 1, the developing roller 4 and the photoconductor 1 are deactivated, the voltages applied are turned OFF (S93), and the metal soap application operation is ended (S94).

After the metal soap application operation is ended, whether there is a continue print request is determined (S95), and the operations from S83 to S95 are repeated until there is no longer a continue print request. If there is no request, the process moves to an end print operation (S96).

3. Studying the Effect

The results obtained from studying the actual effect are described below. In order to study occurrence of image smearing in Example 9 and Comparative Example 8, 10,000 sheets were continuously passed in one day at a printing ratio of 1%, the photoconductor was left to stand in the apparatus for one day, and whether there was image smearing after being left to stand was compared. The reason for leaving the photoconductor to stand for one day is that the corona products generated on the surface of the photoconductor 1 sufficiently absorb moisture by being left to stand for one day, and thus the effect of reducing the surface resistance of the photoconductor 1 becomes prominent. A sample for determining whether image smearing occurred was obtained by printing a halftone image on one sheet and used for evaluation. The evaluation standard is as follows.
○: No image smearing occurred. There were no blank areas or blurring of contours in the image boundary portion that occurred by latent image blurring in all parts of the image.
x: Image smearing occurred. Blank areas and blurring of contours in the image boundary portion resulting from latent image blurring occurred in some or all parts of the image.

The sheets were passed and the sample was output in an environment of 30° C./80% RH. The total number of sheets that were passed was up to 120,000. The results are indicated in Table 12.

TABLE 12

| | Number of sheets passed (x 1000 sheets) | | | | | |
|---|---|---|---|---|---|---|
| | 20 | 40 | 60 | 80 | 100 | 120 |
| Example 9 | ○ | ○ | ○ | ○ | ○ | ○ |
| Comparative Example 8 | ○ | ○ | ○ | ○ | x | x |

As shown in Table 12, image smearing did not occur even after 120,000 sheets of printing in Example 9. In contrast, in Comparative Example 8, image smearing is satisfactorily suppressed up to 80,000 sheets, but image smearing occurs after the 100,000 sheets. In both Example 9 and Comparative Example 8, the toner level was high up to the intermediate stage of endurance, and image smearing was satisfactorily suppressed due to sufficient supply of the metal soap 45*c*. In Example 9 and Comparative Example 8, an undercoat layer of the same formulation is used. In both cases, the VL-up occurred as the image forming was repeated.

However, in Comparative Example 8, presumably, the toner amount decreased by repeating the image formation, the metal soap 45*c* that could be supplied depleted, and thus the image smearing occurred. The cause for this is presumably that as the image formation is repeated, the carrier transporting capability degraded due to deterioration, negative charges accumulated in the undercoat layer, and the influence of the increase in light potential VL was not considered. In Comparative Example 3, the conditions for executing the metal soap application operation were set without considering the influence of the decrease in charging current value resulting from the increase in light potential VL; thus, after the VL-up, the threshold value for the charging current value was not exceeded, and the metal soap application operation was not executed. Thus, the VL-up occurred, and image smearing occurred after about 100,000 sheets at which the toner amount was low.

Meanwhile, according to the structure of Example 9, metal soap application operation can be executed at an appropriate timing even when the light potential VL increased due to the repeated image formation. In Example 9, the irradiation time is stored as the information regarding image exposure and pre-exposure in the memory 15 loaded onto the process cartridge 7. Then, the metal soap application operation timing is determined by calculating the threshold value for the charging current value by using this information, and then comparing the threshold value with the value of the charging current flowing in the charging roller 2. As a result, even when a photoconductor 1 that undergoes VL-up is used, the metal soap 45*c* can be stably maintained on the surface of the photoconductor 1. Thus, it has become possible to suppress occurrence of image smearing by using a lower-cost structure while maintaining the endurance of the photoconductor 1.

In Example 9, the irradiation time was stored as the information regarding image exposure and pre-exposure; alternatively, the information regarding image exposure and pre-exposure may be calculated by using at least one selected from the irradiation time and irradiation intensity for image exposure and the irradiation time and irradiation intensity for pre-exposure.

Example 10 features that a protective layer is formed on the surface of the photoconductor 1 so that, even in a long lifetime structure, image smearing is suppressed by a simple structure while maintaining the endurance of the photoconductor 1.

1. Protective Layer of Photoconductor

The photoconductor 1 may have a protective layer on the photosensitive layer. When the photoconductor 1 has a protective layer, the protective layer is the surface layer. The photoconductor 1 of Example 10 has a wear-resistant protective layer as the uppermost surface layer in order to improve the wear resistance. The protective layer improves endurance. The protective layer serving as the surface layer has a universal hardness value (HU) of 210 or more and 250 or less ($N/mm^2$) and an elastic deformation ratio (We) of 37% or more and 52% or less.

The protective layer may contain a resin and a conductive particles and/or a charge transport material. Examples of the conductive particles include particles of metal oxides such as titanium oxide, zinc oxide, tin oxide, and indium oxide. Examples of the charge transport material include polycyclic aromatic compounds, heterocyclic compounds, hydrazone compounds, styryl compounds, enamine compounds, benzidine compounds, triarylamine compounds, and resins having groups derived from these substances. Among these, triarylamine compounds and benzidine compounds are preferable.

Examples of the resin include polyester resins, acrylic resins, phenoxy resins, polycarbonate resins, polystyrene resins, phenol resins, melamine resins, and epoxy resins. Among these, polycarbonate resins, polyester resins, and acrylic resins are preferable.

The protective layer may be formed as a cured film obtained by polymerizing a composition that contains a monomer having a polymerizable functional group. Examples of the reaction for this process include a thermal polymerization reaction, a photopolymerization reaction, and a radiation polymerization reaction. Examples of the polymerizable functional group in the monomer having a polymerizable functional group include an acryl group and a methacryl group. A material having a charge transport property may be used as a monomer having a polymerizable functional group.

The protective layer may contain additives such as an antioxidant, a UV absorber, a plasticizer, a leveling agent, a lubrication imparter, a wear resistance improver, and the like. Specific examples thereof include hindered phenol compounds, hindered amine compounds, sulfur compounds, phosphorus compounds, benzophenone compounds, siloxane-modified resins, silicone oil, fluororesin particles, polystyrene resin particles, polyethylene resin particles, silica particles, alumina particles, and boron nitride particles. The protective layer preferably has an average thickness of 0.5 μm or more and 10 μm or less and more preferably has an average thickness of 1 μm or more and 7 μm or less.

The protective layer can be formed by preparing a protective layer-forming coating solution containing the aforementioned materials and a solvent, forming a coating film of this coating solution, and drying and/or curing the coating film. Examples of the solvent used in the coating solution include alcohol solvents, ketone solvents, ether solvents, sulfoxide solvents, ester solvents, and aromatic hydrocarbon solvents. In Example 10, the average thickness of the protective layer is set to 3 μm.

In Example 10, the following materials were prepared.

Compound represented by formula (A-12) below: 10 parts

Compound represented by formula (A-25) below: 10 parts

1-Propanol: 50 parts 1,1,2,2,3,3,4-heptafluorocyclopentane (trade name: ZEORORAH, produced by ZEON CORPORATION): 25 parts These materials were mixed and stirred. The resulting mixture was filtered through a polyflon filter (trade name: PF-020 produced by Advantec Toyo Kaisha, Ltd.) to prepare a protective layer-forming coating solution.

(A-12)

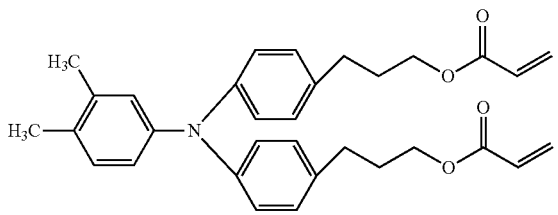

(A-25)

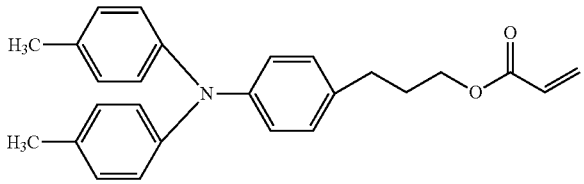

This protective layer-forming coating solution was applied to the charge transport layer by dip coating to form a coating film, and the coating film was dried for 6 minutes at 50° C. Subsequently, in a nitrogen atmosphere, while the support member (irradiation target) was rotated at a speed of 200 rpm, the coating film was irradiated with an electron beam for 1.6 seconds at an acceleration voltage of 70 kV and a beam current of 5.0 mA. The absorbed amount of the electron beam was measured during this process and was found to be 15 kGy. Subsequently, in a nitrogen atmosphere, the coating film was heated by increasing the temperature of the coating film from 25° C. to 117° C. in 30 seconds. The oxygen concentration from irradiation with the electron beam to the subsequent heating treatment was 15 ppm or less. Next, in air, the coating film was naturally cooled to 25° C., and then heat-treated for 30 minutes under conditions such that the temperature of the coating film was increased to 105° C. so as to form a protective layer having a thickness of 3 μm. Thus, a cylindrical (drum-shaped) photoconductor k that had a support member, an undercoat layer, a charge generation layer, a charge transport layer, and a protective layer in this order was prepared.

According to the structure of Example 10, the photoconductor k which is the photoconductor 1 that includes a protective layer was used, and thus the surface of the photoconductor 1 is scraped less due to wear. In other words, the surface potential formed on the photoconductor 1 becomes stable. The metal soap 45*c* can be more stably maintained on the surface of the photoconductor 1 by using the photoconductor 1 of Example 10. Thus, it has become possible to suppress occurrence of image smearing in a longer lifetime structure while maintaining the endurance of the photoconductor 1.

Alternatively, a structure that combines the structure of Example 9 with the structure of Example 3 in which the surface of the photoconductor 1 is subjected to a roughening treatment may be employed. Alternatively, the structure of any one of Examples 5 to 10 and the toner used in Example 4 may be combined.

The features of the structure of Example 11 are described below. The structures common to those of Examples 1 to 10 are omitted from the description.

1. Control Mode of Image Forming Apparatus

Figure 23:
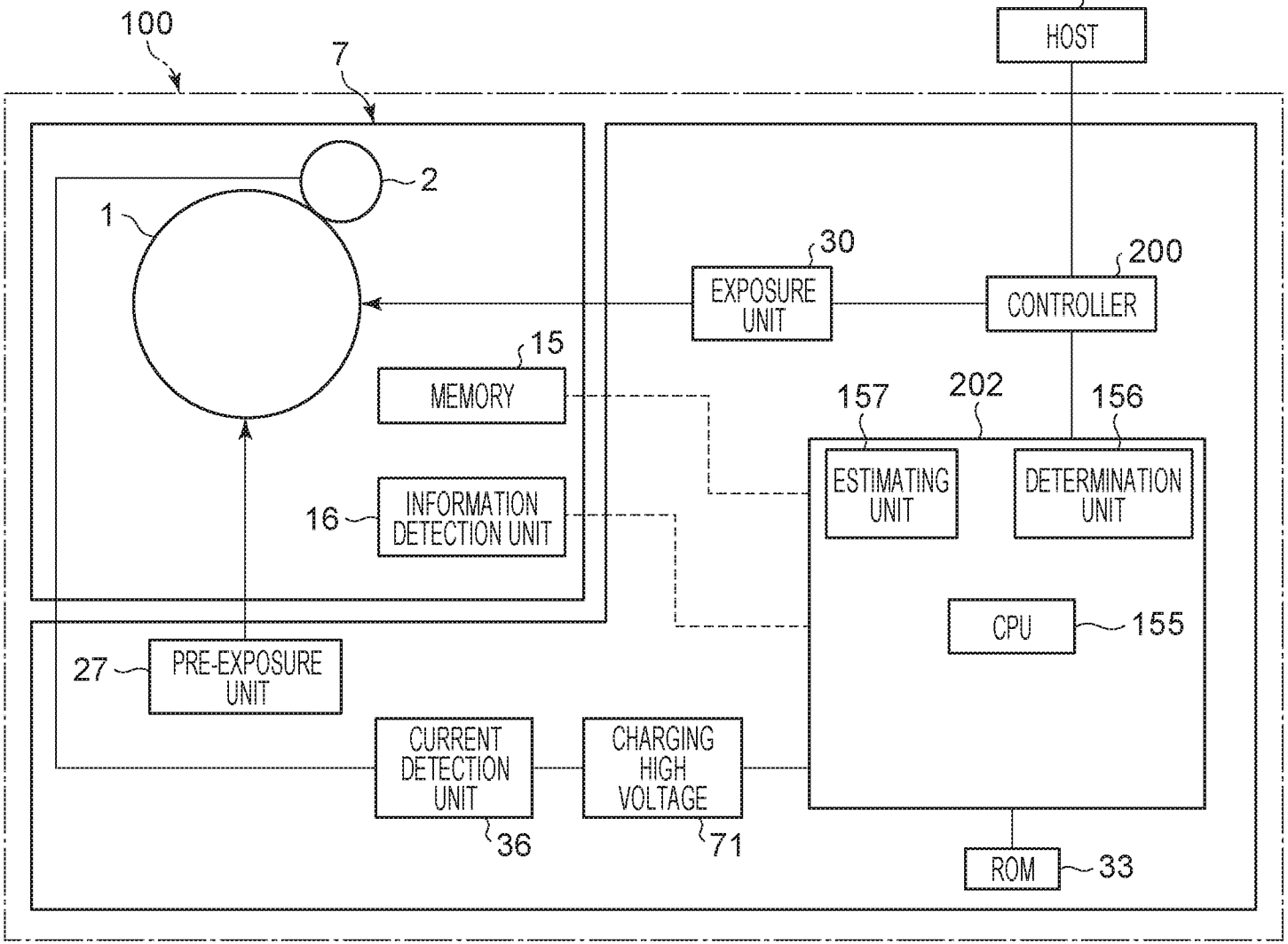
FIG. 23 is a block diagram illustrating a control mode of a current detection unit in Example 11.

FIG. 23 is a diagram illustrating a mode related to the control of a current detection unit 36 that serves as a charging current detecting unit, which is the feature of Example 11. The control unit 202 includes a CPU 155, which is a central device for performing various calculation processes, and is connected to storage elements such as a RAM and a ROM 33, a memory 15 serving as a storage unit, an environment sensor 16 serving as an environment detection unit that detects the environment, etc. Furthermore, the control unit 202 further includes a determination unit 156 that determines whether or not the metal soap application operation described below is executable, and an estimating unit 157 that estimates the charging current value. In the structure of Example 11, the estimating unit 157 is optional. In Example 11, the control unit 202 controls the aforementioned high voltages and the like to perform a metal soap application operation described in detail below.

2. Influence of Corona Products on Photoconductor

When image smearing is occurring, not only a discharge current for forming potential is generated by the charging roller 2, but also the current is directly injected into the corona products generated on the surface of the photoconductor 1 from the charging roller 2. Thus, there flows a current larger than the normal charging current which consists of the discharge current only. The increase in the charging current starts when corona products start to adhere, and it is possible to detect this phenomenon before occurrence of image smearing by detecting the injection current. Example 11 takes advantage of this phenomenon.

3. Metal Soap Application Operation

In Example 11, whether or not the metal soap application operation can be executed is determined by the determination unit 156 according to the value of the charging current that flows under charging voltage application. In one example, the process is controlled so that the metal soap application operation is executed when the predetermined threshold value for the charging current value is exceeded.

4. Relationship Between Charging Current Amount and Image Smearing

In Example 11, the charging current value detected by the current detection unit 36 that detects the charging current flowing in the charging roller 2 is assumed to be the adherence amount of the corona products. Then, the metal soap application operation timing is determined on the basis of a calculated value obtained by adding only a positive value of the difference value (Δ) between the predetermined corona product adherence prevention amount and the absolute value of the charging current detected real time. The reason for adding only the positive value is that when the value is negative, occurrence of the corona products is below the threshold value for image smearing, and thus there is no need to conduct addition.

In order to detect the charging current flowing in the charging roller 2, in Example 11, the charging current detection unit 36 is provided as illustrated in FIG. 23. The charging current detection unit 36 that has received a signal from the CPU 155 detects the charging current value while applying a DC voltage to the charging roller 2.

Next, the corona product adherence prevention amount, which is the effect achieved by supplying the metal soap during typical image forming is described. The corona product adherence prevention amount is calculated in advance by the study described below, and the results thereof is stored in the memory 15.

In a 30° C./80% RH (H/H) environment, the corona product adherence prevention amount is calculated by using the difference in the injection current. The larger the injection current, the larger the amount of the corona products on the photoconductor 1 and the larger the influence on the image smearing. In order to measure the injection current, a charging voltage having an absolute value smaller than that of the discharge start voltage Vth is applied. As a result, the influence of the discharge can be removed, and thus only the injection current caused by the corona products can be extracted. When the image forming operation is continued by changing the injection current value, the results shown in Table 13 are obtained. Specifically, in order to confirm occurrence of image smearing, 10,000 sheets were continuously passed in one day at a printing ratio of 1%, the photoconductor was left to stand in the apparatus for one day, and whether there was image smearing after being left to stand was compared. The reason for leaving the photoconductor to stand for one day is that the corona products generated on the surface of the photoconductor 1 sufficiently absorb moisture by being left to stand for one day, and thus the effect of reducing the surface resistance of the photoconductor 1 becomes prominent. A sample for determining whether image smearing occurred was obtained by printing a halftone image on one sheet and used for evaluation. The evaluation standard is as follows.

○: No image smearing occurred. There were no blank areas or blurring of contours in the image boundary portion that occurred by latent image blurring in all parts of the image.
x: Image smearing occurred. Blank areas and blurring of contours in the image boundary portion resulting from latent image blurring occurred in some or all parts of the image.

TABLE 13

| | Injection current value [μA] | Number of sheets passed (× 1000 sheets) |
|---|---|---|
| Structure 1 | 4 | ○ |
| Structure 2 | 5 | x |

The results in Table 13 demonstrate that as long as the injection current amount is 4 μA, the metal soap 45*c* in an amount that does not cause image smearing is being supplied to the surface of the photoconductor 1. Based on the results, the injection current amount with which adherence of corona products can be prevented (hereinafter this amount is referred to as the "corona product adherence prevention amount") is set to 4 μA.

Next, the calculated value is described. A calculated value is determined by adding only a positive value obtained when the corona product adherence amount is subtracted from the absolute value of the charging current. The metal soap application operation is executed when the calculated value reaches the predetermined threshold value. When the image is evaluated under the aforementioned conditions in a 30° C./80% RH (H/H) environment, the results shown in Table 14 below are obtained. The charging current values indicated in Table 14 are each a total current value of the discharge current and the injection current, and the value indicates the charging current value at the time×occurred.

TABLE 14

| | Charging current value [μA] | Number of sheets passed (× 1000 sheets) 6.5 | 7.5 | 9.0 | 10 | 15 | 16.5 |
|---|---|---|---|---|---|---|---|
| Structure 3 | 12 | ○ | ○ | ○ | ○ | ○ | x |
| Structure 4 | 17 | ○ | ○ | ○ | x | x | x |
| Structure 5 | 22 | ○ | x | x | x | x | x |

Referring to the results of Table 14 above, the timing at which image smearing occurred differed depending on the charging current value during image forming. By repeating the image forming operation, adherence of corona products on the photoconductor 1 gradually occurred, and the charging current value increased with the image forming operation in all of the structures 3, 4, and 5. These results show that the corona products have built up.

Here, (Δ in charging current value=real-time charging current amount—corona product adherence prevention amount)×(number of sheets subjected to image formation) is substantially coincident. It is determined that the amount of the corona products exceeded the threshold value as soon as × occurs; thus, the threshold value is the amount of the corona products generated up to immediately before the timing at which the amount of the corona products exceeded a particular amount. This shows that image smearing occurs as soon as the product of the charging current amount and the number of sheets exceeds the threshold value. In other words, the threshold value is dependent on the duration of execution of the image forming operation expressed by the charging current amount and the number of sheets of recording material S.

$$(12\ \mu A-4\ \mu A)\times 15000=1.2\times 10^5 \quad \text{Structure 3:}$$

$$(17\ \mu A-4\ \mu A)\times 9000=1.2\times 10^5 \quad \text{Structure 4:}$$

$$(22\ \mu A-4\ \mu A)\times 6500=1.2\times 10^5 \quad \text{Structure 5:}$$

From this result, the threshold value for the calculated value in the 30° C./80% RH environment can be set to $1.2\times 10^5$. In the 30° C./80% RH environment, it is possible to obtain a structure that prevents image smearing by performing the metal soap application operation at this timing.

Figure 24:
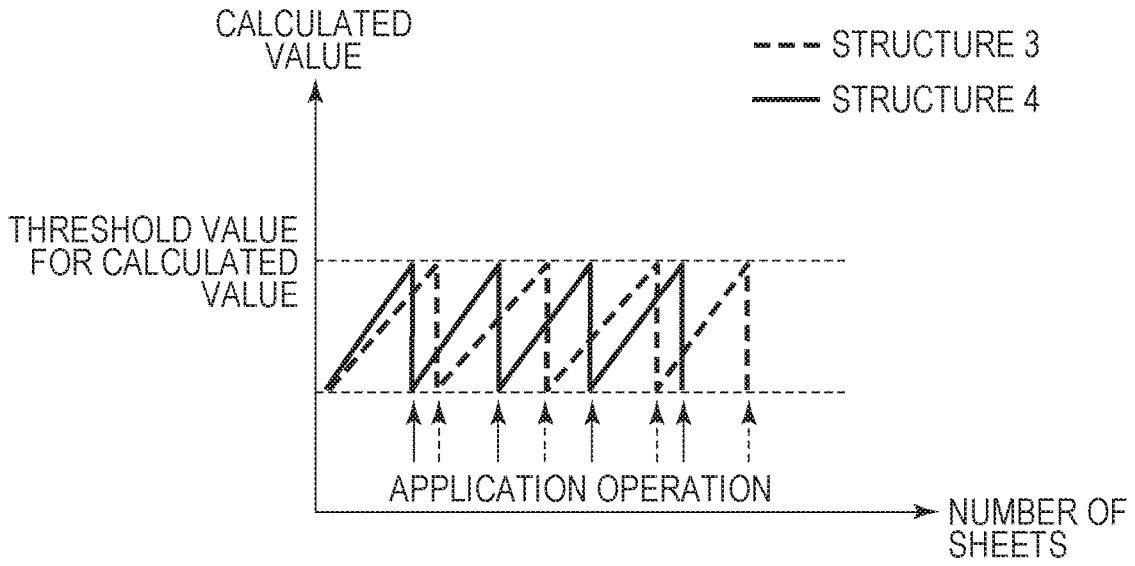
FIG. 24 is a graph illustrating the endurance transition of a charging current value in Example 11.

FIG. 24 shows the transition of the calculated value in structures 3 and 4 when the image forming operation is conducted in a 30° C./80% RH environment. The dotted line indicates the structure 3 and the solid line indicates the structure 4. After the image forming operation is started, the calculated value increases due to the calculation results of the charging current value and the corona product adherence prevention amount corresponding to the structure. The slope of the calculated value is smaller in the structure 3 since the charging current value is low. When image forming is continued as is, the value reaches the threshold value for the calculated value set within the range in which image smearing does not occur. The metal soap application operation is executed at this timing.

Next, the threshold value for the calculated value in a 27° C./70% RH environment was studied, and the results indicated in Table 15 are obtained.

TABLE 15

| | Charging current value [μA] | Number of sheets passed (× 1000 sheets) 16 | 17 | 22 | 23 | 36 | 37 |
|---|---|---|---|---|---|---|---|
| Structure 3 | 12 | ○ | ○ | ○ | ○ | ○ | x |
| Structure 4 | 17 | ○ | ○ | ○ | x | x | x |
| Structure 5 | 22 | ○ | x | x | x | x | x |

As shown in Table 15 above, the timing at which image smearing occurs differs depending on the charging current value during image forming. This result is similar to that in Table 14, and (Δ in charging current value)×(number of sheets subjected to image formation) is substantially coincident.

Structure 3: $(12\ \mu A-4\ \mu A)\times 36000=2.9\times 10^5$

Structure 4: $(17\ \mu A-4\ \mu A)\times 22000=2.9\times 10^5$

Structure 5: $(22\ \mu A-4\ \mu A)\times 16000=2.9\times 10^5$

From this result, the threshold value for the calculated value in the 27° C./70% RH environment can be set to $2.9\times 10^5$. As described above, image smearing is a phenomenon that occurs when the surface resistance of the photoconductor 1 has decreased due to adherence of moisture to the corona products. Thus, the moisture content in the use environment greatly affects this phenomenon. Thus, the threshold value for the calculated value in the 27° C./70% RH environment can be set to be larger than that in the 30° C./80% RH environment.

Figure 25:
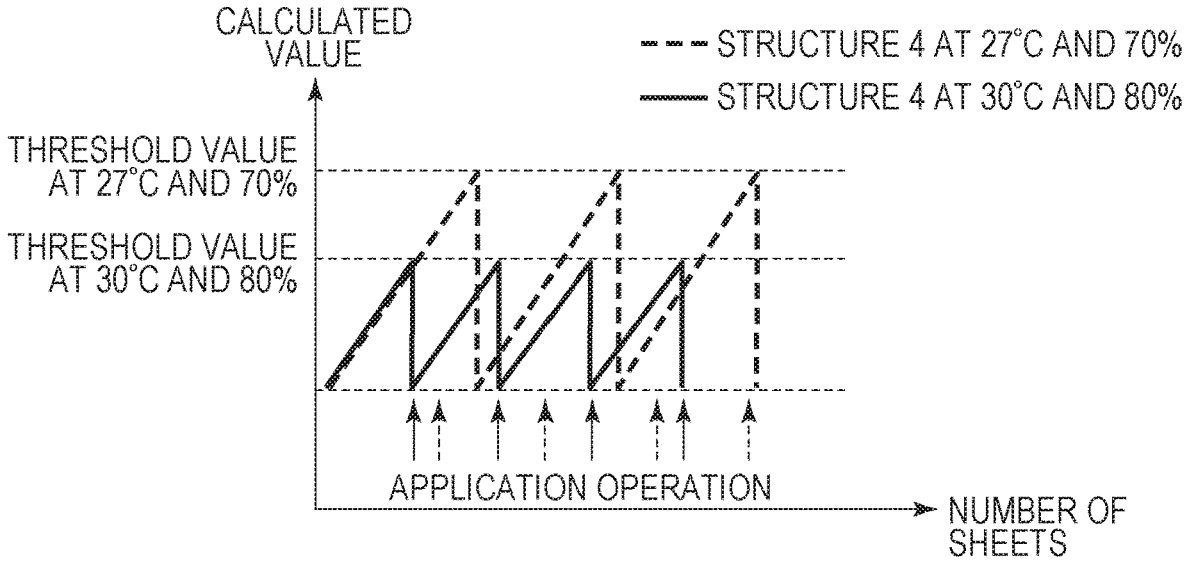
FIG. 25 is a graph illustrating the endurance transition of a charging current value in different environments in Example 11.

FIG. 25 shows the transition of the calculated value in structure 4 when the image forming operation is conducted in a 27° C./70% RH environment. The dotted line indicates the transition in 27° C./70% RH of structure 4, and the solid line indicates the transition in 30° C./80% RH of structure 4. After the image forming operation is started, the calculated value increases due to the calculation results of the charging current value and the corona product adherence prevention amount corresponding to the structure. The slope of the calculated value is smaller in the structure 3 since the charging current value is low. When image forming is continued as is, the value reaches the threshold value for the calculated value set within the range in which image smearing does not occur. The metal soap application operation is executed at this timing.

In the 27° C./70% RH environment, it is possible to obtain a structure that prevents image smearing by performing the metal soap application operation at this timing.

The results described above indicate that the threshold value is dependent on the duration of execution of the image forming operation expressed by the charging current amount and the number of sheets of recording material S as well as the temperature and humidity. The execution time for the image forming operation may take into account parameters regarding corona products, such as the time for which the charging voltage is applied and the exposure time.

Next, the environment sensor 16 that senses environments of 27° C./70% RH and 30° C./80% RH will now be described in detail.

When the environment sensor 16 calculates the temperature, the control unit 202 AD-converts the voltage input to the CPU 155 from the environment sensor 16 via the CPU 155 to obtain the AD value. Moreover, the detection result of the environment sensor 16 is acquired as a 10 bit AD value.

The AD value is sampled at 10 msec intervals, and the sampled AD values are converted into the environmental temperature in 0.1° C. increments. In Example 11, a structure in which the environment sensor 16 is formed in the cartridge 7 is employed; alternatively, the environment sensor 16 may be formed in the image forming apparatus 100.

At the time this conversion into the environmental temperature is performed ten times (every 100 msec), the average value at six points selected from sampled ten environmental temperature points by omitting the largest and second largest values and the smallest and second smallest values is determined. This average value is employed as the present temperature value (in 0.1° C. increments), and the first decimal place thereof is rounded off and retained in the RAM as the present temperature value (in 1° C. increments).

The control performed by the environment sensor 16 involves estimating the temperature in the image forming apparatus 100 that rises due to the temperature rise caused by the image forming operation and correcting the environmental temperature.

The actual service state deviates from the atmosphere temperature due to the influence of the temperature rise inside the image forming apparatus 100; thus, the environment sensor 16 corrects the environmental temperature and performs control to employ an appropriate value.

Meanwhile, when the environment sensor 16 calculates the humidity, the control unit 202 performs AD conversion of the voltage input to the ASIC from the environment sensor 16 via the ASIC to obtain the AD value. The detection result of the environment sensor 16 is acquired as a 10 bit AD value by AD conversion in the ASIC. The environmental humidity (%) is calculated from the average of the environmental humidity sensor AD values and the environmental temperature (° C.), and is updated every 100 msec.

The environmental humidity sensor AD value is sampled ten times at 10 msec intervals, and the average value of six points selected from the sampled ten points by omitting the largest and second largest values and the smallest and second smallest values of the sampled environmental humidity sensor AD values is determined. As a result, the environmental humidity sensor AD average value is calculated.

Next, the environmental humidity RH5(%), which is the environmental humidity sensor AD average value at 5° C., and the environmental humidity RH50(%), which is the environmental humidity sensor AD average value at 50° C., are acquired.

The environmental humidity (%) is calculated from mathematical formula 6 below by using RH5(%), RH50(%), and the environmental temperature T (° C.).

$$\text{Environmental humidity (\%)}=RH50+(50-T)\times((RH5-RH50)/(50-5)), \quad \text{(Mathematical formula 6)}$$

where the environmental temperature T has the first decimal place as the effective figure. The first decimal place of the environmental humidity is rounded.

The calculated environmental humidity (%) is retained in the RAM at the next updating timing.

Next, the absolute humidity (absolute moisture content) is calculated from the environmental humidity. The absolute humidity ($g/m^3$) is determined on the basis of the environmental temperature T (C) and the environmental humidity RH (%).

The absolute humidity ($g/m^3$) is acquired on the basis of a saturated moisture content Wmax ($g/m^3$) at the environmental temperature T (C).

The absolute humidity ($g/m^3$) is calculated from mathematical formula 7 below by using the saturated moisture content Wmax ($g/m^3$) and the environmental humidity RH (%).

$$\text{Absolute humidity}(g/m^3)=W\text{max}\times(\text{RH}/100) \quad \text{(Mathematical formula 7)}$$

The timing of updating the absolute humidity is set to be the same as the timing of calculating the average value of the environmental humidity.

In this example, the threshold value for the calculated value corresponding to the environment is stored in the memory 15, and the threshold value of the calculated value is determined from the result detected by the environment sensor 16.

In Example 11, the temperature/humidity was measured with the environment sensor 16. Image smearing is an issue that occurs when moisture adheres to the corona products, and easily occurs as the absolute humidity increases. Thus, the environment sensor 16 may have an ability to measure the absolute humidity as in Example 11. However, it is still possible to determine the timing of the metal soap application operation by using a sensor that can measure only the environmental temperature T or the environmental humidity RH from the viewpoint of cost.

5. Control Procedure for Metal Soap Application Operation

Figure 26:
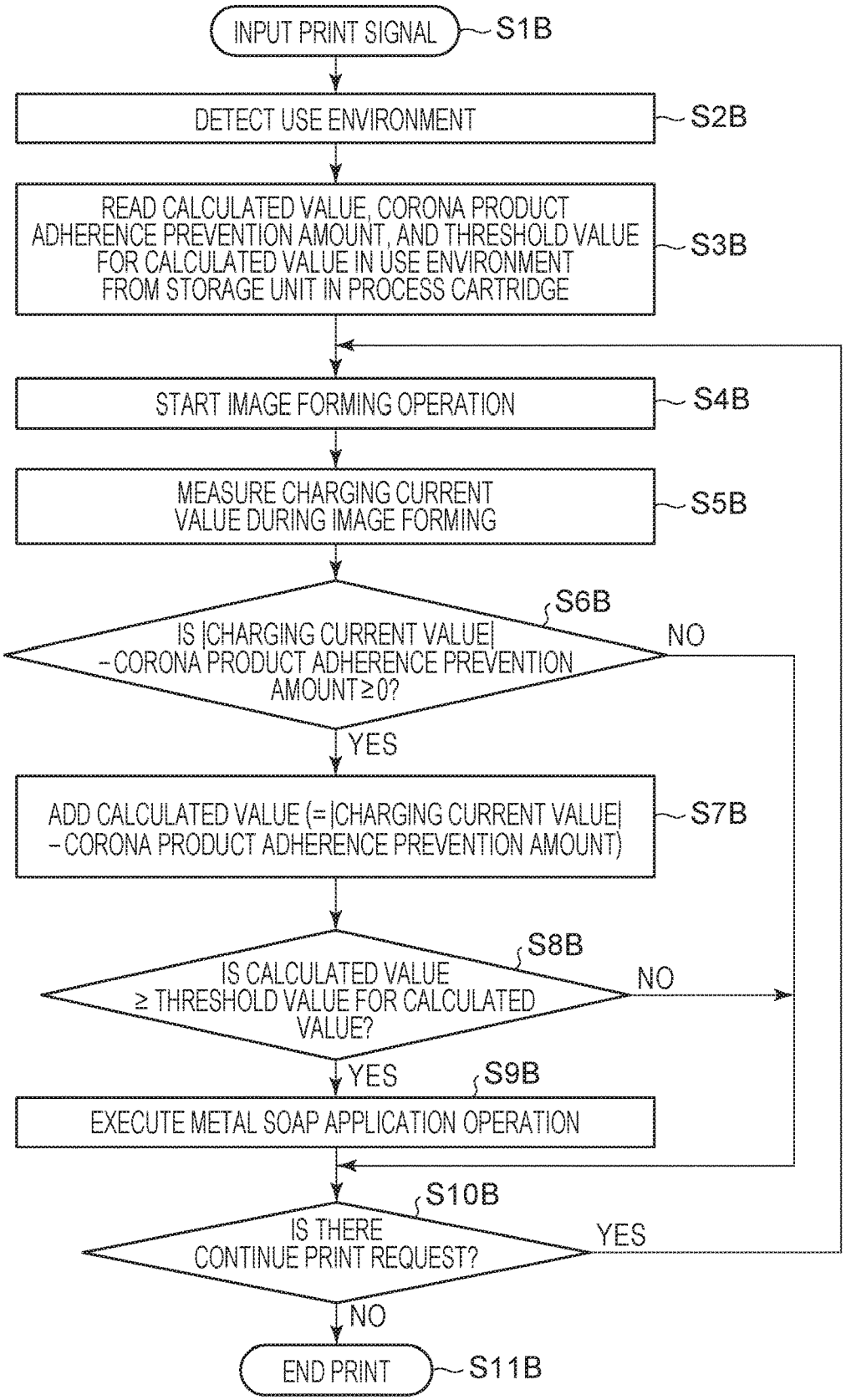
FIG. 26 is a flowchart illustrating a metal soap application operation in Example 11.

Next, referring to the flowchart in FIG. 26, the control procedure for the metal soap application operation for suppressing image smearing in this example is described. In Example 11, the control unit 202 executes the metal soap application operation.

The process cartridge 7 is equipped with the memory 15, and the memory 15 stores the calculated value and the threshold value for the calculated value described above. When a print signal is input (SIB), the CPU 155 in the image forming apparatus main body 100 performs environment detection by using the environment sensor 16 (S2B). Next, the CPU 155 communicates with the memory 15 and reads the calculated value, the corona product adherence prevention amount, and the threshold value for the calculated value in the use environment (S3B).

Next, the image forming operation is started (S4B). Next, the CPU 155 performs charging current detection during the image formation and measures the present charge current value at the desired charging voltage (S5B). Then CPU 155 subtracts the corona product adherence prevention amount from the absolute value of the charging current and determines whether the result is positive or not (S6B).

If the result is not a positive value, whether there is a continue print request is determined (S10B). If there is no request, the process moves to end print operation (S11B) and if there is a request, the operations from S4B to SOB are repeated until there is no longer a continue print request.

If the result is a positive value, the value obtained by subtracting the corona product adherence prevention amount from the absolute value of the charging current is added to the calculated value read in S3B, and the calculated value is updated (S7B).

It is determined whether the calculated value updated in S7B exceeds the threshold value for the calculated value in the use environment read in S3B (S8B).

If the present calculated value does not exceed the set threshold value, whether there is a continue print request is determined (S10B). If there is no request, the process moves to end print operation (S11B) and if there is a request, the operations from S4B to S10B are repeated until there is no longer a continue print request.

If the present calculated value exceeds the set threshold value, it is the timing of executing the metal soap application operation, and thus the metal soap application operation is executed (S9B). After the metal soap application operation is ended, whether there is a continue print request is determined (S10B), and if there is no request, the process moves to end print operation (S11B) and if there is a request, the operations from S4B to S10B are repeated until there is no longer a continue print request. After execution of the metal soap application operation, the number of prints and the calculated value are reset.

The metal soap application operation duration can be 2 to 30 seconds. The minimum duration is the time taken for the photoconductor 1 to rotate once. Downtime is generated if the duration of the metal soap application operation is excessively long; thus, the time period is set as appropriate. Alternatively, the detected charging current value may be confirmed to be below the corona product adherence prevention amount while detecting the current by the charging current detection unit 36 during execution of the metal soap application operation, and then the metal soap application operation may be ended.

In Example 11, the charging current during image forming is measured and the influence on the amount of the corona products by the image pattern is taken into account in determining the timing for the metal soap application operation. As a result, the metal soap application operation can be executed at a more appropriate timing. However, even when the charging current amount during image forming is not measured, it is still possible to determined the timing of executing the metal soap application operation by studying Tables 14 and 15 in advance.

Moreover, although the current values are used to indicate the corona product adherence amount and the corona product adherence prevention amount in Example 11, any other parameter that has a correlation with image smearing may be used instead.

In the structure of the image forming apparatus 100 used in Example 12, the same components as those of Examples 1 to 11 are denoted by the same reference signs and descriptions thereof are omitted.

Hereinafter, in Example 12, a more accurate timing for the metal soap application operation is determined by setting the corona product adherence prevention amount to a value appropriate for the extent of use of the toner and by calculating the calculated value in the calculation unit. The details are as follows.

1. Toner Level and Development Lifetime

The remaining amount of the metal soap 45*c* externally added to the toner differs depending on the extend of use of the toner. Since the effect of the metal soap 45*c* varies depending on the extent of deterioration of the toner 10, the use information of the developing unit 3 is taken into account in executing the metal soap application operation so that the image smearing can be suppressed. In Example 12, the parameters that serve as use information for estimating the extent of deterioration of the toner 10 are the lifetime of the developing roller 4 (hereinafter referred to as the "development lifetime") and the toner level (the remaining amount of the toner). The development lifetime is the ratio of the remaining lifetime based on the number of rotations of the developing roller 4. The number of rotations can be substituted by the surficial moving distance.

Next, the reason that these parameters affect the remaining amount of the metal soap 45*c* is described.

The developing roller 4 is rubbed as it rotates while bearing the toner 10 on the surface thereof, and thus the toner 10 receives damage. As a result, there are more chances that the metal soap 45*c* externally added to the toner 10 would detach from the toner 10. If the toner level is high, the damage inflicted by the rotation of the developing roller 4 is dispersed among many particles of the toner 10 as the toner 10 is replaced, and thus detachment of the metal soap 45*c* is less. In contrast, if the toner level is low, the damage inflicted by the rotation of the developing roller 4 is repeated on fewer particles of the toner 10, and thus there are more chances of detachment of the metal soap 45*c*.

By using the technique shown in Table 13 in Example 11, the threshold value for the metal soap application operation and the corona product adherence prevention amount are calculated according to the extent of use of the toner 10.

One specific example is indicated in Table 16 for each predetermined period.

TABLE 16

| Corona | | Development lifetime | | | | |
|---|---|---|---|---|---|---|
| product adherence prevention amount | | 100 to 90% | 89 to 70% | 69 to 50% | 49 to 20% | 19 to 0% |
| Toner level | 100 to 80% | 13 μA | 10 μA | 6 μA | 4 μA | 4 μA |
| | 79 to 50% | 9 μA | 9 μA | 4 μA | 2 μA | 2 μA |
| | 49 to 30% | 8 μA | 6 μA | 4 μA | 1 μA | 1 μA |
| | 29 to 0% | 7 μA | 5 μA | 2 μA | 1 μA | 1 μA |

As indicated in Table 16, when the toner level is high and the development lifetime is not advanced, and there is a margin until image smearing occurs by corona products. In other words, the amount of the corona products on the surface of the photoconductor 1 is relatively small and the effect of the metal soap 45*c* of the toner 10 is strong. Thus, in the initial state, the corona product adherence prevention amount can be set to a large value. In contrast, in the case where the toner level is low, the development lifetime is not much advanced, and a high-print-ratio images are printed on many sheets, toner deterioration caused by being rubbed by the developing roller 4 does not progress much. Naturally, there is need to decrease the corona product adherence prevention amount according to the decrease in toner level; however, since the effect of the metal soap 45*c* is not substantially lost, the corona product adherence prevention amount can be set to a moderately large value. However, even when the toner level is high, rubbing of the toner 10 by the developing roller 4 occurs to some extent in a low printing state where the development lifetime is advanced. Thus, the development lifetime rather than the toner level is susceptible to the influence of the decrease in corona product adherence prevention amount. Moreover, in a state in which the toner level is low and the development lifetime is advanced, the effect of the metal soap 45*c* is minimized, and thus, the corona product adherence prevention amount is set to a minimum value, which is 1 μA.

Thus, the corona product adherence prevention amount during a predetermined period can be changed according to the toner level and the development lifetime. In Example 12, the toner level and the development lifetime are stored in the memory 15.

The metal soap application operation can be executed at a more appropriate timing by performing control according to Table 16.

2. Control Procedure for Metal Soap Application Operation

Figure 27:
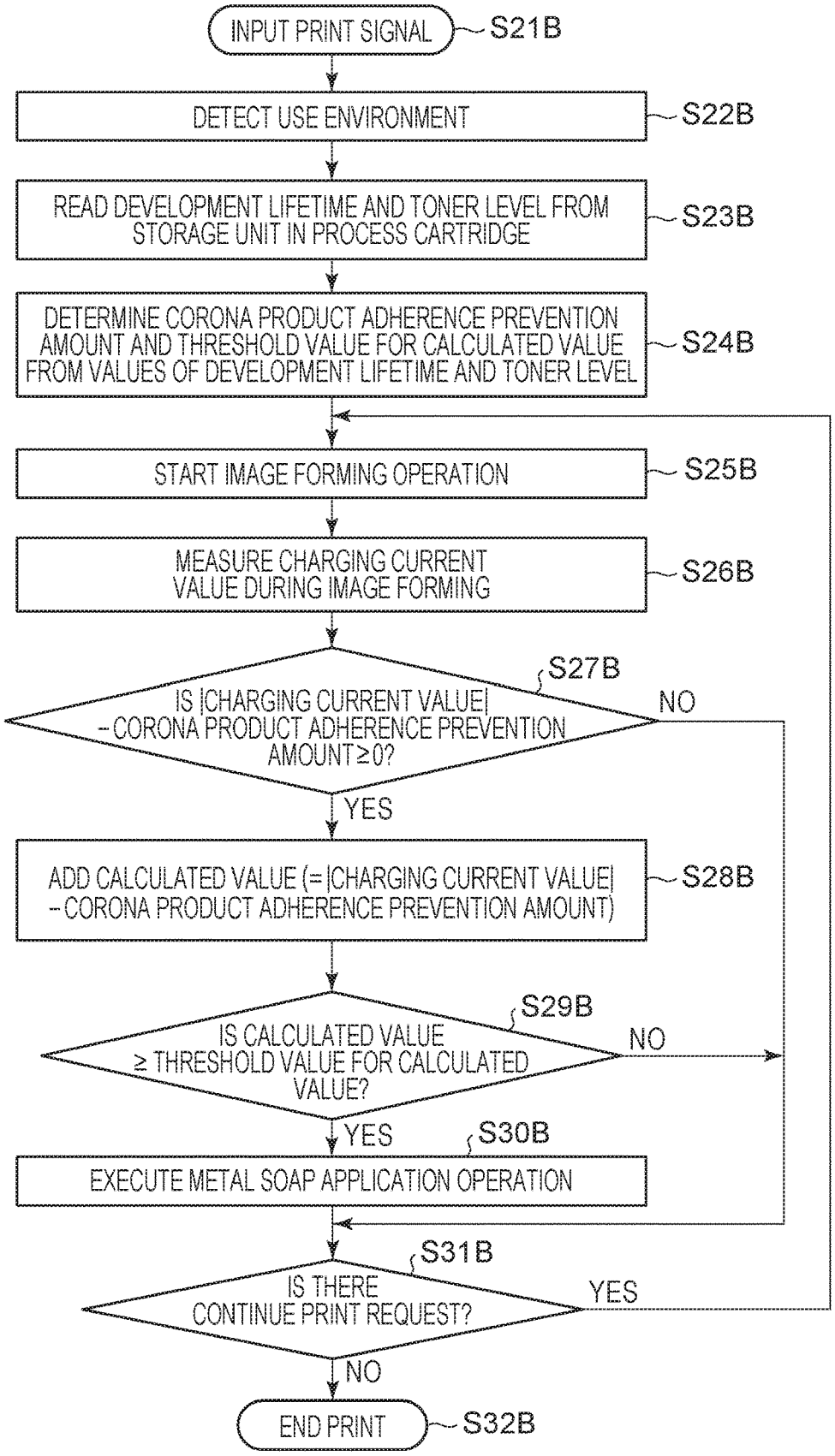
FIG. 27 is a flowchart illustrating a metal soap application operation in Example 12.

Next, referring to the flowchart in FIG. 27, the control procedure for the metal soap application operation for suppressing image smearing is described. In an embodiment for implementing the present disclosure, the control unit 202 executes the metal soap application operation.

The process cartridge 7 is equipped with the memory 15, and the memory 15 stores the calculated value and the threshold value for the calculated value described above. When a print signal is input (S21B), CPU 155 in the image forming apparatus main body 100 performs environment detection by using the environment sensor (S22B). Next, the CPU 155 communicates with the memory 15 and reads the development lifetime and the toner level (S23B). Next, the CPU 155 communicates with the memory 15 and reads the corona product adherence prevention amount and the threshold value for the calculated value in the use environment (S24B).

Next, the image forming operation is started (S25B). Next, the CPU 155 detects the charging current through the current detection unit 36, and measures the present charging current value at a desired charging voltage (S26B). Then CPU 155 subtracts the corona product adherence prevention amount from the absolute value of the charging current and determines whether the result is positive or not (S27B).

If the result is not a positive value, whether there is a continue print request is determined (S30B). If there is no request, the process moves to an end print operation (S31B) and if there is a request, the operations from S25B to S31B are repeated until there is no longer a continue print request.

If the result is a positive value, the value obtained by subtracting the corona product adherence prevention amount from the absolute value of the charging current is added to the calculated value read in S3B, and the calculated value is updated (S28B).

It is determined whether the calculated value updated in S28B exceeds the threshold value for the calculated value in the use environment read in S23B (S29B).

If the present calculated value does not exceed the set threshold value, whether there is a continue print request is determined (S31B). If there is no request, the process moves to end print operation (S32B) and if there is a request, the operations from S25B to S31B are repeated until there is no longer a continue print request.

If the present calculated value exceeds the set threshold value, it is the timing of executing the metal soap application operation, and thus the metal soap application operation is executed (S30B). After the metal soap application operation is ended, whether there is a continue print request is determined (S31B), and if there is no request, the process moves to end print operation (S32B) and if there is a request, the operations from S25B to S31B are repeated until there is no longer a continue print request. After execution of the metal soap application operation, the number of prints and the calculated value are reset.

However, according to the structure of Example 12, the operation of applying the metal soap onto the photoconductor 1 by detecting the current was conducted at an appropriate timing on the basis of the toner level and the development lifetime, and thus image smearing could be suppressed.

In Examples 11 and 12, the charging current value that detects the charging current flowing in the charging roller 2 is used; however, the feature of Example 13 is that the charging current value is not detected, and the result obtained by using the current value estimating function is set to be the corona product adherence amount.

In the charging current amount, the discharge current amount that contributes to discharge is known to be determined by the absolute humidity, the thickness of the photoconductor 1, and the transfer voltage. Thus, in Example 13, the discharge current amount is estimated from the results regarding the absolute humidity and the thickness of the photoconductor 1. This estimation is also possible by using the number of rotations of the charging roller 2 and the photoconductor 1 instead of the thickness of the photoconductor 1.

In Example 13, the estimating unit 157 illustrated in FIG. 23 estimates the charging current value from the absolute humidity and the thickness of the photoconductor 1.

1. Control Procedure for Metal Soap Application Operation

Figure 28:
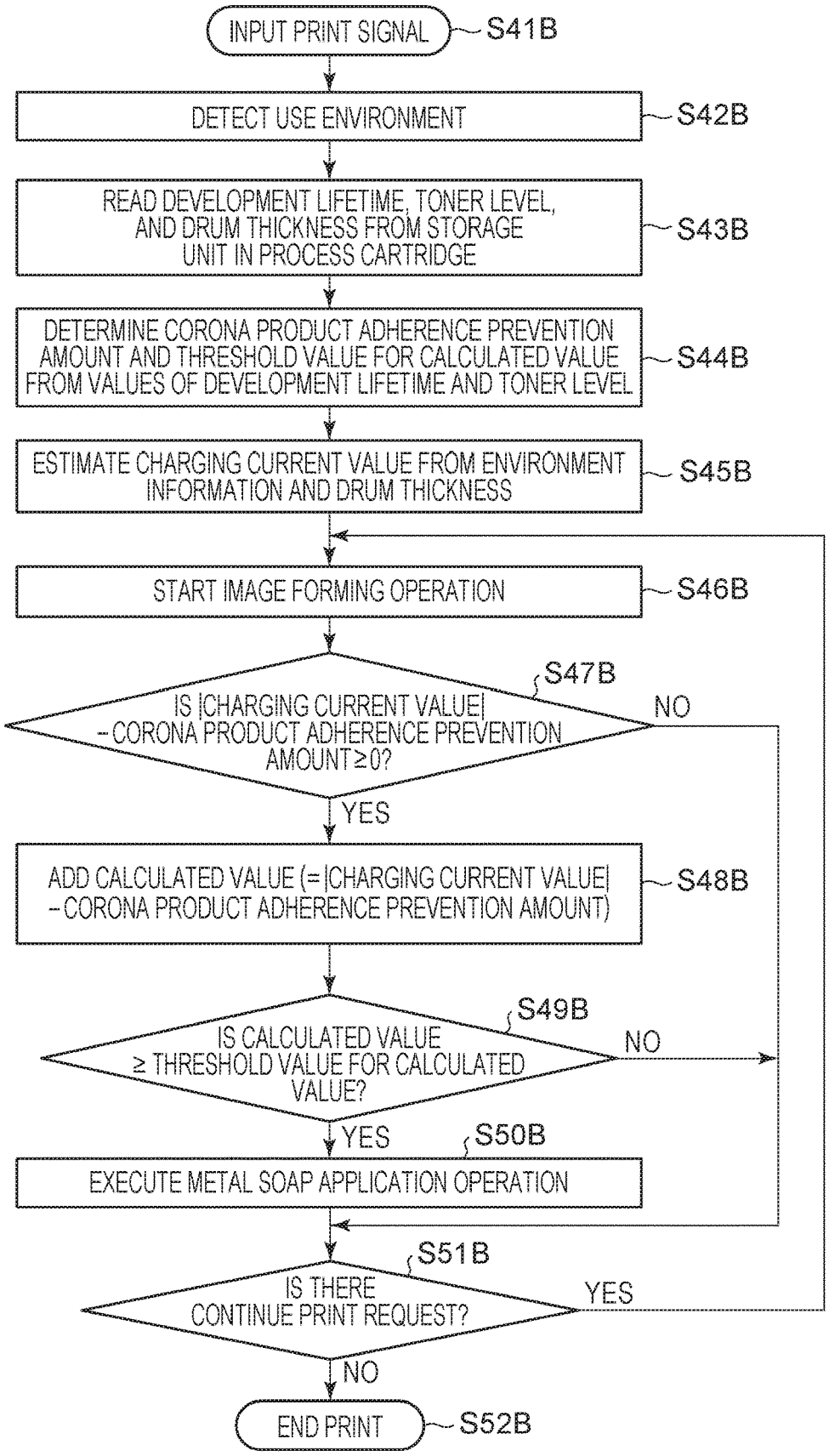
FIG. 28 is a flowchart illustrating a metal soap application operation in Example 13.

Next, referring to the flowchart in FIG. 28, the control procedure for the metal soap application operation for avoiding image smearing is described. In an embodiment for implementing the present disclosure, the control unit 202 executes the metal soap application operation.

The process cartridge 7 is equipped with the memory 15, and the memory 15 stores the calculated value and the threshold value for the calculated value described above. When a print signal is input (S41B), CPU 155 in the image forming apparatus main body 100 performs environment detection by using the environment sensor (S42B). Next, the CPU 155 communicates with the memory 15 and reads the development lifetime, the toner level, and the drum thickness (S43B). Next, the corona product adherence prevention amount and the threshold value for the calculated value in the use environment are determined from the values of the development lifetime and the toner level (S44B).

Furthermore, the CPU 155 estimates the charging current value from the environment information and the drum thickness (S45B) and then starts the image forming operation (S46B). The CPU 155 then subtracts the corona product adherence prevention amount from the absolute value of the estimated charging current that occurs as a result of the image forming operation, and determines whether the result is positive or not (S47B).

If the result is not a positive value, whether there is a continue print request is determined (S51B). If there is no request, the process moves to end print operation (S52B) and if there is a request, the operations from S46B to S51B are repeated until there is no longer a continue print request.

If the result is a positive value, the value obtained by subtracting the corona product adherence prevention amount from the absolute value (corona product adherence amount) of the estimated charging current is added to the calculated value determined in S44B, and the calculated value is updated (S48B).

Whether the calculated value updated in S48B exceeds the threshold value for the calculated value in the use environment determined in S44B is determined (S49B).

If the present calculated value does not exceed the set threshold value, whether there is a continue print request is determined (S51B). If there is no request, the process moves to an end print operation (S52B) and if there is a request, the operations from S46B to S51B are repeated until there is no longer a continue print request.

If the present calculated value exceeds the set threshold value, it is the timing of executing the metal soap application operation, and thus the metal soap application operation is executed (S50B). After the metal soap application operation is ended, whether there is a continue print request is determined (S51B), and if there is no request, the process moves to end print operation (S52B) and if there is a request, the operations from S46B to S51B are repeated until there is no longer a continue print request. After execution of the metal soap application operation, the number of prints and the calculated value are reset.

According to the structure of Example 13, the operation of applying the metal soap onto the photoconductor 1 could be performed at an appropriate timing since the result estimated by the estimating unit having a current value estimating function without performing current detection is assumed to be the corona product adherence amount, and thus image smearing could be suppressed.

Alternatively, a structure that combines the structure of Example 13 with the structure of Example 3 in which the surface of the photoconductor 1 is subjected to a roughening treatment may be employed.

Alternatively, the structure of any one of Examples 11 to 13 and the toner used in Example 4 may be combined.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-120445, filed Jun. 27, 2019, Japanese Patent Application No. 2019-120449, filed Jun. 27, 2019, and Japanese Patent Application No. 2019-120450, filed Jun. 27, 2019 which are hereby incorporated by reference herein in their entirety.

What is claimed is:

1. An image forming apparatus that forms a toner image on a recording material, the image forming apparatus comprising:

a rotatable image bearing member;

a charging member that charges a surface of the image bearing member;

a toner storing unit that stores a toner containing a metal soap;

a developing member that forms a toner image by supplying the toner to the surface of the image bearing member, which is charged by the charging member, in a developing portion where the developing member opposes the image bearing member; and a control unit that controls a rotation speed of the image bearing member so that a surficial moving speed of the developing member is higher than a surficial moving speed of the image bearing member, wherein an image forming operation for forming the toner image on a recording material and an application operation of applying the metal soap to the surface of the image bearing member by supplying the toner stored in the toner storing unit to the surface of the image bearing member from the developing member are executed, and wherein the control unit performs control so that a surficial moving speed of the image bearing member during the application operation is lower than the surficial moving speed of the image bearing member during the image forming operation, and so that a speed difference between the surficial moving speed of the developing member and the surficial moving speed of the image bearing member during the application operation is larger than that during the image forming operation.

2. The image forming apparatus according to claim 1, wherein, in a rotation axis direction of the image bearing member, a range of a ten-point average surface roughness (Rz) of the surface of the image bearing member is $0.10 \leq Rz \leq 0.70$ (μm), and a range of an average interval (Sm) between concavities and convexities on the surface of the image bearing member is $0 < Sm \leq 70$ (μm).

3. The image forming apparatus according to claim 1, wherein the surficial moving speed at which the developing member rotates during the image forming operation is different from that during the application operation.

4. The image forming apparatus according to claim 1, further comprising:

a first voltage applying unit that applies a charging voltage to the charging member; and a second voltage applying unit that applies a developing voltage to the developing member, wherein, when a difference between a surface potential of the surface of the image bearing member, which is charged by the charging member, in the developing portion and the developing voltage applied to the developing member by the second voltage applying unit is assumed to be a back contrast, the control unit performs control so that the back contrast during the application operation is larger than the back contrast during the image forming operation.

5. The image forming apparatus according to claim 4, further comprising:

a toner supplying member that contacts the developing member to form a contact portion and supplies the toner at the contact portion; and a third voltage applying unit that applies a toner supplying voltage to the toner supplying member, wherein, during the application operation, the control unit controls the second voltage applying unit and the third voltage applying unit so that a potential difference is formed in the contact portion, the potential difference generating an electrostatic force that induces the metal soap to move from the toner supplying member toward the developing member.

6. The image forming apparatus according to claim 1, wherein, during the application operation, the developing member contacts the image bearing member in the developing portion.

7. The image forming apparatus according to claim 1, wherein the toner contains an organic silicon polymer, and a number of carbon atoms directly bonded to a silicon atom in the organic silicon polymer is 1 or more and 3 or less.

8. The image forming apparatus according to claim 7, wherein the organic silicon polymer has a partial structure represented by R—SiO3/2, where R represents a hydrocarbon group having 1 to 6 carbon atoms.

9. The image forming apparatus according to claim 8, wherein R represents a hydrocarbon group having 1 to 3 carbon atoms.

10. The image forming apparatus according to claim 1, further comprising:

an intermediate transfer body that contacts the image bearing member to form a transfer portion and bears the toner image formed on the surface of the image bearing member in the transfer portion;

a transfer member that transfers the toner image borne on the intermediate transfer body onto a recording material; and an exposing unit that exposes a surface of the image bearing member with light, the exposing unit exposing a surface of the image bearing member on a downstream with respect to a rotation direction of the image bearing member of the transfer portion in the image bearing member and upstream with respect to the rotation direction of a charging portion where the image bearing member and the charging portion face each other, wherein the control unit performs control so that an exposure amount of the exposing unit during the application operation is smaller than the exposure amount of the exposing unit during the image forming operation.

11. The image forming apparatus according to claim 10, wherein exposure by the exposing unit is not performed during the application operation.

12. The image forming apparatus according to claim 1, wherein a metal species of the metal soap is at least one member selected from the group consisting of zinc, calcium, and magnesium.

13. The image forming apparatus according to claim 1, wherein the metal soap is at least one member selected from the group consisting of zinc stearate, calcium stearate, and magnesium stearate.

14. The image forming apparatus according to claim 1, wherein the metal soap has a particle diameter of 0.15 μm or more and 2.0 μm or less.

15. The image forming apparatus according to claim 1, wherein the image bearing member has a protective layer as an uppermost surface layer, the protective layer being formed of an acrylic resin.

16. An image forming apparatus that forms a toner image on a recording material, the image forming apparatus comprising:

a rotatable image bearing member in which, in a rotation axis direction of the image bearing member, a range of a ten-point average surface roughness (Rz) of a surface of the image bearing member is $0.10 \leq Rz \leq 0.70$ (μm), and a range of an average interval (Sm) between concavities and convexities on the surface of the image bearing member is $0 < Sm \leq 70$ (μm);

a charging member that charges the surface of the image bearing member;

a toner storing unit that stores a toner containing a metal soap;

a developing member that forms a toner image by supplying the toner to the surface of the image bearing member, which is charged by the charging member, in a developing portion where the developing member opposes the image bearing member; and a control unit that controls at least one member selected from the group consisting of a rotation speed of the image bearing member and a rotation speed of the developing member so that a surficial moving speed of the developing member is higher than a surficial moving speed of the image bearing member, wherein an image forming operation for forming the toner image on a recording material and an application operation of applying the metal soap to the surface of the image bearing member by supplying the toner stored in the toner storing unit to the surface of the image bearing member from the developing member are executed, and wherein the control unit performs control so that a speed difference between the surficial moving speed of the developing member and the surficial moving speed of the image bearing member during the application operation is larger than that during the image forming operation.

17. The image forming apparatus according to claim 16, wherein the surficial moving speed at which the developing member rotates during the image forming operation is different from that during the application operation.

18. The image forming apparatus according to claim 16, wherein the surficial moving speed at which the image bearing member rotates during the image forming operation is different from that during the application operation.

19. An image forming apparatus that forms a toner image on a recording material, the image forming apparatus comprising:

a rotatable image bearing member;

a charging member that charges a surface of the image bearing member;

a toner storing unit that stores a toner containing a metal soap;

a developing member that forms a toner image by supplying the toner to the surface of the image bearing member, which is charged by the charging member, in a developing portion where the developing member opposes the image bearing member;

a toner supplying member that contacts the developing member to form a contact portion and supplies the toner at the contact portion;

a first voltage applying unit that applies a charging voltage to the charging member;

a second voltage applying unit that applies a developing voltage to the developing member;

a third voltage applying unit that applies a toner supplying voltage to the toner supplying member; and a control unit that controls the first voltage applying unit and the second voltage applying unit, wherein an image forming operation for forming the toner image on a recording material and an application operation of applying the metal soap to the surface of the image bearing member by supplying the toner stored in the toner storing unit to the surface of the image bearing member from the developing member are executed, and wherein, when a difference between a surface potential of the surface of the image bearing member, which is charged by the charging member, in the developing portion and the developing voltage applied to the developing member by the second voltage applying unit is assumed to be a back contrast, the control unit performs control so that the back contrast during the application operation is larger than the back contrast during the image forming operation, wherein, during the application operation, the control unit controls the second voltage applying unit and the third voltage applying unit so that a potential difference is formed in the contact portion, the potential difference generating an electrostatic force that induces the metal soap to move from the toner supplying member toward the developing member.

20. The image forming apparatus according to claim 19, wherein the control unit controls at least one member selected from the group consisting of a rotation speed of the image bearing member and a rotation speed of the developing member so that a surficial moving speed of the developing member is higher than a surficial moving speed of the image bearing member, and the control unit performs control so that a speed difference between the surficial moving speed of the developing member and the surficial moving speed of the image bearing member during the application operation is larger than the speed difference during the image forming operation.

21. The image forming apparatus according to claim 20, wherein the surficial moving speed at which the developing member rotates during the image forming operation is different from that during the application operation.

22. The image forming apparatus according to claim 20, wherein the surficial moving speed at which the image bearing member rotates during the image forming operation is different from that during the application operation.

23. The image forming apparatus according to claim 19, wherein, in a rotation axis direction of the image bearing member, a range of a ten-point average surface roughness (Rz) of the surface of the image bearing member is $0.10 \leq Rz \leq 0.70$ (μm), and a range of an average interval (Sm) between concavities and convexities on the surface of the image bearing member is $0 < Sm \leq 70$ (μm).

24. An image forming apparatus that forms a toner image on a recording material, the image forming apparatus comprising:

a rotatable image bearing member;

a charging member that charges a surface of the image bearing member;

a toner storing unit that stores a toner containing a metal soap;

a developing member that forms a toner image by supplying the toner to the surface of the image bearing member, which is charged by the charging member, in a developing portion where the developing member opposes the image bearing member;

a voltage applying unit that applies a charging voltage to the charging member;

a current detection unit that detects a current flowing from the charging member to the image bearing member while the charging voltage is being applied to the voltage applying unit; and a control unit that controls the voltage applying unit, wherein an image forming operation for forming the toner image on a recording material and an application operation of applying the metal soap to the surface of the image bearing member by supplying the toner stored in the toner storing unit to the surface of the image bearing member from the developing member are executed, and wherein the application operation is not executed when a current value of the current detected by the current detection unit is a first current value, and the application operation is executed when the current value is a second current value having an absolute value larger than that of the first current value.

25. The image forming apparatus according to claim 24, wherein the application operation is executed when a current value of the current detected by the current detection unit exceeds a predetermined threshold value.

26. The image forming apparatus according to claim 25, further comprising:

an information detection unit that detects use information of the image bearing member and the charging member, wherein, the threshold value is set to have a larger absolute value when the use information detected by the information detection unit is second use information than when the use information detected by the information detection unit is first use information, the second use information indicating more use than the first use information.

27. The image forming apparatus according to claim 26, further comprising:

a first exposing unit that exposes, with light, the surface of the image bearing member charged by the charging member;

a transfer member that contacts the image bearing member to form a transfer portion and transfers the toner image formed on the surface of the image bearing member in the transfer portion; and a second exposing unit that exposes a surface of the image bearing member with light, the second exposing unit exposing a surface of the image bearing member on a downstream with respect to a rotation direction of the image bearing member of the transfer portion in the image bearing member and upstream with respect to the rotation direction of a charging portion where the image bearing member and the charging portion face each other, wherein information regarding the use information is calculated by using at least one member selected from the group consisting of information regarding a thickness of the image bearing member, information regarding an exposure amount of exposure by the first exposing unit, information regarding an exposure amount of exposure by the second exposing unit, a number of sheets subjected to image formation, a number of rotations of the image bearing member, and a voltage applying time by the voltage applying unit.

28. The image forming apparatus according to claim 27, wherein the information regarding the exposure amount of exposure by the first exposing unit and the information regarding the exposure amount of exposure by the second exposing unit are calculated by using at least one member selected from the group consisting of an irradiation time and an irradiation intensity of exposure by the first exposing unit, and an irradiation time and an irradiation intensity of exposure by the second exposing unit.

29. The image forming apparatus according to claim 25, wherein the threshold value is increased as an absolute value of the charging voltage applied to the charging member during the image forming operation is increased.

30. The image forming apparatus according to claim 24, wherein, in a state in which a surficial moving speed of the developing member is higher than a surficial moving speed of the image bearing member, a speed difference between the surficial moving speed of the image bearing member and the surficial moving speed of the developing member during the application operation is larger than the speed difference during the image forming operation.

31. The image forming apparatus according to claim 24, wherein, during the application operation, the developing member contacts the image bearing member in the developing portion.

32. The image forming apparatus according to claim 24, wherein the surficial moving speed at which the developing member rotates during the image forming operation is different from that during the application operation.

33. The image forming apparatus according to claim 24, wherein the surficial moving speed at which the image bearing member rotates during the image forming operation is different from that during the application operation.

34. The image forming apparatus according to claim 24, wherein a range of a ten-point average surface roughness (Rz) of the surface of the image bearing member is $0.10 \leq Rz \leq 0.70$ (μm), and a range of an average interval (Sm) between concavities and convexities on the surface of the image bearing member is $0 < Sm \leq 70$ (μm).

35. The image forming apparatus according to claim 24, wherein the toner contains an organic silicon polymer, and a number of carbon atoms directly bonded to a silicon atom in the organic silicon polymer is 1 or more and 3 or less.

36. The image forming apparatus according to claim 35, wherein the organic silicon polymer has a partial structure represented by R—SiO3/2, where R represents a hydrocarbon group having 1 to 6 carbon atoms.

37. The image forming apparatus according to claim 36, wherein R represents a hydrocarbon group having 1 to 3 carbon atoms.

38. The image forming apparatus according to claim 24, further comprising:

a second voltage applying unit that applies a developing voltage to the developing member whereas the voltage applying unit that applies the charging voltage to the charging member is assumed to be a first voltage applying unit, wherein, when a difference between a surface potential of the surface of the image bearing member, which is charged by the charging member, in the developing portion and the developing voltage applied to the developing member by the second voltage applying unit is assumed to be a back contrast, the control unit performs control so that the back contrast during the application operation is larger than the back contrast during the image forming operation.

39. The image forming apparatus according to claim 24, wherein a metal species of the metal soap is at least one member selected from the group consisting of zinc, calcium, and magnesium.

40. The image forming apparatus according to claim 24, wherein the metal soap is at least one member selected from the group consisting of zinc stearate, calcium stearate, and magnesium stearate.

41. The image forming apparatus according to claim 24, wherein the metal soap has a particle diameter of 0.15 μm or more and 2.0 μm or less.

42. The image forming apparatus according to claim 24, wherein the image bearing member has a protective layer as an uppermost surface layer, the protective layer being formed of an acrylic resin.

43. The image forming apparatus according to claim 42, wherein the protective layer is a cured film obtained by polymerizing a composition that contains a monomer having a polymerizable functional group.

44. An image forming apparatus that forms a toner image on a recording material, the apparatus comprising:

a rotatable image bearing member;

a charging member that charges a surface of the image bearing member;

a toner storing unit that stores a toner containing a metal soap;

a developing member that forms a toner image by supplying the toner to the surface of the image bearing member, which is charged by the charging member, in a developing portion where the developing member opposes the image bearing member;

a voltage applying unit that applies a charging voltage to the charging member;

a control unit that performs control to enable execution of an image forming operation for forming the toner image on a recording material and an application operation of applying the metal soap to the surface of the image bearing member by supplying the toner stored in the toner storing unit to the surface of the image bearing member from the developing member;

a determination unit that determines whether or not to execute the application operation on the basis of a current value of a current flowing from the charging member to the image bearing member when the charging voltage is being applied to the charging member, information regarding an environment in which the image forming apparatus is used, and information regarding an execution time for the image forming operation; and an estimating unit that estimates the current value, wherein the determination unit determines whether or not to execute the application operation on the basis of the current value estimated by the estimating unit during the image forming operation.

45. The image forming apparatus according to claim 44, wherein the estimating unit estimates the current value on the basis of the information regarding the environment.

46. The image forming apparatus according to claim 44, wherein the estimating unit estimates the current value on the basis of the information regarding a thickness of the image bearing member.

47. The image forming apparatus according to claim 46, wherein the information regarding the thickness of the image bearing member is calculated by using at least one member selected from the group consisting of a number of rotations of the image bearing member and a time for which the charging voltage is applied.

48. The image forming apparatus according to claim 44, further comprising an environment detection unit that detects at least one of a temperature and a humidity, which are the information regarding the environment.

49. The image forming apparatus according to claim 48, wherein an absolute humidity is calculated from the information regarding the environment detected by the environment detection unit.

50. The image forming apparatus according to claim 44, wherein the information regarding the execution time is a number of sheets of recording material on which toner images are printed by the image forming operation.

51. The image forming apparatus according to claim 44, wherein the information regarding the execution time is reset after execution of the application operation.

52. The image forming apparatus according to claim 44, wherein an adherence amount of corona products adhering to the surface of the image bearing member is calculated on the basis of the current value.

53. The image forming apparatus according to claim 52, further comprising:

a calculating unit that calculates a difference between the adherence amount and an adherence prevention amount which is the current value in a range in which the corona products generated on the surface of the image bearing member do not affect the toner image; and a storage unit that stores a calculated value calculated by the calculating unit, wherein the application operation is executed when the calculated value stored in the storage unit exceeds a threshold value.

54. The image forming apparatus according to claim 53, wherein the calculated value is a product of the difference and a number of sheets of recording material.

55. The image forming apparatus according to claim 53, wherein the calculated value is reset after execution of the application operation.

56. The image forming apparatus according to claim 53, wherein the threshold value is changed according to the information regarding the environment.

57. The image forming apparatus according to claim 53, wherein the adherence prevention amount and the threshold value are changed on the basis of use information of the developing member.

58. The image forming apparatus according to claim 57, wherein the use information of the developing member is information regarding an amount of the toner stored in the toner storing unit.

59. The image forming apparatus according to claim 57, wherein the use information of the developing member is a number of rotations of the developing member.

60. The image forming apparatus according to claim 44, wherein the control unit controls at least one member selected from the group consisting of a rotation speed of the image bearing member and a rotation speed of the developing member so that a surficial moving speed of the developing member is higher than a surficial moving speed of the image bearing member, and the control unit performs control so that a speed difference between the surficial moving speed of the developing member and the surficial moving speed of the image bearing member during the application operation is larger than the speed difference during the image forming operation.

61. The image forming apparatus according to claim 44, further comprising:

a second voltage applying unit that applies a developing voltage to the developing member whereas the voltage applying unit that applies the charging voltage to the charging member is assumed to be a first voltage applying unit, wherein, when a difference between a surface potential of the surface of the image bearing member, which is charged by the charging member, in the developing portion and the developing voltage applied to the developing member by the second voltage applying unit is assumed to be a back contrast, the control unit performs control so that the back contrast during the application operation is larger than the back contrast during the image forming operation.

62. The image forming apparatus according to claim 61, further comprising:

a toner supplying member that contacts the developing member to form a contact portion and supplies the toner at the contact portion; and a third voltage applying unit that applies a toner supplying voltage to the toner supplying member, wherein, during the application operation, the control unit controls the second voltage applying unit and the third voltage applying unit so that a potential difference is formed in the contact portion, the potential difference generating an electrostatic force that induces the metal soap to move from the toner supplying member toward the developing member.

63. The image forming apparatus according to claim 44, wherein, during the application operation, the developing member contacts the image bearing member in the developing portion.

64. The image forming apparatus according to claim 44, wherein a surficial moving speed at which the developing member rotates during the image forming operation is different from that during the application operation.

65. The image forming apparatus according to claim 44, wherein a surficial moving speed at which the image bearing member rotates during the image forming operation is different from that during the application operation.

66. The image forming apparatus according to claim 44, wherein, in a rotation axis direction of the image bearing member, a range of a ten-point average surface roughness (Rz) of the surface of the image bearing member is $0.10 \leq Rz \leq 0.70$ (μm), and a range of an average interval (Sm) between concavities and convexities on the surface of the image bearing member is $0 < Sm \leq 70$ (μm).

67. The image forming apparatus according to claim 44, wherein the toner contains an organic silicon polymer, and a number of carbon atoms directly bonded to a silicon atom in the organic silicon polymer is 1 or more and 3 or less.

68. The image forming apparatus according to claim 67, wherein the organic silicon polymer has a partial structure represented by R—SiO3/2, where R represents a hydrocarbon group having 1 to 6 carbon atoms.

69. The image forming apparatus according to claim 68, wherein R represents a hydrocarbon group having 1 to 3 carbon atoms.

70. The image forming apparatus according to claim 44, further comprising:

an intermediate transfer body that contacts the image bearing member to form a transfer portion and bears the toner image formed on the surface of the image bearing member in the transfer portion;

a transfer member that transfers the toner image borne on the intermediate transfer body onto a recording material; and an exposing unit that exposes a surface of the image bearing member with light, the exposing unit exposing a surface of the image bearing member on a downstream with respect to a rotation direction of the image bearing member of the transfer portion in the image bearing member and upstream with respect to the rotation direction of a charging portion where the image bearing member and the charging portion face each other, wherein the control unit performs control so that an exposure amount of the exposing unit during the application operation is smaller than the exposure amount of the exposing unit during the image forming operation.

71. The image forming apparatus according to claim 70, wherein exposure by the exposing unit is not performed during the application operation.

72. The image forming apparatus according to claim 44, wherein a metal species of the metal soap is at least one member selected from the group consisting of zinc, calcium, and magnesium.

73. The image forming apparatus according to claim 44, wherein the metal soap is at least one member selected from the group consisting of zinc stearate, calcium stearate, and magnesium stearate.

74. The image forming apparatus according to claim 44, wherein the metal soap has a particle diameter of 0.15 μm or more and 2.0 μm or less.

* * * * *